US012319487B2

(12) United States Patent
Baba et al.

(10) Patent No.: US 12,319,487 B2
(45) Date of Patent: Jun. 3, 2025

(54) LIQUID-CONTAINING COMBINATION CONTAINER, CONTAINER SET, AND METHOD OF MANUFACTURING LIQUID-CONTAINING CONTAINER

(71) Applicant: DAI NIPPON PRINTING CO., LTD., Tokyo-to (JP)

(72) Inventors: Takuma Baba, Tokyo-to (JP); Hiroyuki Kobori, Tokyo-to (JP); Reiko Shimizu, Tokyo-to (JP); Hisashi Aizawa, Tokyo-to (JP); Kazuhiro Takushima, Tokyo-to (JP)

(73) Assignee: DAI NIPPON PRINTING CO., LTD., Tokyo (JP)

( * ) Notice: Subject to any disclaimer, the term of this patent is extended or adjusted under 35 U.S.C. 154(b) by 0 days.

(21) Appl. No.: 18/283,923

(22) PCT Filed: Mar. 24, 2022

(86) PCT No.: PCT/JP2022/014192
§ 371 (c)(1),
(2) Date: Jan. 5, 2024

(87) PCT Pub. No.: WO2022/203029
PCT Pub. Date: Sep. 29, 2022

(65) Prior Publication Data

US 2024/0199305 A1 Jun. 20, 2024

(30) Foreign Application Priority Data

Mar. 24, 2021 (JP) ..... 2021-050769
Sep. 22, 2021 (JP) ..... 2021-154831
Dec. 28, 2021 (JP) ..... 2021-215291

(51) Int. Cl.
*B65D 81/26* (2006.01)
*B65D 77/04* (2006.01)
*B65D 81/24* (2006.01)

(52) U.S. Cl.
CPC ..... *B65D 81/268* (2013.01); *B65D 77/0406* (2013.01); *B65D 81/245* (2013.01)

(58) Field of Classification Search
CPC ..... B65D 81/268; B65D 81/245; B65D 77/0406; B65D 51/002; A61J 1/065; A61J 1/16
(Continued)

(56) References Cited

U.S. PATENT DOCUMENTS 10,065,784 B2 * 9/2018 Tanoguchi ..... A61J 1/10
2007/0163917 A1 * 7/2007 Friesen ..... A61J 1/00 206/528

(Continued)

FOREIGN PATENT DOCUMENTS

JP S56-125876 U 9/1981
JP S63-275346 A 11/1988

(Continued)

OTHER PUBLICATIONS

Jun. 7, 2022 International Search Report issued in International Patent Application No. PCT/JP2022/014193.

(Continued)

*Primary Examiner* — Steven A. Reynolds
(74) *Attorney, Agent, or Firm* — Oliff PLC

(57) ABSTRACT

A liquid-containing combination container includes a first container that contains a liquid, a second container that contains the first container and that has an oxygen barrier property, and an oxygen absorber that absorbs oxygen in the second container. The first container includes a container (Continued)

body that includes an opening portion and a stopper that closes the opening portion, the stopper has oxygen permeability.

20 Claims, 35 Drawing Sheets

(58) Field of Classification Search
USPC ..... 206/204, 438
See application file for complete search history.

(56) References Cited

U.S. PATENT DOCUMENTS

| | | | | |
|---|---|---|---|---|
| 2014/0262883 | A1* | 9/2014 | Devouassoux | B65D 75/36 206/364 |
| 2018/0009583 | A1* | 1/2018 | Fukushi | B65D 51/002 |

FOREIGN PATENT DOCUMENTS

| | | | |
|---|---|---|---|
| JP | H04-200465 | A | 7/1992 |
| JP | H05-319459 | A | 12/1993 |
| JP | H07-165252 | A | 6/1995 |
| JP | H09-051785 | A | 2/1997 |
| JP | 2002-159559 | A | 6/2002 |
| JP | 2003-341737 | A | 12/2003 |
| JP | 2005-006737 | A | 1/2005 |
| JP | 2008-222270 | A | 9/2008 |
| JP | 2011-212366 | A | 10/2011 |
| JP | 2012-125436 | A | 7/2012 |
| JP | 3180810 | U | 1/2013 |
| JP | 2015-117062 | A | 6/2015 |
| JP | 2015-189497 | A | 11/2015 |
| JP | 3223227 | U | 9/2019 |
| WO | 2014/140097 | A1 | 9/2014 |

OTHER PUBLICATIONS

Sep. 12, 2023 International Preliminary Report on Patentability issued in International Patent Application No. PCT/JP2022/014193.
Jun. 7, 2022 International Search Report issued in International Patent Application No. PCT/JP2022/014192.
Sep. 12, 2023 International Preliminary Report on Patentability issued in International Patent Application No. PCT/JP2022/014192.
Feb. 15, 2022 Office Action issued in Japanese Patent Application No. 2021-050769.
Feb. 15, 2022 Office Action issued in Japanese Patent Application No. 2021-050742.
Jan. 6, 2023 Office Action issued in Japanese Patent Application No. 2022-569275.
Feb. 17, 2023 Office Action issued in Japanese Patent Application No. 2022-569275.
U.S. Appl. No. 18/283,876, filed Jan. 4, 2024 in the name of Takuma Baba et al.

* cited by examiner

LIQUID-CONTAINING COMBINATION CONTAINER, CONTAINER SET, AND METHOD OF MANUFACTURING LIQUID-CONTAINING CONTAINER

TECHNICAL FIELD

The present disclosure relates to a liquid-containing combination container, a container set, and a method of manufacturing a liquid-containing container.

BACKGROUND ART

A known container contains a liquid (for example, PTL 1). The liquid is decomposed in the container due to oxygen depending on the kind of the liquid. It can be understood that a container that has an oxygen barrier property is used in order to deal with this failure.

PTL 1: JP2011-212366A

SUMMARY OF INVENTION

However, oxygen can be dissolved in the liquid when the liquid is manufactured. As for the container that has the oxygen barrier property, the degradation of the liquid caused by the dissolved oxygen in the liquid cannot be dealt with. That is, an existing technique cannot sufficiently reduce the degradation of the liquid that is contained in the container due to oxygen. It is an object of the present disclosure to reduce the degradation of a liquid due to oxygen.

A first liquid-containing combination container according to the present disclosure includes a first container that contains a liquid, and a second container that contains the first container and that has an oxygen barrier property, and the first container contains silicone.

As for the first liquid-containing combination container according to the present disclosure, the first container may include a container body that includes an opening portion and a stopper that closes the opening portion, and the stopper may contain silicone.

A second liquid-containing combination container according to the present disclosure includes a first container that contains a liquid, and a second container that contains the first container and that has an oxygen barrier property, and the first container includes a container body that includes an opening portion and a stopper that closes the opening portion, and the stopper has oxygen permeability.

As for the first and second liquid-containing combination containers according to the present disclosure, an oxygen permeability coefficient ($cm^3$ (STP)·cm/($cm^2$·sec·Pa)) of a material of the stopper may be higher than an oxygen permeability coefficient ($cm^3$ (STP)·cm/($cm^2$·sec·Pa)) of a material of the container body.

As for the first and second liquid-containing combination containers according to the present disclosure, an oxygen permeability coefficient of a material of the stopper may be $1\times10^{-12}$ ($cm^3$ (STP)·cm/($cm^2$·sec·Pa)) or more.

A third liquid-containing combination container according to the present disclosure includes a first container that contains a liquid, and a second container that contains the first container and that has an oxygen barrier property, the first container includes a container body that includes an opening portion and a stopper that closes the opening portion, and an oxygen permeability coefficient of a material of the stopper is $1\times10^{11}$ ($cm^3$ (STP)·cm/($cm^2$·sec·Pa)) or more.

As for the first to third liquid-containing combination containers according to the present disclosure, an opening area of the container body may be 1 $mm^2$ or more, and a thickness of the stopper may be 5 mm or less.

As for the first to third liquid-containing combination containers according to the present disclosure, the container body may have an oxygen barrier property.

As for the first to third liquid-containing combination containers according to the present disclosure, an oxygen concentration in the first container may be equal to an oxygen concentration in the second container.

As for the first to third liquid-containing combination containers according to the present disclosure, an oxygen concentration in the first container may be 0.05% or less, and an oxygen concentration in the second container may be less than 0.3%.

A fourth liquid-containing combination container according to the present disclosure includes a first container that contains a liquid and that has oxygen permeability and a second container that contains the first container and that has an oxygen barrier property, an oxygen concentration in the first container is less than 0.3%, and an oxygen concentration in the second container is 0.05% or less.

As for the first to fourth liquid-containing combination containers according to the present disclosure, an amount of dissolved oxygen in the liquid in the first container may be less than 0.15 mg/L.

A fifth liquid-containing combination container according to the present disclosure includes a first container that contains a liquid and that has oxygen permeability and a second container that contains the first container and that has an oxygen barrier property, and an amount of dissolved oxygen in the liquid in the first container is less than 0.15 mg/L.

As for the first to fifth liquid-containing combination containers according to the present disclosure, an oxygen absorber that absorbs oxygen in the second container may be provided.

As for the first to fifth liquid-containing combination containers according to the present disclosure, the first container may include a syringe that includes a cylinder and a piston that is inserted into the cylinder, and the syringe may contain the liquid in a container space that is defined by the cylinder and the piston.

As for the first to fifth liquid-containing combination containers according to the present disclosure, the piston may include a gasket that is disposed in the cylinder and that defines the container space, and the gasket may have oxygen permeability.

As for the first to fifth liquid-containing combination containers according to the present disclosure, the syringe may include a stopper that closes an opening portion that is provided in the cylinder, and the stopper may have oxygen permeability.

A sixth liquid-containing combination container according to the present disclosure includes a first container that contains a liquid and that has oxygen permeability and a second container that contains the first container and that has an oxygen barrier property, and an oxygen absorber that absorbs oxygen in the second container is provided.

As for the first to sixth liquid-containing combination containers according to the present disclosure, the container body may have an oxygen barrier property. As for the first to sixth liquid-containing combination containers according to the present disclosure, the container body may be composed of glass.

As for the first to sixth liquid-containing combination containers according to the present disclosure, the stopper may have oxygen permeability. As for the first to sixth liquid-containing combination containers according to the present disclosure, the stopper may contain silicone.

As for the first to sixth liquid-containing combination containers according to the present disclosure, a dehydrating agent that absorbs moisture in the second container may be provided.

As for the first to sixth liquid-containing combination containers according to the present disclosure, a partial volume of the first container obtained by subtracting a volume of the liquid from a volume of the first container may be 50 ml or less.

As for the first to sixth liquid-containing combination containers according to the present disclosure, a volume of the liquid that is contained in the first container may be 20 mL or less.

As for the first to sixth liquid-containing combination containers according to the present disclosure, the first container may include a fixture that is mounted on the container body and that fixes the stopper to the container body, the stopper may include a plate portion that is disposed on the container body and that covers the opening portion and an insertion projection that projects from the plate portion and that is inserted into the opening portion, the fixture may cover a periphery of the plate portion, and the fixture may have an exposure hole through which a region of the plate portion that is exposed to an inside of the container body is exposed. The container body may have an oxygen barrier property. The container body may be composed of glass. The fixture may have an oxygen barrier property. The fixture may be composed of metal. The stopper may have oxygen permeability. The stopper may contain silicone.

As for the first to sixth liquid-containing combination containers according to the present disclosure, a step may be formed between a portion around the exposure hole of the fixture and a portion of the stopper that is exposed to an inside of the exposure hole.

As for the first to sixth liquid-containing combination containers according to the present disclosure, a portion around the exposure hole of the fixture may include a bent portion that bends such that the bent portion approaches the plate portion and may press the plate portion toward an inner portion of the container body.

As for the first to sixth liquid-containing combination containers according to the present disclosure, a portion of the stopper that is exposed to an inside of the exposure hole may include a linear projecting portion that linearly extends, and the linear projecting portion may indicate a position of a region of the plate portion that is exposed to an inside of the container body.

As for the first to sixth liquid-containing combination containers according to the present disclosure, a portion of the stopper that is exposed to an inside of the exposure hole may include a linear projecting portion that linearly extends, and the linear projecting portion may extend on a peripheral portion of a region of the plate portion that is exposed to an inside of the container body.

As for the first to sixth liquid-containing combination containers according to the present disclosure, a portion of the stopper that is exposed to an inside of the exposure hole may include a linear projecting portion that linearly extends, a part of the linear projecting portion may be covered by the fixture, and the other part of the linear projecting portion may be exposed to the inside of the exposure hole.

As for the first to sixth liquid-containing combination containers according to the present disclosure, a gap may be formed between a portion around the exposure hole of the fixture and a portion adjacent to the linear projecting portion of the stopper.

As for the first to sixth liquid-containing combination containers according to the present disclosure, the linear projecting portion may include multiple linear projecting portions that are separated from each other, and an end portion of the linear projecting portion that is exposed to an inside of the exposure hole may be located on a region of the plate portion that is exposed to an inside of the container body.

As for the first to sixth liquid-containing combination containers according to the present disclosure, the second container may include a to-be-opened portion (opening-intention portion) that is to be opened, and an oxygen absorber may be between the to-be-opened portion of the second container and the first container.

As for the first to sixth liquid-containing combination containers according to the present disclosure, the first container may include a container body that includes an opening portion and a stopper that closes the opening portion, the container body may have an oxygen barrier property, the stopper has oxygen permeability, and an oxygen absorber may be between the second container and the stopper.

As for the first to sixth liquid-containing combination containers according to the present disclosure, a deoxygenated member that includes the oxygen absorber and a parcel that contains the oxygen absorber may be attached to (mounted on) the second container.

The first to sixth liquid-containing combination containers according to the present disclosure may include an oxygen absorber that is disposed on a portion of the first container that has oxygen permeability.

As for the first to sixth liquid-containing combination containers according to the present disclosure, the first container may include a container body that includes an opening portion and a stopper that closes the opening portion, the container body may have an oxygen barrier property, the stopper may have oxygen permeability, and an oxygen absorber may face the stopper.

The first to sixth liquid-containing combination containers according to the present disclosure may include an oxygen absorber, and the oxygen absorber may be at least partly located above a portion of the first container that has the oxygen permeability.

As for the first to sixth liquid-containing combination containers according to the present disclosure, the first container may include a fixture that is mounted on the container body and that fixes the stopper to the container body, and a deoxygenated member that includes the oxygen absorber and a parcel that contains the oxygen absorber may be attached to (mounted on) the fixture.

As for the first to sixth liquid-containing combination containers according to the present disclosure, the liquid may contain an aqueous solution, a deoxygenated member that includes the oxygen absorber does not contain a water retention agent or contains a water retention agent that is capable of retaining moisture in a volume equal to or less than 5% of an initial volume of the liquid.

As for the first to sixth liquid-containing combination containers according to the present disclosure, the liquid may contain alcohol or oil, and a deoxygenated member that includes the oxygen absorber may contain a water retention agent that retains moisture.

As for the first to sixth liquid-containing combination containers according to the present disclosure, the liquid may contain a non-aqueous solvent, and a deoxygenated member that includes the oxygen absorber may contain a water retention agent that retains moisture. The non-aqueous solvent may be a solvent in which a main component is not water. A ratio of a volume of moisture to the non-aqueous solvent may be 2% or less, may be 1% or less, or may be 0.5% or less.

As for the first to sixth liquid-containing combination containers according to the present disclosure, the first container may include a container body that includes an opening portion and a stopper that closes the opening portion, the stopper may have oxygen permeability, and a contact angle of an inner surface of the stopper may be 80° or more.

As for the first to sixth liquid-containing combination containers according to the present disclosure, the first container may include a container body that includes an opening portion and a stopper that closes the opening portion, the stopper may be permeable to oxygen, a sheet that has oxygen permeability and liquid repellency may be provided between a liquid that is contained in the container body and the stopper.

As for the first to sixth liquid-containing combination containers according to the present disclosure, the sheet may be held between the stopper and the container body.

As for the first to sixth liquid-containing combination containers according to the present disclosure, the first container may include a container body that includes an opening portion and a stopper that closes the opening portion, the stopper is permeable to oxygen, and a recessed portion that is capable of holding gas may be provided on an inner surface of the stopper.

As for the first to sixth liquid-containing combination containers according to the present disclosure, the first container may include a container body that includes an opening portion, a stopper that closes the opening portion, and an extension wall portion that extends from an inner surface of the container body.

As for the first to sixth liquid-containing combination containers according to the present disclosure, the first container may include a container body that includes an opening portion, a stopper that closes the opening portion, and an extension wall portion that extends from an inner surface of the container body, the extension wall portion may have an annular shape that includes an outer periphery and an inner periphery, the extension wall portion may be connected to the inner surface of the container body over the entire length of the outer periphery, and a hole that is defined by the inner periphery may be provided.

As for the first to sixth liquid-containing combination containers according to the present disclosure, the first container may include a container body that includes an opening portion and a stopper that closes the opening portion, the stopper may be permeable to oxygen, an outer surface of the stopper may have unevenness or may include a projection that projects from the outer surface of the stopper.

As for the first to sixth liquid-containing combination containers according to the present disclosure, the first container may include a container body that includes an opening portion and a stopper that closes the opening portion, the stopper may be permeable to oxygen, an inner surface of the stopper may have unevenness or may include a projection that projects from the inner surface of the stopper.

A seventh liquid-containing combination container according to the present disclosure includes a first container that contains a liquid, and a second container that contains the first container and that has an oxygen barrier property, the first container includes a container body that includes an opening portion and a stopper that closes the opening portion, the stopper has oxygen permeability, and a gap is formed between the stopper of the first container that is contained in the second container and the second container.

An eighth liquid-containing combination container according to the present disclosure includes a first container that contains a liquid, a tray that contains the first container, and a second container that has an oxygen barrier property and that contains the tray that contains the first container, the first container includes a container body that includes an opening portion and a stopper that closes the opening portion, the stopper has oxygen permeability, a portion of the tray is located between the stopper and the second container, and a gap is formed between the tray and the stopper.

As for the eighth liquid-containing combination container according to the present disclosure, the tray may include a bottom wall and a side wall that is connected to the bottom wall, the side wall may include a first side wall portion that faces the stopper of the first container that is contained in the tray and a second side wall portion that faces the first side wall portion, and the gap may be formed between the first side wall portion and the stopper.

As for the eighth liquid-containing combination container according to the present disclosure, the second container may be a film container, the second side wall portion may be capable of being disposed so as to face a placement surface on which the liquid-containing combination container is placed with the second container interposed therebetween.

As for the eighth liquid-containing combination container according to the present disclosure, the second side wall portion may be capable of being disposed so as to face a placement surface on which the liquid-containing combination container is placed with the second container interposed therebetween such that the bottom wall inclines with respect to the placement surface.

As for the eighth liquid-containing combination container according to the present disclosure, the tray may include a recessed portion, a projecting portion, a hole, or a combination thereof.

As for the eighth liquid-containing combination container according to the present disclosure, the tray may include a bottom wall and a side wall that is connected to the bottom wall, and a flange portion that extends from the side wall, and the flange portion may include the recessed portion or the projecting portion.

A ninth liquid-containing combination container according to the present disclosure includes a first container that contains a liquid, and a second container that contains the first container and that has an oxygen barrier property, the first container includes a container body that includes an opening portion and a stopper that closes the opening portion, the stopper has oxygen permeability, the second container includes a tray that includes an opening portion and that contains the first container and a lid member that closes the opening portion of the tray, the tray includes a bottom wall and a side wall that is connected to the bottom wall and that faces the stopper, and a gap is formed between the side wall and the stopper.

As for the ninth liquid-containing combination container according to the present disclosure, the side wall may include a first side wall portion that faces the stopper of the first container that is contained in the tray and a second side wall portion that faces the first side wall portion, the gap may be formed between the first side wall portion and the stopper, and the second side wall portion may be capable of being disposed so as to be located on a placement surface on which the liquid-containing combination container is placed.

As for the ninth liquid-containing combination container according to the present disclosure, the second side wall portion may be capable of being disposed so as to be placed on a placement surface on which the liquid-containing combination container is placed such that the bottom wall inclines with respect to the placement surface.

The eighth and ninth liquid-containing combination containers according to the present disclosure may include an oxygen absorber that absorbs oxygen in the second container, and the oxygen absorber may be located between the tray and the first container.

As for the eighth and ninth liquid-containing combination containers according to the present disclosure, the tray may include a bottom wall and a side wall that is connected to the bottom wall, the side wall may include a first side wall portion that faces the stopper of the first container that is contained in the tray and a second side wall portion that faces the first side wall portion, and the oxygen absorber may be located between the first side wall portion and the stopper.

The eighth liquid-containing combination container according to the present disclosure may include an oxygen absorber that absorbs oxygen in the second container, and the oxygen absorber may be located between the tray and the second container.

The ninth liquid-containing combination container according to the present disclosure may include an oxygen absorber that absorbs oxygen in the second container, and the oxygen absorber may be held by the lid member.

As for the eighth and ninth liquid-containing combination containers according to the present disclosure, the tray may include a bottom wall and a side wall that is connected to the bottom wall, and the bottom wall may include a projection that is inserted into a recessed portion between the stopper and the container body.

A tenth liquid-containing combination container according to the present disclosure includes a first container that contains a liquid, and a second container that contains the first container and that has an oxygen barrier property, the first container includes a container body that includes an opening portion and a stopper that closes the opening portion, the stopper has oxygen permeability, the second container includes a first film and a second film that contains the first container between the second film and the first film, the first film and the second film are joined at a seal portion so as to be capable of being peeled, the seal portion includes a first seal portion that bends, and the first seal portion projects so as to be separated from the stopper in a direction in which the first seal portion and the stopper face each other.

The tenth liquid-containing combination container according to the present disclosure may include an oxygen absorber between the first seal portion and the stopper.

As for the tenth liquid-containing combination container according to the present disclosure, the stopper may face the first seal portion, the seal portion may include a first side seal portion that is connected to an end of the first seal portion and a second side seal portion that is connected to the other end of the first seal portion, a container space in which the first container is contained may be formed between the first side seal portion and the second side seal portion, a minimum distance along the first film between the first side seal portion and the second side seal portion and a minimum distance along the second film between the first side seal portion and the second side seal portion may be shorter than a length of the first container in a direction in which the stopper is inserted into the opening portion.

An eleventh liquid-containing combination container according to the present disclosure includes a first container that contains a liquid, and a second container that contains the first container and that has an oxygen barrier property, the first container includes a container body that includes an opening portion and a stopper that closes the opening portion, the stopper is permeable to oxygen, the second container includes a first film and a second film that contains the first container between the second film and the first film, the second container is opened in a manner in which the first film and the second film are cut at a to-be-opened portion (opening intention portion), the first film and the second film are joined at a seal portion, the seal portion includes a first side seal portion and a second side seal portion that are separated in a longitudinal direction of the to-be-opened portion, and a through-portion that extends through the first film and the second film is provided at a position at which the second side seal portion intersects with the to-be-opened portion.

As for the eleventh liquid-containing combination container according to the present disclosure, the first side seal portion may have a notch that corresponds to an end of the to-be-opened portion.

As for the eleventh liquid-containing combination container according to the present disclosure, the second side seal portion may include a wide portion that is wider than an adjacent portion, and the through-portion may be provided at a position at which the wide portion intersects with the to-be-opened portion.

As for the eleventh liquid-containing combination container according to the present disclosure, the second side seal portion may include an inner edge that projects such that the inner edge approaches the first side seal portion at the wide portion.

As for the eleventh liquid-containing combination container according to the present disclosure, the first container may be contained in the second container such that the stopper faces a space in the second container between the first side seal portion and the wide portion.

The eleventh liquid-containing combination container according to the present disclosure may include an oxygen absorber that absorbs oxygen in the second container, and the oxygen absorber may be held by the second container at a position away from the wide portion in a direction in which the space in the second container faces the stopper.

The eleventh liquid-containing combination container according to the present disclosure may include an oxygen absorber between the to-be-opened portion (opening intention portion) and the first container.

A twelfth liquid-containing combination container according to the present disclosure includes a first container that contains a liquid, a second container that contains the first container and that has an oxygen barrier property, and an outer box that contains the second container, the first container includes a container body that includes an opening portion and a stopper that closes the opening portion, the stopper has oxygen permeability, the second container includes a first film and a second film that contains the first container between the second film and the first film, the first film and the second film are joined at a seal portion so as to be capable of being peeled, the outer box includes an outer box body and a lid portion that relatively moves with respect to the outer box body and that opens the outer box, the first film is attached to (mounted on) the outer box body, the second film is attached to (mounted on) the lid portion, the lid portion is relatively moved with respect to the outer box body, the second film is consequently peeled from the first film at the seal portion, and the second container is opened.

As for the twelfth liquid-containing combination container according to the present disclosure, the outer box may include a transparent portion that is transparent.

A thirteenth liquid-containing combination container according to the present disclosure includes a first container that contains a liquid, and a second container that contains the first container and that has an oxygen barrier property, the first container includes a container body that includes an opening portion and a stopper that closes the opening portion, the stopper has oxygen permeability, the second container includes a first film, a second film that is joined to the first film and that contains the first container between the second film and the first film, and a gas bag (gas package, gas pouch) that is provided between the first film and the second film and that contains gas.

As for the thirteenth liquid-containing combination container according to the present disclosure, the gas bag may be joined to the first film and the second film.

As for the thirteenth liquid-containing combination container according to the present disclosure, the first film and the second film may be joined at a seal portion, and the gas bag may be joined to the first film and the second film at the seal portion.

As for the thirteenth liquid-containing combination container according to the present disclosure, the seal portion may include a first side seal portion and a second side seal portion that are separated in a width direction, the gas bag may include a first gas bag that is joined to the first film and the second film at the first side seal portion and a second gas bag that is joined to the first film and the second film at the second side seal portion, and the first container may be located between the first gas bag and the second gas bag.

The thirteenth liquid-containing combination container according to the present disclosure may include an oxygen absorber that absorbs oxygen in the second container, and the oxygen absorber may be held between the gas bag and one of the first film and the second film.

A first container set according to the present disclosure includes a first container that contains a liquid, and a second container that is capable of containing the first container and that has an oxygen barrier property, and the first container contains silicone.

As for the first container set according to the present disclosure, the first container may include a container body that includes an opening portion and a stopper that closes the opening portion, and the stopper may contain silicone.

A second container set according to the present disclosure includes a first container that contains a liquid, and a second container that is capable of containing the first container and that has an oxygen barrier property, the first container includes a container body that includes an opening portion and a stopper that closes the opening portion, and the stopper has oxygen permeability.

A third container set according to the present disclosure includes a first container that contains a liquid, and a second container that is capable of containing the first container and that has an oxygen barrier property, the first container includes a container body that includes an opening portion and a stopper that closes the opening portion, and an oxygen permeability coefficient of a material of the stopper is $1\times10^{-12}$ ($cm^3$ (STP)·cm/($cm^2$·sec·Pa)) or more.

As for the first to third container sets according to the present disclosure, an oxygen concentration in the first container may be 1.5% or less.

A fourth container set according to the present disclosure includes a first container that contains a liquid and that has oxygen permeability, and a second container that is capable of containing the first container and that has an oxygen barrier property, and an oxygen concentration in the first container is 1.5% or less.

A fifth container set according to the present disclosure includes a first container that contains a liquid and that has oxygen permeability, a second container that is capable of containing the first container and that has an oxygen barrier property, and an oxygen absorber that absorbs oxygen in the second container.

A sixth container set according to the present disclosure includes a first container that contains a liquid, and a second container that is capable of containing the first container and that has an oxygen barrier property, and the first container includes a container body that includes an opening portion and a stopper that closes the opening portion, the stopper has oxygen permeability, and a gap is formed between the stopper of the first container that is contained in the second container and the second container.

A seventh container set according to the present disclosure includes a first container that contains a liquid, a tray that is capable of containing the first container, and a second container that has an oxygen barrier property and that is capable of containing the tray that contains the first container, the first container includes a container body that includes an opening portion and a stopper that closes the opening portion, the stopper has oxygen permeability, the tray is located between the stopper and the second container, and a gap is formed between the tray and the stopper.

An eighth container set according to the present disclosure includes a first container that contains a liquid, and a second container that is capable of containing the first container and that has an oxygen barrier property, the first container includes a container body that includes an opening portion and a stopper that closes the opening portion, the stopper has oxygen permeability, the second container includes a tray that includes an opening portion and that contains the first container and a lid member that closes the opening portion of the tray, the tray includes a bottom wall and a side wall that is connected to the bottom wall and that faces the stopper, and a gap is formed between the side wall and the stopper.

A ninth container set according to the present disclosure includes a first container that contains a liquid, and a second container that is capable of containing the first container and that has an oxygen barrier property, the first container includes a container body that includes an opening portion and a stopper that closes the opening portion, the stopper has oxygen permeability, the second container includes a first film and a second film that contains the first container between the second film and the first film, the first film and the second film are joined at a seal portion so as to be capable of being peeled, the seal portion includes a first seal portion that bends, and the first seal portion projects so as to be separated from the stopper in a direction in which the first seal portion and the stopper face each other.

A tenth container set according to the present disclosure includes a first container that contains a liquid, and a second container that is capable of containing the first container and that has an oxygen barrier property, the first container includes a container body that includes an opening portion and a stopper that closes the opening portion, the stopper has oxygen permeability, the second container includes a first film and a second film that contains the first container between the second film and the first film, the second container is opened in a manner in which the first film and the second film are cut at a to-be-opened portion (opening intention portion), the first film and the second film are joined at a seal portion, the seal portion includes a first side seal portion and a second side seal portion that are separated in a longitudinal direction of the to-be-opened portion, and a through-portion that extends through the first film and the second film is provided at a position at which the second side seal portion intersects with the to-be-opened portion.

An eleventh container set according to the present disclosure includes a first container that contains a liquid, a second container that is capable of containing the first container and that has an oxygen barrier property, and an outer box that is capable of containing the second container, the first container includes a container body that includes an opening portion and a stopper that closes the opening portion, the stopper has oxygen permeability, the second container includes a first film and a second film that contains the first container between the second film and the first film, the first film and the second film are joined at a seal portion so as to be capable of being peeled, the outer box includes an outer box body and a lid portion that relatively moves with respect to the outer box body and that opens the outer box, the first film is attached to (mounted on) the outer box body, the second film is attached to (mounted on) the lid portion, the lid portion is relatively moved with respect to the outer box body, the second film is consequently peeled from the first film at the seal portion, and the second container is opened.

A twelfth container set according to the present disclosure includes a first container that contains a liquid, and a second container that is capable of containing the first container and that has an oxygen barrier property, the first container includes a container body that includes an opening portion and a stopper that closes the opening portion, the stopper has oxygen permeability, and the second container includes a first film, a second film that is joined to the first film and that contains the first container between the second film and the first film, and a gas bag that is provided between the first film and the second film and that contains gas.

A first method of manufacturing a liquid-containing container according to the present disclosure includes closing a second container that contains a first container, and adjusting an amount of oxygen in the first container, the first container contains a liquid and has oxygen permeability, the second container has an oxygen barrier property. In the adjusting the amount of oxygen, oxygen in the first container permeates the first container, and an oxygen concentration in the first container reduces.

In the first method of manufacturing the liquid-containing container according to the present disclosure, the first container may contain silicone.

In the first method of manufacturing the liquid-containing container according to the present disclosure, the first container may include a container body that includes an opening portion and a stopper that closes the opening portion, and the stopper may contain silicone.

In the first method of manufacturing the liquid-containing container according to the present disclosure, the first container may include a container body that includes an opening portion and a stopper that closes the opening portion, and the stopper may have the oxygen permeability.

In the first method of manufacturing the liquid-containing container according to the present disclosure, the first container may include a container body that includes an opening portion and a stopper that closes the opening portion, an oxygen permeability coefficient ($cm^3$ (STP)·cm/($cm^2$ sec·Pa)) of a material of the stopper may be higher than an oxygen permeability coefficient ($cm^3$ (STP)·cm/($cm^2$·sec·Pa)) of a material of the container body.

In the first method of manufacturing the liquid-containing container according to the present disclosure, the first container may include a container body that includes an opening portion and a stopper that closes the opening portion, an oxygen permeability coefficient of a material of the stopper may be $1\times10^{-12}$ ($cm^3$ (STP)·cm/($cm^2$ sec·Pa)) or more.

At the adjusting the amount of oxygen in the first method of manufacturing the liquid-containing container according to the present disclosure, an oxygen concentration (%) in the first container and an oxygen concentration (%) in the second container may be equal to each other.

At the adjusting the amount of oxygen in the first method of manufacturing the liquid-containing container according to the present disclosure, an oxygen concentration in the first container may be less than 0.3%, and an oxygen concentration in the second container may be 0.05% or less.

At the adjusting the amount of oxygen in the first method of manufacturing the liquid-containing container according to the present disclosure, an amount of dissolved oxygen in the liquid in the first container may be less than 0.15 mg/L.

In the first method of manufacturing the liquid-containing container according to the present disclosure, an oxygen absorber that absorbs oxygen in the second container may be provided.

In the first method of manufacturing the liquid-containing container according to the present disclosure, a dehydrating agent that absorbs moisture in the second container may be provided.

In the first method of manufacturing the liquid-containing container according to the present disclosure, a period until equilibrium of permeation of oxygen through the first container is reached after the second container is closed may be within four weeks.

A second method of manufacturing a liquid-containing container according to the present disclosure is a method of manufacturing a liquid-containing container by using any one of the seventh to thirteenth liquid-containing combination containers according to the present disclosure and includes closing a second container that contains a first container and adjusting an oxygen concentration in a manner in which an oxygen absorber absorbs oxygen in the second container. In the adjusting the oxygen concentration, oxygen in the first container permeates the stopper, moves to a position outside the first container, and is absorbed by the oxygen absorber in the second container.

A third method of manufacturing a liquid-containing container according to the present disclosure is a method of manufacturing a liquid-containing container by using the eighth liquid-containing combination container according to the present disclosure and includes closing a second container that contains a first container and adjusting an oxygen concentration in a manner in which an oxygen absorber absorbs oxygen in the second container, in the adjusting the oxygen concentration, oxygen in the first container permeates the stopper, moves to a position outside the first container, and is absorbed by the oxygen absorber in the second container, and the liquid-containing combination container is disposed on a placement surface such that the second side wall portion faces the placement surface on which the liquid-containing combination container is placed with the second container interposed therebetween.

A fourth method of manufacturing a liquid-containing container according to the present disclosure is a method of manufacturing a liquid-containing container by using the ninth liquid-containing combination container according to the present disclosure and includes closing a second container that contains a first container and adjusting an oxygen concentration in a manner in which an oxygen absorber absorbs oxygen in the second container, in the adjusting the oxygen concentration, oxygen in the first container permeates the stopper, moves to a position outside the first container, and is absorbed by the oxygen absorber in the second container, and the liquid-containing combination container is disposed on a placement surface such that the second side wall portion faces the placement surface on which the liquid-containing combination container is placed.

According to the present disclosure, a liquid can be inhibited from deteriorating due to oxygen.

DESCRIPTION OF EMBODIMENTS

Figure 1:
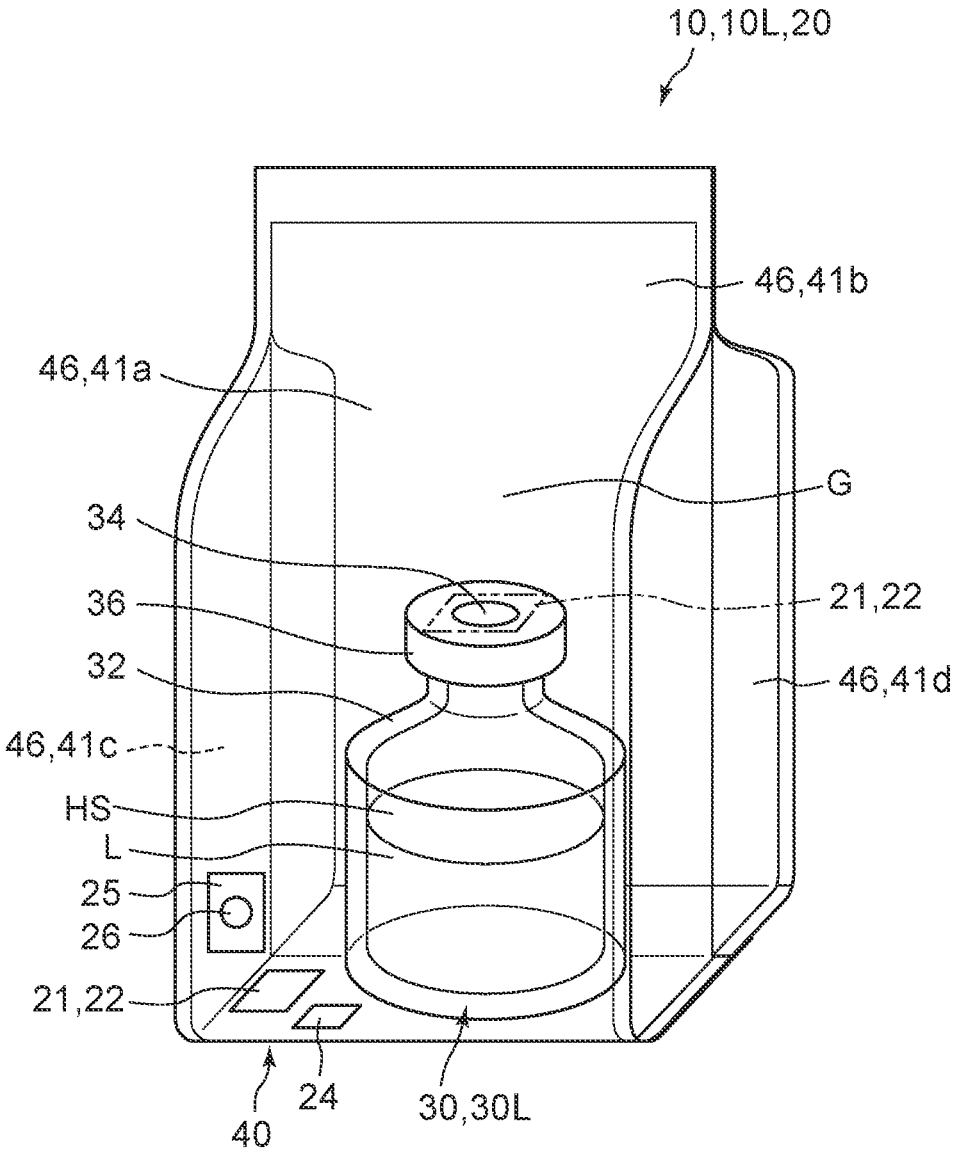
FIG. 1 is a perspective view of an example of a liquid-containing combination container for describing an embodiment of the present disclosure.

An embodiment of the present disclosure will hereinafter be described with reference to the drawings. In the drawings attached to the present specification, a scale and an aspect ratio, for example, are appropriately changed from actual ones and exaggerated for convenience of ease of illustration and understanding.

FIG. 1 to FIG. 48 are diagrams for describing the embodiment of the present disclosure. A container set 20 includes a first container 30 and a second container 40. A liquid-containing first container 30L includes the first container 30 and a liquid L that is contained in the first container 30. The first container 30 has oxygen permeability. That is, the first container 30 includes at least a portion that is permeable to oxygen. The second container 40 has an oxygen barrier property. The second container 40 can contain the liquid-containing first container 30L A liquid-containing combination container 10L includes the liquid-containing first container 30L and the second container 40. The liquid-containing first container 30L is contained in the second container 40. The liquid-containing combination container 10L adjusts an oxygen concentration in the second container 40 and can consequently adjust the amount of dissolved oxygen in the liquid L in addition to the oxygen concentration in the first container 30. The first container 30 that has the oxygen permeability is an airtight container.

An airtight container means a container an air leak of which is not detected in a liquid immersion method that is defined as JISZ2330:2012. More specifically, when a container that contains gas is immersed in water and can inhibit bubbles from leaking, the container is determined to be the airtight container. In a state in which no bubbles that leak from the container are detected when the container that contains gas is immersed in water, the state of the airtight container is determined to be an airtight state. In a liquid immersion test, the container to be tested is immersed at a depth of 10 cm or more and 30 cm or less from a water surface. Whether bubbles are present is determined by visual observation for 10 minutes.

Components of the liquid-containing combination container 10L will be described in detail with reference to an illustrated specific example. The liquid-containing first container 30L will now be described.

The liquid-containing first container 30L includes the first container 30 and the liquid L that is contained in the first container 30 as described above. The first container 30 has the oxygen permeability. However, the first container 30 can seal the liquid L. That is, the first container 30 is permeable to oxygen but is not permeable to the liquid L.

The liquid L that is contained in the first container 30 is not particularly limited. The liquid may be a solution that contains a solvent and solute that is dissolved in the solvent. The solvent is not particularly limited but may be water or alcohol. The liquid is not limited to a liquid in strict meaning but may be a suspension in which solid particles are dispersed. The liquid L may be a food product such as green tea, coffee, black tea, soup, juice, broth, or a concentrate obtained by concentrating one or more of these. The liquid may be a medicine (drug, chemical) such as an internal medicine, an external medicine, or an injectable solution. The liquid L may not be a food product or a medicine. The liquid L may be blood or a body fluid.

The inside of the first container 30 may be sterile. The liquid L may be a liquid to be kept sterile. Examples of the liquid L to be kept sterile include a liquid that has high sensitivity such as a food product or a medicine. The liquid L that has the high sensitivity is likely to deteriorate due to post sterilization (also referred to as final sterilization) that is performed after manufacturing. The post sterilization cannot be used for the liquid that has the high sensitivity. Examples of the post sterilization include sterilization methods such as a high pressure steam method, a dry heat method, a radiation method, an ethylene oxide gas method, and a hydrogen peroxide gas plasma method. In the present specification, the liquid L that has the high sensitivity means that 5% or more of all active ingredients that are contained in the liquid in weight is dissolved (decomposed) when the post sterilization is performed on the liquid L, and 1% or more of one or more kinds of the active ingredients that are contained in the liquid is dissolved (decomposed) in weight when the post sterilization is performed on the liquid L. The liquid L that has the high sensitivity on which the post sterilization cannot be performed can be manufactured by using a manufacturing line that is disposed in a sterile environment. That is, the liquid L that has the high sensitivity can be manufactured by using a sterile operation method. Examples of the liquid L that has the high sensitivity include an anticancer drug, an antiviral agent, a vaccine, and an antipsychotic drug.

The entire space in which the manufacturing line for the liquid L is disposed may be replaced with inert gas to adjust the amount of oxygen in the liquid L that is manufactured by using the sterile operation method. However, massive capacity investment is needed to maintain an inert gas atmosphere in the entire space in which the manufacturing line for the liquid L is disposed, and there is a concern about the safety of an operator. Form the background described above, the amount of oxygen in the liquid L is typically adjusted, for example, by replacing the atmosphere in the first container 30 that contains the liquid L with the inert gas or by bubbling the liquid L by using the inert gas.

In contrast, a contrivance that is devised by the present inventors described below is that the liquid-containing first container 30L is contained in the second container 40, and consequently, the amount of dissolved oxygen in the liquid L can be reduced to an amount of less than 0.15 mg/L, 0.04 mg/L or less, 0.03 mg/L or less, 0.02 mg/L or less, or less than 0.015 mg/L. It can be said that actions and effects caused by the contrivance of the present inventors are remarkable beyond the range that is predicted based on the technical level.

A product (the liquid L) that exhibits, for example, "sterilized" or "sterile", the inside of a container that contains the product, a product (the liquid L) such as a medicine that needs to be "sterile" for marketing, and the inside of a container that contains the product are "sterile", which is described herein. A product (the liquid L) that satisfies $10^{-6}$ of a sterility assurance level (SAL) that is defined as JIS T0806:2014 and the inside of a container that contains the product are also "sterile", which is described herein. A product in which no microbes multiply at the room temperature (for example 20° C.) or more after the product is preserved for four weeks, the inside of a container that contains the product, a product in which no microbes multiply in a refrigeration state (for example, 8° C. or less) after the product is preserved for eight weeks or more, and the inside of a container that contains the product are also "sterile", which is described herein. A medicine in which no microbes multiply at a temperature of 28° C. or more and 32° C. or less after the product is preserved for two weeks, and the inside of a container that contains the medicine are also "sterile", which is described herein.

The first container 30 that contains the liquid L will now be described. The first container 30 can seal the liquid L as described above. That is, the first container 30 can hold the liquid L without leaking.

The first container 30 has the oxygen permeability. A container having the oxygen permeability means that oxygen in a predetermined oxygen permeation amount or more permeates the container in an atmosphere at a temperature of 23° C. and a humidity of 40% RH and is movable between a position inside the container and a position outside the container. The predetermined oxygen permeation amount is $1\times10^{-1}$ (mL/(day×atm)) or more. The predetermined oxygen permeation amount may be 1 (mL/(day×atm)) or more, may be 1.2 (mL/(day×atm)) or more, or may be 3 (mL/(day×atm)) or more. The first container 30 that has the oxygen permeability enables the amount of oxygen in the first container 30 to be adjusted due to the permeation of oxygen in the first container 30.

An upper limit may be set for the oxygen permeation amount of oxygen that permeates the first container 30. Setting the upper limit enables water vapor, for example, to be inhibited from leaking from the first container 30. Setting the upper limit enables the liquid L in the first container 30 to be inhibited from being affected by a high speed at which gas permeates after the second container 40 is opened. The oxygen permeation amount of oxygen that permeates the first container 30 may be 100 (mL/(day×atm)) or less, may be 50 (mL/(day×atm)) or less, or may be 10 (mL/(day×atm)) or less.

The range of the oxygen permeation amount may be determined by using a combination of a freely selected value of the lower limit of the oxygen permeation amount described above and a freely selected value of the upper limit of the oxygen permeation amount described above.

The first container 30 may be permeable to all gasses. The first container 30 may be permeable to only some of gasses including oxygen, for example, only oxygen.

The first container 30 may have the oxygen permeability such that the whole of the first container 30 is permeable to oxygen. The first container 30 may have the oxygen permeability such that a portion of the first container 30 is permeable to oxygen.

The oxygen permeability coefficient of a material of the portion of the first container 30 that has the oxygen permeability may be $1\times10^{-12}$ ($cm^3$ (STP)·cm/($cm^2$·sec·Pa)) or more, may be $5\times10^{-1}$ ($cm^3$ (STP)·cm/($cm^2$·sec·Pa)) or more, or may be $1\times10^{11}$ ($cm^3$ (STP)·cm/($cm^2$·sec·Pa)) or more. Setting the lower limit for the oxygen permeability coefficient enables the permeation of oxygen in the first container 30 to be facilitated and enables the oxygen concentration in the first container 30 to be rapidly adjusted. In the case where the portion that has the oxygen permeability includes multiple layers, the material of at least one of the layers may have the oxygen permeability coefficient described above or the material of all of the layers may have the oxygen permeability coefficient described above.

In the case where an object to be measured is a resin film or a resin sheet, the oxygen permeability coefficient has a value that is measured in accordance with JIS K7126-1. In the case where the object to be measured is rubber, the oxygen permeability coefficient has a value that is measured in accordance with JIS K6275-1. The oxygen permeability coefficient has a value that is measured by using OXTRAN (OXTRAN, 2/61) that is a permeation measuring device made by AMETEK MOCON, the United States of America, in environments of a temperature of 23° C. and a humidity of 40% RH.

The area of the portion of the first container 30 that has the oxygen permeability may be 1 $mm^2$ or more, may be 10 $mm^2$ or more, or may be 30 $mm^2$ or more. The thickness of the portion of the first container 30 that has the oxygen permeability may be 3 mm or less, may be 1 mm or less, or may be several tenths mm or less. This enables the permeation of oxygen in the first container 30 to be facilitated and enables the amount of oxygen in the first container 30 to be rapidly adjusted.

The first container 30 illustrated includes a container body 32 that includes an opening portion 33 and a stopper (plug) 34 that is held by the opening portion 33 of the container body 32. The stopper 34 restricts leakage of the liquid L from the opening portion 33. In this example, the stopper 34 may have the oxygen permeability. From the perspective that movement of oxygen in the first container 30 to a position outside the first container 30 is facilitated, the portion of the first container 30 that has the oxygen permeability is preferably not in contact with the liquid L. As for the container that includes the container body 32 and the stopper 34, the stopper 34 is typically separated from the liquid L that is contained in the container body 32. That is, in a typical state in which the first container 30 is preserved, the permeation of oxygen through the stopper 34 of the first container 30 can be facilitated. In this point of view, the stopper 34 that has the oxygen permeability enables the amount of oxygen in the first container 30 to be rapidly adjusted.

The stopper 34 that has the oxygen permeability may be composed of the material that has the oxygen permeability coefficient ($cm^3$ (STP)·cm/($cm^2$ sec·Pa)) described above. The oxygen permeability coefficient of the material of the stopper 34 may be higher than the oxygen permeability coefficient of the material of the container body 32. A portion of the stopper 34 may have the oxygen permeability. A portion of the stopper 34 may be composed of the material that has the oxygen permeability over the entire thickness. For example, the stopper 34 may have the oxygen permeability over the entire thickness at a central portion away from the periphery and may have the oxygen barrier property at a peripheral portion that surrounds the central portion.

For example, the structure of the portion of the first container that has the oxygen permeability may be determined such that the oxygen concentration (%) in the first container 30 is reduced by 5% or more when the first container 30 that contains a liquid that has an amount of dissolved oxygen of 8 mg/L is preserved in the second container 40 for four weeks.

In an illustrated example, the area of the opening portion 33, that is, the opening area of the container body 32 may be 1 $mm^2$ or more, may be 10 $mm^2$ or more, or may be 30 $mm^2$ or more. The thickness of the stopper 34 may be 3 mm or less or may be 1 mm or less. This enables the permeation of oxygen in the first container 30 to be facilitated and enables the oxygen concentration in the first container 30 to be rapidly adjusted. The needle of a syringe can puncture the stopper 34. In addition, from the perspective of being punctured by a straw, the thickness of the stopper, for example, the thickness of the stopper that has the form of a film may be several tenths mm or less.

From the perspective that leakage of, for example, water vapor is reduced, or from the perspective that the liquid in the first container 30 is inhibited from being affected by a high speed at which gas permeates after the second container 40 is opened, an upper limit may be set for the area of the opening portion 33. Specifically, the area of the opening portion 33 may be 5000 $mm^2$ or less. From the perspective that strength is ensured, the thickness of the stopper, for example, the thickness of the stopper composed of rubber may be 0.01 mm or more.

The stopper 34 that has the oxygen permeability is not particularly limited but may have various structures. In an illustrated example, the stopper 34 is inserted into the opening portion 33 of the container body 32 and covers the opening portion 33. The stopper 34 illustrated in FIG. 2A includes a plate portion 34*a* that has a plate shape and an insertion projection 34*b* that extends from the plate portion 34*a*. The insertion projection 34*b* has, for example, a cylindrical shape. Multiple insertion projections 34*b* may be provided on a circle. The insertion projection 34*b* is inserted into the opening portion 33. The plate portion 34*a* includes a flange portion that extends outward from the insertion projection 34*b* in a radial direction. The flange portion of the plate portion 34*a* is placed on a head portion 32*d* of the container body 32. A stopper that includes an outer spiral and an inner spiral and that is mounted on the container body 32 by using the spirals that engage with each other may be used.

The stopper 34 may contain silicone. The stopper 34 may consist of silicone. A portion of the stopper 34 may be composed of silicone. The silicone that is contained in the stopper 34 is solid in environments in which the first container 30 is to be used. The silicone that is contained in the stopper 34 may not contain silicone that becomes a liquid in the room temperature such as silicone oil. Silicone is a substance a main chain of which is a siloxane bond. The stopper 34 may be composed of a silicone elastomer. The stopper 34 may be composed of silicone rubber.

Silicone rubber means rubber composed of silicone. Silicone rubber is synthetic resin a main component of which is silicone and is a rubber material. Silicone rubber is a rubber material a main chain of which is a siloxane bond. Silicone rubber may be a thermosetting compound that contains a siloxane bond. Examples of silicone rubber include methyl silicone rubber, vinyl-methyl silicone rubber, phenyl-methyl silicone rubber, dimethyl silicone rubber, and fluoro-silicone rubber.

The oxygen permeability coefficient of silicone and the oxygen permeability coefficient of silicone rubber may be $1\times10^{-12}$ ($cm^3$ (STP)·cm/($cm^2$·sec·Pa)) or more or may be $1\times10^{-11}$ ($cm^3$ (STP)·cm/($cm^2$·sec·Pa)) or more. The oxygen permeability coefficient of silicone and the oxygen permeability coefficient of silicone rubber may be $1\times10^{-9}$ ($cm^3$ (STP)·cm/($cm^2$·sec·Pa)) or less. Silicone and silicone rubber have a hydrogen permeability coefficient of about 10 times that of natural rubber, an oxygen permeability coefficient of about 20 times thereof, and a nitrogen permeability coefficient of about 30 times thereof. Silicone and silicone rubber have a hydrogen permeability coefficient of 70 times or more of that of butyl rubber, an oxygen permeability coefficient of 40 times or more thereof, and a nitrogen permeability coefficient of 650 times or more thereof.

At least a portion of the stopper 34 may be composed of silicone. That is, the whole or a portion of the stopper 34 may be composed of silicone or silicone rubber. For example, a portion of the stopper 34 may be composed of silicone or silicone rubber over the entire thickness. The portion may be a central portion of the stopper 34 or may be a part or the whole of a peripheral portion that surrounds the central portion.

Figure 2A:
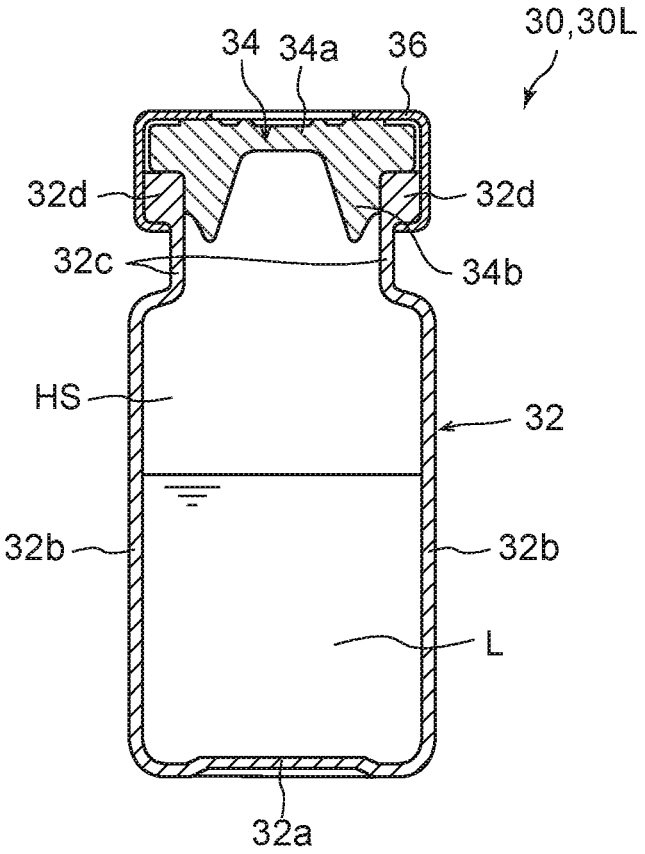
FIG. 2A is a longitudinal sectional view of a liquid-containing first container that can be included in the liquid-containing combination container in FIG. 1.

As illustrated in FIG. 2A, the container body 32 may include a bottom portion 32*a*, a trunk portion 32*b*, a neck portion 32*c*, and the head portion 32*d* in this order. As illustrated in FIG. 2A, the container space for the liquid L is formed mainly by the bottom portion 32*a* and the trunk portion 32*b*. The head portion 32*d* forms an end portion of the container body 32. The head portion 32*d* is thicker than the other portions. The neck portion 32*c* is located between the trunk portion 32*b* and the head portion 32*d*. The width of the neck portion 32*c* is less than the diameters of the trunk portion 32*b* and the head portion 32*d*. The diameter of the neck portion 32*c* is less than the diameters of the trunk portion 32*b* and the head portion 32*d*.

The container body 32 may be transparent such that the liquid L that is contained is observable from the outside. Being transparent means that visible light transmittance is 50% or more and is preferably 80% or more. The visible light transmittance is measured at a measurement wavelength ranging from 380 nm to 780 nm by using a spectrophotometer ("UV-3100PC" conforming JIS K 0115 made by SHIMADZU CORPORATION) at an incident angle of 0° per 1 nm and is specified as the average value of total light transmittance at wavelengths.

The first container 30 illustrated also includes a fixture 36. The fixture 36 restricts the stopper 34 such that the stopper 34 does not come off from the container body 32. The fixture 36 is mounted on the head portion 32*d* of the container body 32. As illustrated in FIG. 1 and FIG. 2A, the fixture 36 covers the periphery of the plate portion 34*a* of the stopper 34. The fixture 36 presses the flange portion of the plate portion 34*a* toward the head portion 32*d*. Consequently, the fixture 36 restricts the stopper 34 such that the stopper 34 does not come off from the container body 32 with a portion of the stopper 34 exposed. In addition, the stopper 34 and the container body 32 can be liquid-tight and airtight. The fixture 36 makes the first container 30 airtight or airtight state. The fixture 36 may be a metal sheet that is fixed to the head portion 32*d*. The fixture 36 may be a cap that is screwed to the head portion 32*d*. The fixture 36 composed of metal has the oxygen barrier property.

In an illustrated example, the oxygen permeability coefficient of the material of the container body 32 may be lower than the oxygen permeability coefficient of the material of the stopper 34. The container body 32 may have the oxygen barrier property. That is, only a portion of the first container 30 may have the oxygen permeability. The oxygen permeability coefficient of the material of the portion that has the oxygen barrier property may be $1\times10^{-13}$ ($cm^3$ (STP)·cm/($cm^2$·sec·Pa)) or less or may be $1\times10^{-17}$ ($cm^3$ (STP)·cm/($cm^2$·sec·Pa)) or less.

Examples of the container body 32 that has the oxygen barrier property include a can composed of metal, a container body that includes a metal layer that is formed by vapor deposition or transfer, and a glass bottle. The container body 32 composed of a resin sheet or a resin plate can have the oxygen barrier property. In this example, the resin sheet and the resin plate may include a layer that has the oxygen barrier property such as an ethylene-vinyl alcohol copolymer (EVOH) or a polyvinyl alcohol (PVA) layer. The container body 32 may include a multilayer body that includes a metal deposition film. The container body 32 that uses the multilayer body or glass can have the oxygen barrier property and can be transparent. In the case where the first container 30 and the container body 32 are transparent, the liquid L that is contained therein can be checked from a position outside the first container 30.

A portion of a container having the oxygen permeability means that oxygen in a predetermined oxygen permeation amount or more permeates the portion of the container and is movable between a position inside the container and a position outside the container in an atmosphere at a temperature of 23° C. and a humidity of 40% RH. The predetermined oxygen permeation amount is $1\times10^{-1}$ (mL/(day×atm)) or more. The predetermined oxygen permeation amount may be 1 (mL/(day×atm)) or more, may be 1.2 (mL/(day×atm)) or more, or may be 3 (mL/(day×atm)) or more. Also in the case where the portion of the first container 30 has the oxygen permeability, the amount of oxygen in the first container 30 can be adjusted.

The predetermined oxygen permeation amount may be 100 (mL/(day×atm)) or less, may be 50 (mL/(day×atm)) or less, or may be 10 (mL/(day×atm)) or less. Setting the upper limit for the oxygen permeation amount enables the leakage of, for example, water vapor to be reduced and enables the liquid in the first container 30 to be inhibited from being affected by a high speed at which oxygen permeates after the second container 40 is opened. The range of the oxygen permeation amount may be determined by using a combination of a freely selected value of the lower limit of the oxygen permeation amount described above and a freely selected value of the upper limit of the oxygen permeation amount described above.

Figure 2B:
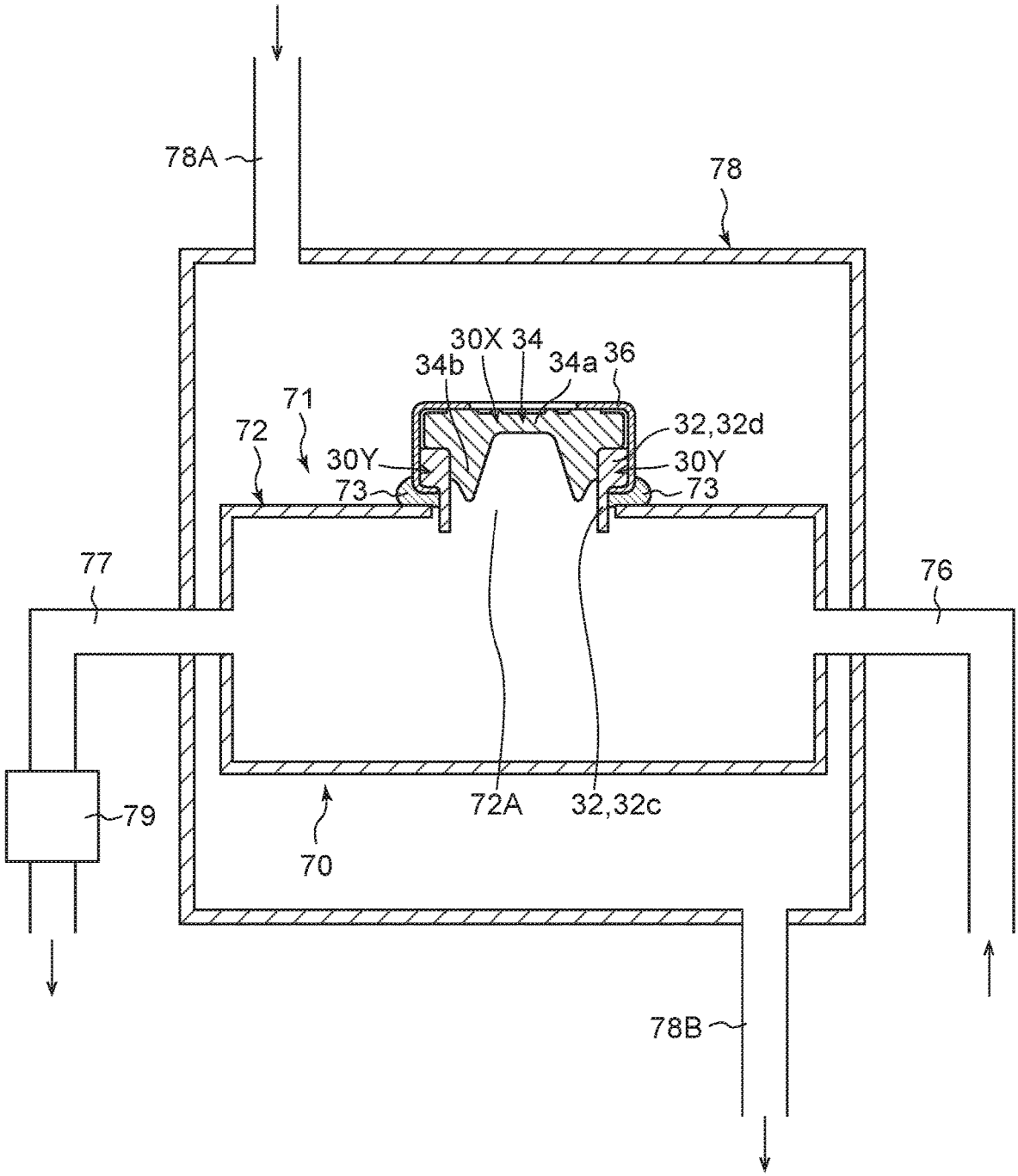
FIG. 2B is a longitudinal sectional view for a method of measuring an oxygen permeation amount as for a stopper of the first container illustrated in FIG. 2A.

As illustrated in FIG. 2B, the oxygen permeation amount (mL/(day×atm)) of oxygen that permeates a portion of the container can be measured by using a test container 70 that contains the portion. The test container 70 includes a partition wall portion 71. The test container 70 has an interior space that is defined by the partition wall portion 71. The partition wall portion 71 includes the portion of the container and a main wall portion 72 that has the oxygen barrier property. The degree of permeation through the portion of the container is specified as the oxygen permeation amount (mL/(day×atm)) of the test container 70.

The oxygen concentration in the test container 70 is maintained, for example, at 0.05% or less. The test container 70 is connected to a first flow path 76 and a second flow path 77. The second flow path 77 is connected to an oxygen measuring device 79 that measures the amount of oxygen. The oxygen measuring device 79 can measure the amount (mL) of oxygen that flows in the second flow path 77. The oxygen measuring device 79 can be an oxygen measuring device that is used in OXTRAN (OXTRAN, 2/61) made by AMETEK MOCON, the United States of America. The first flow path 76 supplies gas into the test container 70. The first flow path 76 may supply gas that contains no oxygen. The first flow path 76 may supply inert gas. The first flow path 76 may supply nitrogen. The second flow path 77 discharges gas in the test container 70. The first flow path 76 and the second flow path 77 have the oxygen barrier property. The test container 70 is maintained by using the first flow path 76 and the second flow path 77 such that no oxygen is substantially present therein. The oxygen concentration in the test container 70 may be maintained at 0.05% or less, may be maintained at less than 0.03%, or may be maintained at 0%.

The test container 70 is disposed in a test atmosphere at a temperature of 23° C. and a humidity of 40% RH. The oxygen concentration of the atmosphere in which the test container 70 is disposed is higher than the oxygen concentration in the test container 70. The test atmosphere is an air atmosphere. The oxygen concentration of the air atmosphere is 20.95%. The test container 70 is disposed in the test atmosphere, and consequently, oxygen permeates a portion 30X of the container and moves from the test atmosphere into the test container 70. Gas in the test container 70 is discharged from the second flow path 77. The amount of oxygen that flows in the second flow path 77 is measured by the oxygen measuring device 79, and the oxygen permeation amount (mL/(day×atm)) of oxygen that permeates the portion 30X in the atmosphere at a temperature of 23° C. and a humidity of 40% RH in a day can be measured.

In an example illustrated, the test container 70 is disposed in a test chamber 78. An atmosphere in the test chamber 78 is maintained at a temperature of 23° C. and a humidity of 40% RH. Air is supplied from a supply path 78A into the test chamber 78. Gas in the test chamber 78 is discharged via a discharge path 78B. Air circulates through the supply path 78A and the discharge path 78B, and the oxygen concentration in the test chamber 78 is maintained at 20.95%.

In an example illustrated in FIG. 2B, a pump for circulating air may be provided on the supply path 78A or the discharge path 78B. If the oxygen concentration in the test chamber 78 can be kept constant, the supply path 78A and the discharge path 78B illustrated in FIG. 2B may be opened to the air atmosphere under atmospheric pressure.

FIG. 2B illustrates a method of measuring the oxygen permeation amount where the portion 30X of the first container 30 that has the oxygen permeability is taken as an example. In the example illustrated in FIG. 2B, the partition wall portion 71 includes the portion 30X of the first container 30 that has the oxygen permeability and the main wall portion 72 that has the oxygen barrier property. For example, the partition wall portion 71 may include the portion 30X that is cut from the first container 30 and the main wall portion 72 that is connected to a peripheral portion 30Y of the portion 30X. The main wall portion 72 has a through-hole 72A from which the portion 30X is exposed. A circumferential portion around the through-hole 72A and the portion 30Y adjacent to the portion 30X may be airtightly joined to each other. In an illustrated example, the portion 30Y adjacent to the portion 30X is airtightly joined to a portion around the through-hole of the main wall portion 72 with a barrier joint member 73 that has the oxygen barrier property interposed therebetween. In the example illustrated in FIG. 2B, a portion of the container set 20 illustrated in FIG. 2A near the stopper 34 is cut. In the example, the stopper 34 corresponds to the portion 30X that has the oxygen permeability. The portions 32*c* and 32*d* that form the opening portion 33 of the container body 32 and the fixture 36, as the portion 30Y adjacent to the portion 30X that has the oxygen permeability, are airtightly connected to the main wall portion 72 with the barrier joint member 73 interposed therebetween.

In the example illustrated in FIG. 2B, the container body 32 is cut at the neck portion 32*c*. The stopper 34 is compressed and held in the opening portion 33 that is formed by the head portion 32*d* of the container body 32. The fixture 36 makes the boundary between the container body 32 and the stopper 34 airtight. The fixture 36 composed of, for example, aluminum that has the oxygen barrier property partly covers the stopper 34. The container body 32 and the fixture 36 that have the oxygen barrier property are connected to the main wall portion 72 with the barrier joint member 73 interposed therebetween. The stopper 34 is maintained in the same state as the state in which the first container 30 is closed when being actually used, for example, when being compressed in the opening portion 33 and fastened by the fixture 36. Accordingly, the oxygen permeation amount as for the stopper 34 can be measured in the same conditions as those in actual use.

The method of measuring the oxygen permeation amount (mL/(day×atm)) of oxygen that permeates the portion of the container is described above. The oxygen permeation amount (mL/(day×atm)) of oxygen that permeates the whole of the container can be specified in a manner in which the oxygen permeation amounts that are measured concerning two or more separated portions of the container are added. For example, the oxygen permeation amount of the first container 30 illustrated in FIG. 2A can be specified in a manner in which the oxygen permeation amount of the container body 32 is measured, and the oxygen permeation amount of the container body 32 and the oxygen permeation amount of the portion 30X that is measured by the method illustrated in FIG. 2B are added. The oxygen permeation amount (mL/(day×atm)) of the container body 32 can be measured by using the test container 70 that is manufactured by combining the container body 32 with the main wall portion 72.

The volume of the first container 30 may be, for example, 1 ml or more and 1100 ml or less, may be 3 mL or more and 700 mL or less, or may be 5 mL or more and 200 mL or less.

In an illustrated example, the container body 32 is a glass bottle that is colorless or colored. The container body 32 is composed of, for example, borosilicate glass. The first container 30 may be a vial bottle. A vial bottle is a container that includes a container body, a stopper (plug) that is inserted into an opening portion of the container body, and a seal that fixes the stopper and that corresponds to the fixture 36, and the seal is clamped (tightened, pressed, press-fitted, capped) to a head portion of the container body together with the stopper by using, for example, a hand gripper. The volume of the first container 30 that is a vial bottle may be 1 mL or more or may be 3 mL or more. The volume of the first container 30 that is a vial bottle may be 500 mL or less or may be 200 mL or less.

In the case where the first container 30 is a vial bottle, the oxygen permeability coefficient of the material of the stopper 34 may be higher than the oxygen permeability coefficient of glass of which the container body 32 is composed. The portion of the first container 30 that has the oxygen permeability is separated from the liquid L, and consequently, movement of oxygen in the first container 30 to a position outside the first container 30 can be facilitated. The first container 30 that is a vial bottle can be stably disposed on a placement surface in a manner in which the bottom portion 32*a* of the container body 32 is brought into contact with the placement surface. At this time, the stopper 34 is separated from the liquid L. The stopper 34 does not come into contact with the liquid L. Accordingly, the permeation of oxygen through the stopper 34 of the first container 30 can be facilitated with the first container 30 normally preserved.

The first container 30 illustrated can maintain the inner pressure at negative pressure under the atmospheric pressure. The first container 30 is capable of containing gas while the gas is maintained at negative pressure under the atmospheric pressure. The first container 30 may be capable of containing gas while the gas is maintained at positive pressure under the atmospheric pressure. In these examples, the first container 30 may have rigidity so as to sufficiently maintain the shape thereof. However, the first container 30 may somewhat deform under the atmospheric pressure when the inner pressure is maintained at negative pressure or positive pressure. Examples of the first container 30 that can maintain the inner pressure at negative pressure or positive pressure include the illustrated specific example described above and a can composed of metal.

The phrase "be capable of containing gas while the gas is maintained at negative pressure under the atmospheric pressure" means that the inner pressure is a negative pressure of 0.80 atm or more, and the container can contain gas without damage. The container that is capable of containing gas while the gas is maintained at negative pressure under the atmospheric pressure may be airtight in the case where the inner pressure is 0.80 atm. The container that is capable of containing gas while the gas is maintained at negative pressure under the atmospheric pressure may be capable of maintaining the volume in the case where the inner pressure is 0.80 atm at 95% or more of the volume in the case where the inner pressure is 1.0 atm. The phrase "be capable of containing gas while the gas is maintained at positive pressure under the atmospheric pressure" means that the inner pressure is a positive pressure of 1.2 atm or less, and the container can contain gas without damage. The container that is capable of containing gas while the gas is maintained at positive pressure under the atmospheric pressure may be airtight in the case where the inner pressure is 1.20 atm. The container that is capable of containing gas while the gas is maintained at positive pressure under the atmospheric pressure may be capable of maintaining the volume in the case where the inner pressure is 1.2 atm at 105% or less of the volume in the case where the inner pressure is 1.0 atm.

The first container 30 is contained in the second container 40 that has the oxygen barrier property. The first container 30 that is contained in the second container 40 may be capable of containing gas without damage in the case where a difference between the inner pressure of the first container 30 and the inner pressure of the second container 40 is 0.2 atm or less. The first container 30 that is contained in the second container 40 may be airtight in the case where a difference between the inner pressure of the first container 30 and the inner pressure of the second container 40 is 0.2 atm or less. The first container 30 that is contained in the second container 40 may have a volume of 95% or more and 105% or less of the volume of the first container 30 when the inner pressure of the first container 30 is equal to the inner pressure of the second container 40 in the case where the difference between the inner pressure of the first container 30 and the inner pressure of the second container 40 is 0.2 atm or less. The inner pressure of the first container 30 may be less than the inner pressure of the second container 40 or the inner pressure of the first container 30 may be higher than the inner pressure of the second container 40 with the first container 30 contained in the second container 40.

The second container 40 has a volume so as to be capable of containing the first container 30. The second container 40 can be sealed, for example, by being welded by using heat sealing or ultrasonic joining or by being joined by using a joining material such as adhesive or glue. The second container 40 may be airtight. The volume of the second container 40 may be, for example, 5 ml or more and 1200 mL or less. In the case where the first container 30 is a small container such as a vial bottle, for example, a container that has a volume of 1 mL or more and 20 mL or less, the volume of the second container may be 1.5 mL or more and 500 mL or less.

The second container 40 has the oxygen barrier property. The second container 40 having the oxygen barrier property means that the degree of the oxygen permeability, in other words, oxygen transmission rate (mL/($m^2$×day×atm)) of the container is 1 or less. The degree of the oxygen permeability (mL/($m^2$×day×atm)) of the container that has the oxygen barrier property may be 0.5 or less or may be 0.1 or less. The degree of the oxygen permeability (oxygen transmission rate) is measured in accordance with JIS K7126-1. The degree of the oxygen permeability is measured by using OXTRAN (OXTRAN, 2/61) that is a permeation measuring device made by AMETEK MOCON, the United States of America, in environments of a temperature of 23° C. and a humidity of 40% RH. As for a container to which JIS K7126-1 is not used, the degree of the oxygen permeability may be specified in a manner in which the oxygen permeation amount described above is measured, the obtained oxygen permeation amount is divided by a surface area.

The oxygen permeability coefficient of the material of the second container 40 that has the oxygen barrier property may be $1\times10^{-13}$ ($cm^3$ (STP)·cm/($cm^2$·sec·Pa)) or less or may be $1\times10^{-17}$ ($cm^3$ (STP)·cm/($cm^2$·sec·Pa)) or less.

Examples of the second container 40 that has the oxygen barrier property include a can composed of metal, a container that includes a metal layer that is formed by vapor deposition or transfer, and a glass bottle. The second container 40 may include a multilayer body that includes a layer that has the oxygen barrier property. The multilayer body may include a resin layer or a metal deposition film that has the oxygen barrier property such as an ethylene-vinyl alcohol copolymer (EVOH) or a polyvinyl alcohol (PVA) layer. The second container 40 may include a transparent portion. A portion of the second container 40 may be transparent. The whole of the second container 40 may be transparent. The second container 40 that uses the multilayer body and the second container 40 that uses glass or resin can have the oxygen barrier property and can be transparent. The second container 40 that is transparent enables the liquid-containing first container 30L that is contained therein to be checked from a position outside the second container 40.

In an example illustrated in FIG. 1, the second container 40 includes a resin film that has the oxygen barrier property. The second container 40 is a so-called pouch. The second container 40 illustrated in FIG. 1 is a so-called gusset bag. The second container 40 includes a first main film 41*a*, a second main film 41*b*, a first gusset film 41*c*, and a second gusset film 41*d*. The first main film 41*a* and the second main film 41*b* face each other. The first gusset film 41*c* has a fold and is located between the first main film 41*a* and the second main film 41*b*. The first gusset film 41*c* connects a side edge of the first main film 41*a* and a side edge of the second main film 41*b*. The second gusset film 41*d* has a fold and is located between the first main film 41*a* and the second main film 41*b*. The second gusset film 41*d* connects the other side edge of the first main film 41*a* and the other side edge of the second main film 41*b*. The first and second main films 41*a* and 41*b*, and the first and second gusset films 41*c* and 41*d* are joined to each other along upper edges and lower edges. The films 41*a* to 41*d* are airtightly joined, for example, by being welded by using heat sealing or ultrasonic joining or by being joined by using a joining material such as adhesive or glue.

Figure 7A:
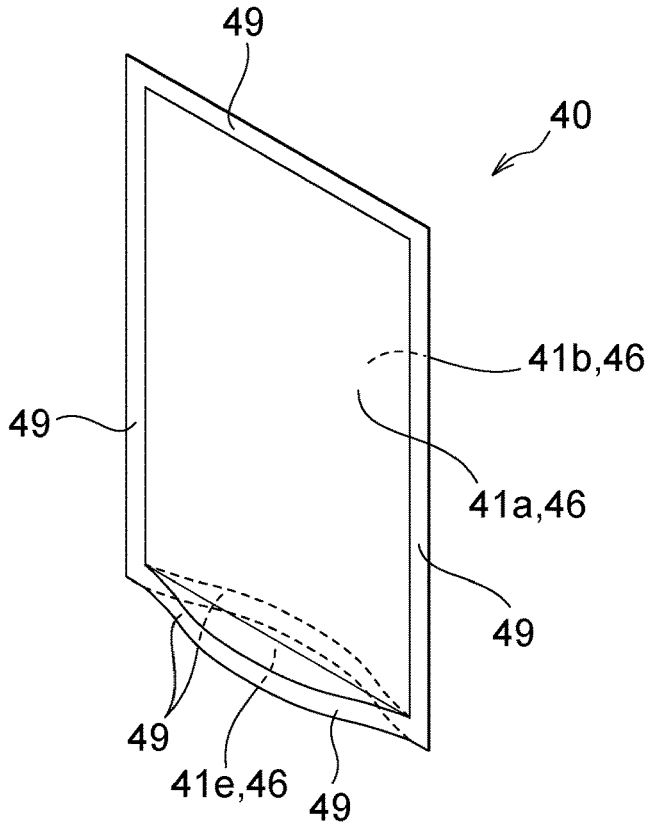
FIG. 7A is a perspective view of another example of a second container.

As for the second container 40 illustrated in FIG. 1, a folded film may serve as two or more of the films 41*a* to 41*d* adjacent to each other instead of separated films joined to each other. As illustrated in FIG. 1, the gusset bag can form a rectangular bottom surface of the second container 40. The first container 30 is disposed on the bottom surface, and consequently, the first container 30 can be stably preserved in the second container 40. As illustrated in FIG. 7A, however, the second container 40 may include a bottom surface film 41*e* in addition to the first main film 41*a* and the second main film 41*b* instead of the gusset bag. The pouch is also called a standing pouch. The pouch can form the bottom surface, and the first container 30 can be stably preserved in the second container 40.

Figure 7B:
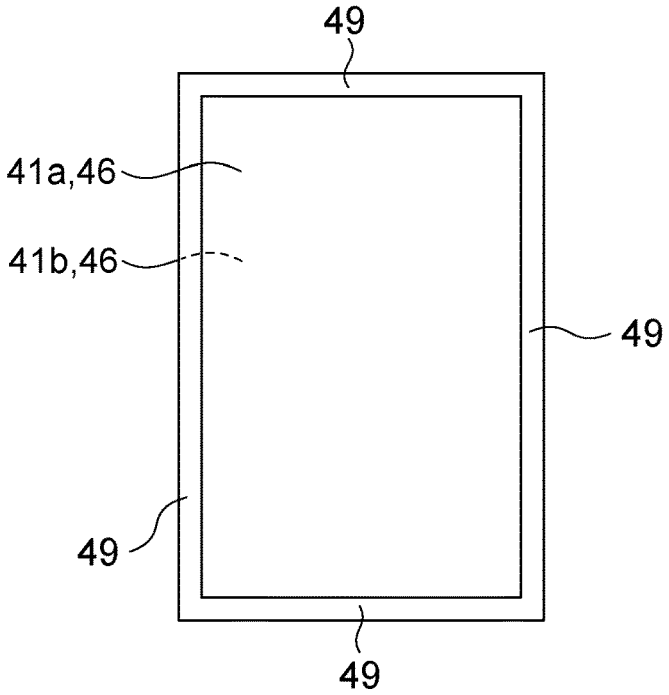
FIG. 7B is a perspective view of another example of the second container.
Figure 7C:
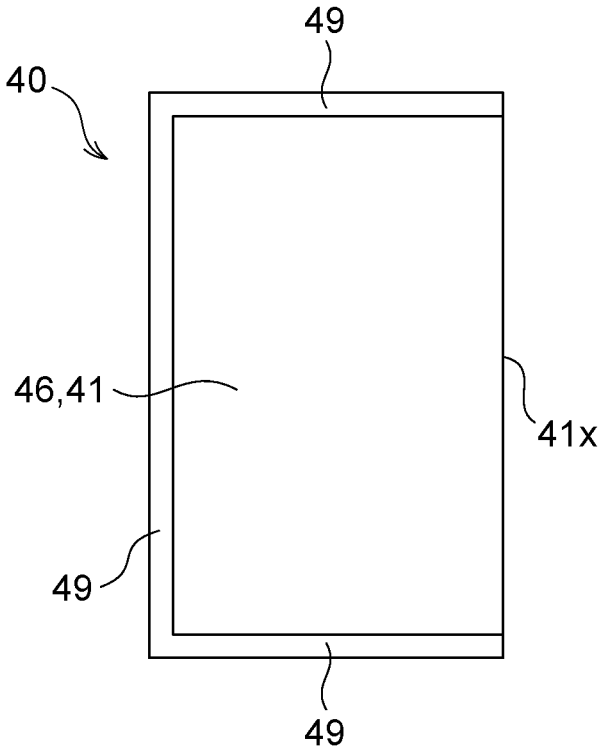
FIG. 7C is a perspective view of another example of the second container.
Figure 7D:
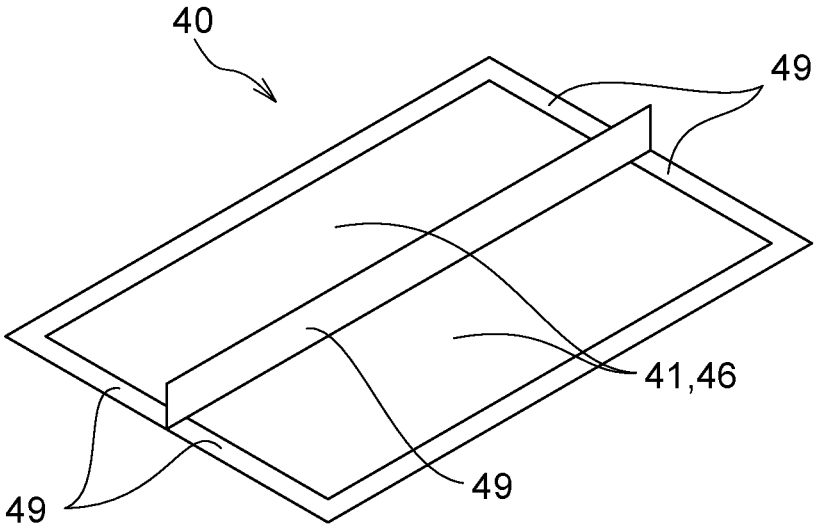
FIG. 7D is a perspective view of another example of the second container.

As illustrated in FIG. 7B to FIG. 7D, the second container 40 that can be disassembled in a plate shape may be used. The second container 40 illustrated in FIG. 7B to FIG. 7D can be manufactured by joining a resin film by using a seal portion 49. The second container 40 illustrated in FIG. 7B can be manufactured by joining the first main film 41*a* and the second main film 41*b* at the seal portion 49 that is provided therearound.

The second container 40 illustrated in FIG. 7C includes a film 41 that is folded along a fold portion 41*x*. Facing Portions of the film 41 that is folded are joined at the seal portion 49, and consequently, the second container 40 can be manufactured. As for the second container 40 illustrated in FIG. 7C, a portion that is surrounded by the fold portion 41*x* and the seal portion 49 in three directions forms the container space.

The second container 40 illustrated in FIG. 7D is also referred to as a pillow container. Both edges of the single film 41 are joined to each other as the seal portion 49, the film 41 is consequently formed into a tubular shape, both end portions of the tube are joined as the seal portion 49, and consequently, the second container 40 is obtained.

In the various examples described above, each film that forms the second container 40 may be transparent.

Figure 8:
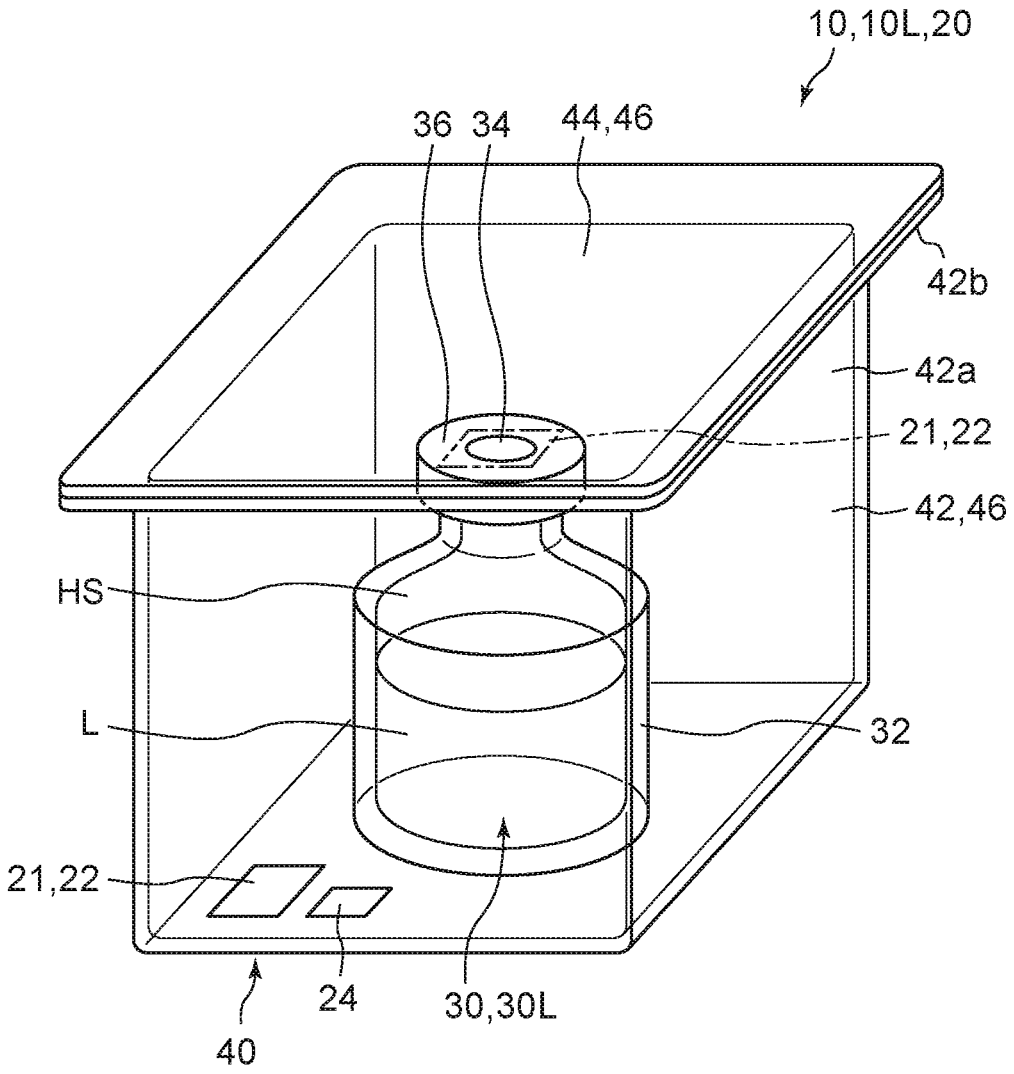
FIG. 8 is a perspective view a modification to the second container.

FIG. 8 illustrates another example of the second container 40. As illustrated in FIG. 8, the second container 40 may include a container body 42 and a lid 44. The container body 42 includes a container portion 42*a* and a flange portion 42*b*. The container portion 42*a* may form a container space that has a rectangular cuboid shape. The first container 30 is contained in the container space. The container portion 42*a* may have a rectangular cuboid shape having an opening in a surface. The flange portion 42*b* is provided around the opening of the container portion 42*a*. The lid 44 has a flat plate shape. A peripheral portion of the lid 44 can be airtightly joined to the flange portion 42*b* of the container body 42. The container body 42 and the lid 44 may be composed of a resin plate that has the oxygen barrier property. The lid 44 and the container body 42 may be transparent. The thickness of the resin plate that has the oxygen barrier property may be 0.05 mm or more and 2 mm or less or may be 0.1 mm or more and 1.5 mm or less.

The second container 40 illustrated in FIG. 8 can maintain the inner pressure at negative pressure under the atmospheric pressure. The second container 40 can contain gas while the gas is maintained at negative pressure under the atmospheric pressure. The second container 40 may contain gas while the gas is maintained at positive pressure under the atmospheric pressure. In these examples, the second container 40 may have rigidity so as to sufficiently maintain the shape thereof. However, the second container 40 may somewhat deform under the atmospheric pressure when the inner pressure is maintained at negative pressure or positive pressure. Examples of the second container 40 that can maintain the inner pressure at negative pressure or positive pressure include a can composed of metal.

The portion of the first container 30 that has the oxygen permeability is at least partly separated from the second container 40 that has the oxygen barrier property, and consequently, movement of oxygen in the first container 30 into the second container 40 can be facilitated. In the example illustrated in FIG. 1, a gap G is formed between the stopper 34 of the first container 30 that is contained in the second container 40 and the second container 40. The gap G can be ensured in the case where the container space of the second container 40 is larger than the shape of the first container 30. In the case where the second container 40 is composed of a material that is flexible such as a resin film, the shape of the second container 40 is adjusted, and consequently, the gap G can be formed between the stopper 34 and the second container 40.

The first container 30 and the second container 40 described above are included in the container set 20 and a combination container 10. The liquid-containing combination container 10L is obtained by using the liquid-containing first container 30L and the second container 40.

A method of manufacturing the liquid-containing combination container 10L will now be described. The liquid-containing combination container 10L is manufactured, and consequently, the liquid-containing first container 30L that has an adjusted oxygen concentration is obtained.

The liquid-containing first container 30L and the second container 40 that is not closed are first prepared. The liquid-containing first container 30L is manufactured in a manner in which the first container 30 is filled with the liquid L. The liquid L such as a food product or a medicine is manufactured by using a manufacturing line that is disposed in a sterile environment at positive pressure. Pressure in the sterile environment is maintained at positive pressure from the perspective that foreign substances such as microbes are inhibited from entering. As a result, the inner pressure of the liquid-containing first container 30L that is obtained is positive pressure as in manufacturing environments.

Figure 3:
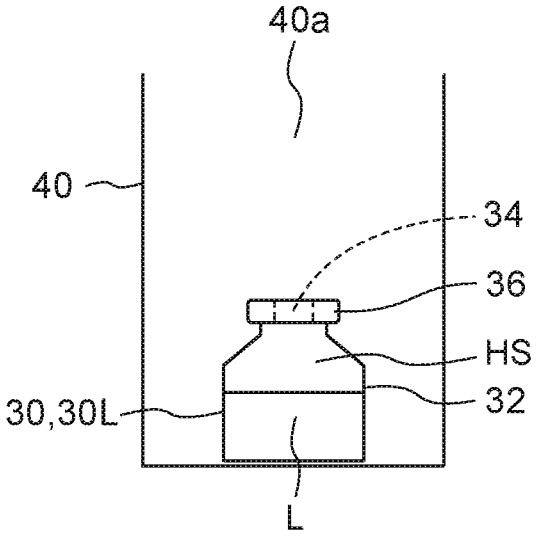
FIG. 3 illustrates an example of a method of manufacturing the liquid-containing combination container in FIG. 1 and the liquid-containing first container in FIG. 2.
Figure 4:
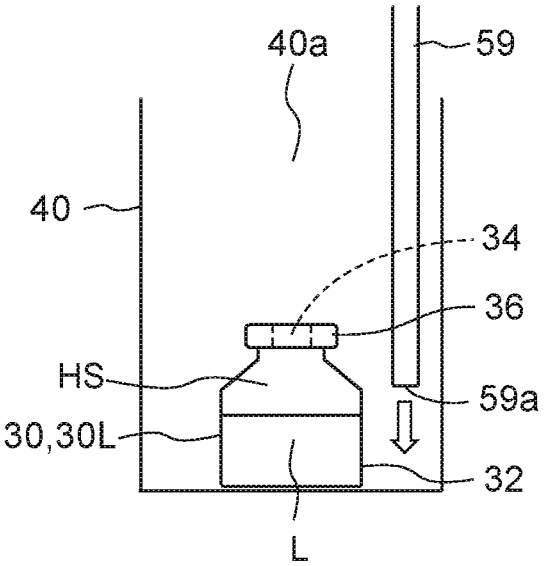
FIG. 4 illustrates an example of the method of manufacturing the liquid-containing combination container in FIG. 1 and the liquid-containing first container in FIG. 2.

As illustrated in FIG. 3, the second container 40 that is not closed has an opening 40*a* for containing the liquid-containing first container 30L. As for the second container 40 illustrated in FIG. 1, upper edge portions of the films 41*a* to 41*d*, for example, are not joined to each other but form the opening 40*a*. As for the second container 40 illustrated in FIG. 8, the container body 42 to which the lid 44 is not attached is prepared. As illustrated in FIG. 3, the liquid-containing first container 30L is contained in the second container 40 via the opening 40*a*.

Subsequently, the second container 40 is filled with inert gas such as nitrogen. In an example illustrated in FIG. 4, the inert gas is supplied from a supply pipe 59. The supply pipe 59 extends through the opening 40*a* into the second container 40. A discharge port 59*a* of the supply pipe 59 is located in the second container 40. The inert gas is supplied from the supply pipe 59, and consequently, an inner portion of the second container 40 is replaced with the inert gas. That is, the liquid-containing first container 30L is placed in an inert gas atmosphere. The inert gas is gas that is stable and less reactive. Examples of the inert gas other than nitrogen include noble gas such as helium, neon, and argon.

The second container 40 may be filled with the inert gas before, after, or at the same time the liquid-containing first container 30L is disposed in the second container 40.

Figure 5:
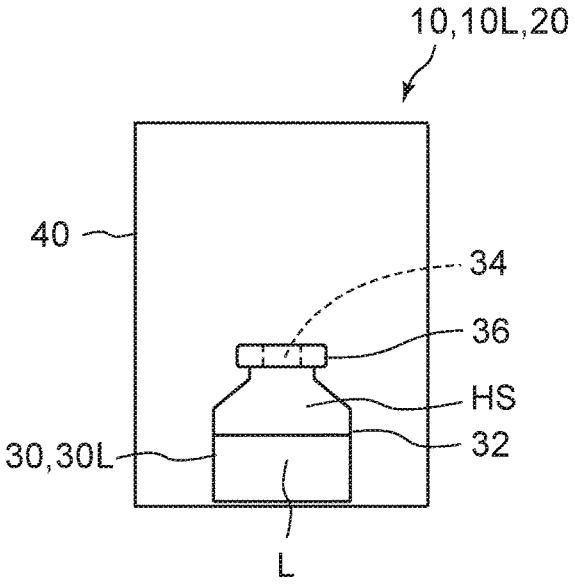
FIG. 5 illustrates an example of the method of manufacturing the liquid-containing combination container in FIG. 1 and the liquid-containing first container in FIG. 2.

As illustrated in FIG. 5, the second container 40 is subsequently closed with the liquid-containing first container 30L contained and with the inert gas filled. As for the second container 40 illustrated in FIG. 1, the upper edge portions of the films 41*a* to 41*d* are joined to each other, the opening 40*a* is closed, and consequently, the second container 40 is closed. As for the second container 40 illustrated in FIG. 8, the peripheral portion of the lid 44 is joined to the flange portion 42*b* of the container body 42, and consequently, the second container 40 is closed. Joining may be done by using a joining material such as adhesive or glue or may be welding by using heat sealing or ultrasonic joining. The second container 40 is airtight.

The second container 40 that contains the liquid-containing first container 30L may be closed in an inert gas atmosphere instead of supplying the inert gas from the supply pipe 59. In this manner, the liquid-containing first container 30L is sealed in the second container 40 together with the inert gas.

Processes until the second container 40 is closed may be performed in a sterile environment. That is, the liquid-containing first container 30L that is manufactured in a sterile state and the second container 40 that is sterilized or manufactured in a sterile state are brought in the sterile environment such as a sterile chamber. If the inert gas atmosphere in the chamber is isolated from the air atmosphere, the inert gas may not be supplied by using the supply pipe 59. The second container 40 that contains the liquid-containing first container 30L in the sterile environment is closed. Accordingly, the inside of the second container 40 that contains the liquid-containing first container 30L is also sterile. That is, the liquid-containing first container 30L can be preserved in the second container 40 in a sterile state.

Subsequently, the liquid-containing first container 30L is preserved in the second container 40. The second container 40 has the oxygen barrier property as described above. Oxygen is effectively inhibited from permeating the second container 40. At least a portion of the first container 30 has the oxygen permeability. The second container 40 is filled with the inert gas, and the oxygen concentration in the second container 40 is very low. As for the liquid-containing combination container 10L, oxygen in the first container 30 permeates the first container 30 and moves into the second container 40. The oxygen concentration in the second container 40 increases as the oxygen moves from the first container 30 into the second container 40, and the oxygen concentration in the first container 30 reduces. In a final equilibrium state in which the permeation of oxygen through the first container 30 equilibrated, the oxygen concentration in the first container 30 can match the oxygen concentration in the second container 40.

In addition, the oxygen concentration in the first container 30 reduces, and subsequently, the partial pressure of oxygen in the first container 30 reduces. The partial pressure of oxygen in the first container 30 reduces, and subsequently, the saturation solubility (mg/L) of oxygen into the liquid L in the first container 30 reduces. The amount (mg/L) of dissolved oxygen of the liquid L reduces.

The liquid-containing first container 30L is contained in the second container 40 as described above, and consequently, the oxygen concentration (%) of gas that is contain together with the liquid in the first container 30 can be reduced. In addition, the amount (mg/L) of dissolved oxygen in the liquid L in the first container 30 can be reduced. For example, the liquid-containing first container 30L is preserved in the second container 40 before use, and consequently, the amount (mg/L) of dissolved oxygen in the liquid L in the first container 30 can be reduced.

The liquid L that has the high sensitivity such as a food product or a medicine can be dissolved (decomposed) by oxygen. For example, a solute in an aqueous solution that is a medicine can be dissolved (decomposed) by oxygen. A liquid that is a medicine and a solute in an aqueous solution that is a medicine can be dissolved (decomposed) by oxygen. Particles that are dispersed in a liquid in a suspension that is a medicine or a food product can be dissolved (decomposed) by oxygen. The liquid L is contained in the first container 30 that is disposed in the second container 40, and consequently, dissolving (decomposition) due to oxygen in the liquid L can be reduced. That is, the oxygen concentration in the first container 30 can be adjusted after the liquid L is sealed according to the present embodiment, which is preferable for the liquid L that has the high sensitivity such as a food product or a medicine.

When the second container 40 is closed, an oxygen absorber (oxygen scavenger) 21 that absorbs oxygen in the second container 40 is provided instead of filling the second container 40 with the inert gas or in addition to filling the second container 40 with the inert gas. The oxygen absorber 21 absorbs oxygen, and consequently, the oxygen concentration in the second container 40 reduces, and oxygen in the first container 30 moves into the second container 40. The use of the oxygen absorber 21 enables the oxygen concentration in the second container 40 and the oxygen concentration in the first container 30 to be more effectively reduced. The present inventors confirm that the use of the oxygen absorber 21 in a sufficient amount enables the oxygen concentration in the second container 40 and the oxygen concentration in the first container 30 to be maintained at low concentrations, for example, less than 0.3%, 0.1% or less, 0.05% or less, less than 0.03%, or 0%. The oxygen concentration in the first container 30 reduces, and consequently, the amount of dissolved oxygen in the liquid L that is contained in the first container 30 reduces. The present inventors confirm that the use of the oxygen absorber 21 in a sufficient amount enables the amount of dissolved oxygen in the liquid L to be greatly reduced and to be maintained, for example, at less than 0.15 mg/L, 0.04 mg/L or less, 0.03 mg/L or less, 0.02 mg/L or less, less than 0.015 mg/L, or 0 mg/L.

The amount of the oxygen absorber 21 is set such that the total amount of oxygen in the first container 30 and the second container 40 can be absorbed.

Figure 9A:
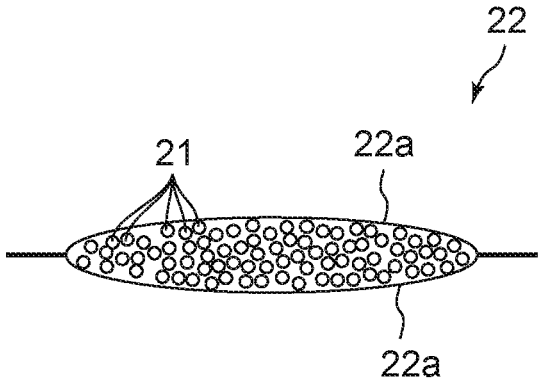
FIG. 9A is a sectional view of an example of a deoxygenated member that includes an oxygen absorber.

The oxygen absorber 21 is not particularly limited provided that the oxygen absorber 21 is a composition that can absorb oxygen. Examples of the oxygen absorber 21 can include an iron oxygen absorber and a non-iron oxygen absorber. The oxygen absorber may be an oxygen absorber composition that contains, as a main component for an oxygen absorbing reaction, metal powder such as iron powder, a reducible inorganic substance such as an iron compound, polyhydric phenol, polyhydric alcohol, ascorbic acid, a reducible organic substance such as the salt thereof, or a metal complex. As illustrated in FIG. 1 and FIG. 8, the combination container 10 may include a deoxygenated member 22 that is contained in the second container 40 together with the liquid-containing first container 30L. As illustrated in FIG. 9A, the deoxygenated member 22 includes a parcel (package, pouch) 22*a* that has the oxygen permeability and the oxygen absorber 21 that is contained in the parcel 22*a*. Examples of the deoxygenated member 22 that includes the oxygen absorber 21 may include an FX type of moisture-dependent iron, an S type, an SPE type, a ZP type, a ZI-PT type, a ZJ-PK type, and an E type of self-reactive iron, a GLS type, a GL-M type, and GE type of a self-reactive organic matter, available from MITSUBISHI GAS CHEMICAL COMPANY, INC. Examples of the deoxygenated member 22 that includes the oxygen absorber 21 may include a ZH type, a Z-PK YA, a Z-PR, a Z-PKR, and a ZM type for a medicine, available from MITSUBISHI GAS CHEMICAL COMPANY, INC.

Figure 9B:
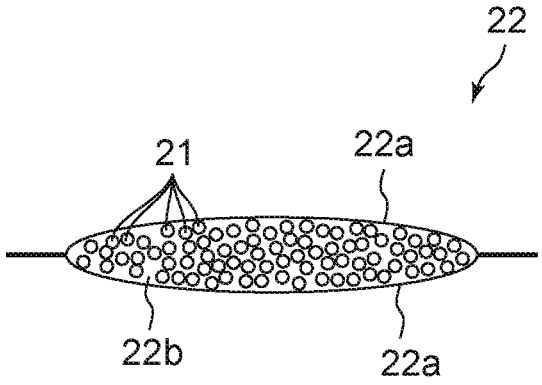
FIG. 9B is a sectional view of another example of the deoxygenated member that includes the oxygen absorber.

As illustrated in FIG. 9B, the deoxygenated member 22 may contain a water retention agent 22*b* that retains moisture in order to facilitate absorbance of oxygen by using the oxygen absorber 21. Examples of the water retention agent 22*b* include one or more selected from a group consisting of diatomaceous earth, silica, and activated carbon. The water retention agent 22*b* may be used as a carrier that carries the oxygen absorber 21.

In an example in which the liquid L contains a non-aqueous solvent such as alcohol or oil, the water retention agent 22*b* that retains moisture is effective for ensuring a function of the oxygen absorber 21 to absorb oxygen. A non-aqueous solvent means a solvent in which a main component that has the maximum volume ratio is not water. The non-aqueous solvent may substantially not contain water. The ratio of the volume of moisture in the non-aqueous solvent may be 2% or less, may be 1% or less, or may be 0.5% or less. The non-aqueous solvent may not contain water.

In the case where the liquid L is an aqueous solution, the deoxygenated member 22 may not contain the water retention agent 22*b*. The first container 30 that has the oxygen permeability has water vapor permeability in many cases. In this example, moisture can be supplied to the oxygen absorber 21 without using the water retention agent 22*b*. Moisture may be inhibited from being absorbed by the water retention agent 22*b*. For example, the amount of moisture that is absorbed by the water retention agent 22*b* that is used for the deoxygenated member 22 may be 5% or less of the volume (mL) of the liquid L that is contained in the first container 30. As for a condition in which the liquid such as a medicine is preserved, a reduction in the volume can be set at 5% or less. A reduction in the liquid L in the first container 30 can be restricted. This condition can be satisfied when the amount of moisture that can be absorbed by the water retention agent 22*b* is set at 5% or less of the initial volume (mL) of the liquid L.

In the case where water vapor that permeates the first container 30 and that moves into the second container 40 activates the oxygen absorber 21, a portion or the whole of the oxygen absorber 21 or a portion or the whole of the deoxygenated member 22 may be disposed above the portion of the first container 30 that has the oxygen permeability in the vertical direction. For example, in the case where the container body 32 has the oxygen barrier property, and the stopper 34 has the oxygen permeability, a portion or the whole of the oxygen absorber 21 may be disposed above the stopper 34. In the case where the container body 32 has the oxygen barrier property, and the stopper 34 has the oxygen permeability, a portion or the whole of the deoxygenated member 22 may be disposed above the stopper 34. Water vapor is lighter than nitrogen, oxygen, and many kinds of inert gas. Accordingly, the water vapor that permeates the first container 30 can be effectively used to activate the oxygen absorber 21.

Figure 9C:
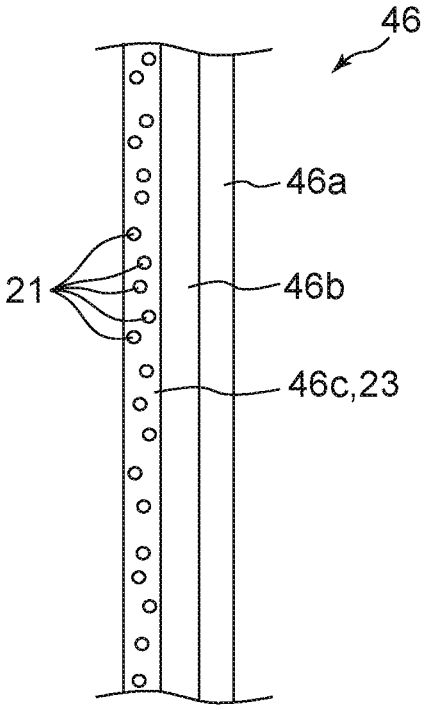
FIG. 9C is a sectional view of an example of a deoxygenated film that includes the oxygen absorber.

The oxygen absorber 21 may be contained in a deoxygenated film 23. FIG. 9C illustrates an example of a multilayer body 46 that includes the deoxygenated film 23. The multilayer body 46 that includes the deoxygenated film 23 may be included in the film 41*a* to 41*e* of the second container 40 illustrated in FIG. 1 and FIG. 7A to FIG. 7C. The multilayer body 46 that includes the deoxygenated film 23 may be included in the container body 42 or the lid 44 of the second container 40 illustrated in FIG. 8. The multilayer body 46 illustrated in FIG. 9C includes a first layer 46*a*, a second layer 46*b*, and a third layer 46*c*. The first layer 46*a* may be an outermost layer composed of, for example, polyethylene terephthalate or nylon. The second layer 46*b* may be an oxygen barrier layer composed of, for example, aluminum foil, inorganic deposition film, or metal deposition film. The third layer 46*c* may be an innermost layer that serves as a heat seal layer. The third layer 46*c* illustrated includes a base material composed of thermoplastic resin and the oxygen absorber 21 that is dispersed in the base material. As in an example illustrated in FIG. 9C, the second container 40 may include the deoxygenated film 23 that includes the oxygen absorber 21 as a portion of the multilayer body 46. The oxygen absorber 21 is not limited by the heat seal layer or the innermost layer 46*c* and may be contained in an adhesive layer or an intermediate layer of the multilayer body. In another example, the first container 30 may include the deoxygenated film 23 that includes the oxygen absorber 21. As in the example illustrated in FIG. 1 and an example illustrated in FIG. 8, the oxygen absorber 21 may be provided separately from the first container 30 and the second container 40 or may be provided as a portion of the first container 30 or the second container 40 illustrated in FIG. 9C.

The oxygen concentration (%) in the first container 30 and the oxygen concentration (%) in the second container 40 are specified by a measurement device that is suitable for measurement of these oxygen concentrations. An oxygen amount measuring device in a headspace method, an oxygen amount measuring device in a fluorescent contact method, and an oxygen amount measuring device in a fluorescent non-contact method are known as measurement devices that measure an oxygen concentration. The amount (mg/L) of dissolved oxygen of the liquid that is contained in the first container 30 is specified by a measurement device that is suitable for measurement of the amount of dissolved oxygen in the liquid. The oxygen amount measuring device in the fluorescent contact method and the oxygen amount measuring device in the fluorescent non-contact method, for example, are known as measurement devices that measure the amount of dissolved oxygen. An appropriate measurement device is selected as the measurement device that measures the oxygen concentration and the amount of dissolved oxygen in consideration for, for example, a measurement limit, stability of measurement in an oxygen concentration band to be measured, a measurement environment, and a measurement condition.

A headspace analyzer FMS760 made by lighthouse is used as the oxygen amount measuring device in the headspace method. As for measurement by using the measurement device, light at a frequency that can be absorbed by oxygen is emitted from a position outside a container toward the container that contains oxygen to be measured, and light that passes through a headspace HS of the container and that exits from the container is received. A change in light intensity is measured before and after permeation, and the oxygen concentration (%) in the container can be specified based on the change in the light intensity. Accordingly, if light from the measurement device can pass through the first container 30, the oxygen concentration in the first container 30 can be specified without opening the first container 30. If light from the measurement device can pass through the second container 40, light is emitted from a position outside the second container 40, and the oxygen concentration in the first container 30 can be measured without opening the second container 40 also as for the first container 30 that is contained in the second container 40. The oxygen concentration (%) in the second container 40 can be measured by using the headspace analyzer FMS760 made by lighthouse. The saturation solubility of oxygen into the liquid L can be specified by using the oxygen concentration (%) and temperature of the headspace HS that is measured. The amount (mg/L) of dissolved oxygen in the liquid L can be specified based on the specified saturation solubility. The oxygen concentration in a container can be measured by using the headspace analyzer FMS760 from a position outside the container. The lower limit of the oxygen concentration that can be measured by the headspace analyzer FMS760 is higher than the lower limit of the oxygen concentration that can be measured by other measurement devices.

An oxygen amount measuring device Microx4 made by PreSens Precision Sensing GmbH in Germany is used as the oxygen amount measuring device in the fluorescent contact method. The oxygen amount measuring device Microx4 is a needle device. The oxygen amount measuring device Microx4 punctures a needle into a container, can consequently measure the oxygen concentration and the amount of dissolved oxygen in the container, and is excellent for stability of measurement depending on the structure of a portion of the container into which the needle is punctured. Multiple combination containers or containers that are manufactured in the same condition are prepared, the amounts of oxygen in the containers are measured by using a needle oxygen amount measuring device with different timings, and consequently, variations in the amounts of oxygen over time can be evaluated.

An oxygen sensor is contained in advance in a container, and consequently, the oxygen concentrations and the amounts of dissolved oxygen in the first container 30 and in the second container 40 can be measured by the oxygen amount measuring device in the fluorescent non-contact method. An oxygen amount measuring device Fibox3 made by PreSens Precision Sensing GmbH in Germany is used as the oxygen amount measuring device in the fluorescent non-contact method. The oxygen sensor receives light in a specific wavelength range and consequently generates autofluorescence. The amount of the autofluorescence of the oxygen sensor increases as the amount of oxygen around the sensor increases. The oxygen amount measuring device in the fluorescent non-contact method can radiate light at a specific wavelength at which the oxygen sensor generates the autofluorescence, measures the amount of the autofluorescence of the oxygen sensor, and can measure the oxygen concentrations (%) and the amounts (mg/L) of dissolved oxygen. In the case where the first container 30 is contained in the second container 40, light is emitted from a position outside the second container 40 without opening the second container 40, and the amount of dissolved oxygen in the liquid L can be measured.

As illustrated in FIG. 1 and FIG. 8, the container set 20 and the combination container 10 may include a dehydrating agent 24 that absorbs moisture in the second container 40. The dehydrating agent 24 is a substance that absorbs moisture such as water vapor or water or a composition that contains the substance. Examples of the dehydrating agent 24 can include calcium chloride, soda lime, and silica gel. The dehydrating agent 24 may be contained in the second container 40 together with the first container 30, and the second container 40 may be closed. In the example illustrated in FIG. 1, the dehydrating agent 24 that serves as a dehydrating member that is contained in a parcel (package, pouch) is disposed in the second container 40. A dehydrating film that contains a dehydrating material may be included as a portion of the first container 30 or the second container 40 as in the oxygen absorber described above. In this example, an oxygen barrier layer that is included in the second container 40 and the dehydrating film that contains the dehydrating agent 24 may be stacked and formed into one piece. In the case where a non-aqueous solvent such as glycerin or alcohol is contained in the first container 30, the dehydrating agent 24 that is contained in the second container can remove moisture such as water vapor or water in the first container 30. The present inventors confirm that moisture in the first container 30 can be reduced to 100 μg or less, 50 μg or less, or 10 μg or less in a manner in which the dehydrating agent is contained in the second container 40.

In the case of using the dehydrating agent 24, moisture in the first container 30 can be measured by using the Karl Fischer Method. Specifically, the amount of moisture in the first container 30 can be specified in a coulometric titration method by using a Karl Fischer moisture titrator MKC-610 made by Kyoto Electronics Manufacturing Co., Ltd.

The container set 20 and the combination container 10 may include an oxygen detection member 25 that detects the state of oxygen in the second container 40. The oxygen detection member 25 may display the detected state of oxygen. The oxygen detection member 25 may detect the oxygen concentration. The oxygen detection member 25 may display the value of the detected oxygen concentration. The oxygen detection member 25 may display the value of the detected oxygen concentration by using a color.

The oxygen detection member 25 may contain variable organic dye that reversibly changes the color thereof due to oxidation-reduction. For example, an oxygen reducing agent contains organic dye such as thiazine dye, azine dye, or oxazine dye and a reducing agent and may be solid. The oxygen reducing agent may contain an oxygen indicator ink composition. The oxygen indicator ink composition may contain a resin solution, thiazine dye, reducing sugar, and an alkali substance. The thiazine dye, the reducing sugar, and the alkali substance may be dissolved or dispersed in the resin solution. A substance that is contained in the oxygen detection member 25 may reversibly change due to oxidation and reduction. The oxygen detection member 25 that is contained in a container changes the displayed color due to deoxidation in the container before the deoxidation ends by using the oxygen detection member 25 that contains a reversible substance, the amount of oxygen in the container is consequently observed from a position outside the container that is transparent, and a state related to oxygen in the container can be grasped. The oxygen detection member 25 that is contained in the container can change the displayed color and can report an increase in the oxygen concentration after the deoxidation ends, such as a state in which a pinhole, for example, is formed in the container, and oxygen enters the container during, for example, distribution.

More specifically, an oxygen detection member named "AGELESS EYE" available from MITSUBISHI GAS CHEMICAL COMPANY, INC., may be used as the oxygen detection member 25 that is a commercially supplied tablet. The oxygen detection member named "PAPER EYE" available from MITSUBISHI GAS CHEMICAL COMPANY, INC., for example, may be used as an oxygen detector to which an ink composition that has a function of detecting oxygen is applied. The "AGELESS EYE" and "PAPER EYE" are functional products that can simply display a non-oxygen state in which the oxygen concentration in a transparent container is less than 0.1 volume % by using a color variation. For example, the oxygen detection member 25 may be a product that can be used, for example, to maintain the freshness of a food product and the quality of a medicine in addition to the oxygen absorber such as an oxygen absorber named "AGELESS" available from MITSUBISHI GAS CHEMICAL COMPANY, INC.

As illustrated in FIG. 1, the oxygen detection member 25 may be provided such that a display unit (indication portion) 26 can be observed from a position outside the second container 40 that is transparent. In the example illustrated in FIG. 1, the oxygen detection member 25 is contained in the second container 40 as in the oxygen absorber 21 and the deoxygenated member 22. The oxygen detection member 25 may be joined to the inner surface of the second container 40 or the outer surface of the first container 30 by using welding or a joining material. The oxygen detection member 25 may be disposed such that the deoxygenated member 22 and the dehydrating agent 24 do not disrupt the observation of the display unit 26. In the case where the first container 30 is labeled, the deoxygenated member 22, the dehydrating agent 24, and the oxygen detection member 25 are preferably disposed so as not to cover the label.

The oxygen detection member 25 may detect the state of oxygen in the first container 30. That is, the container set 20 and the combination container 10 may include the oxygen detection member 25 that detect the state of oxygen in the first container 30. The oxygen detection member 25 may be contained in the first container 30. The oxygen detection member 25 may display the detected state of oxygen in the first container 30. The oxygen detection member 25 may detect the oxygen concentration in the first container 30. The oxygen detection member 25 may display the value of the detected oxygen concentration in the first container 30. The oxygen detection member 25 may display the value of the detected oxygen concentration in the first container 30 by using a color.

The oxygen concentration in a space that is not occupied by the liquid L in the first container 30, that is, the headspace HS, can be reduced to about 1.5% or less in a manner in which the headspace HS is replaced with inert gas before the stopper 34 is mounted on the container body 32 or bubbling the liquid L by using the inert gas. It can be thought that the amount of dissolved oxygen into the liquid that is contained in a container can be reduced in a manner in which the liquid is manufactured in an atmosphere that is replaced with the inert gas, and the liquid is contained in the container that has the oxygen barrier property. A manufacturing facility needs to be extensively renovated and huge capacity investment is needed to install the entire line for manufacturing the liquid in the atmosphere that is replaced with the inert gas. In the field of, for example, an expensive medicine, the medicine is frozen, dried, pulverized, and preserved in order to ensure the stability of, for example, temperature, oxygen, moisture, and light. As for the pulverization of a liquid medicine for preservation and liquefaction of the pulverized medicine for use, there are huge disadvantages in terms of effort, time, and costs.

According to the present embodiment, however, the first container that contains the liquid can be manufactured by using, for example, an existing facility as usual. Accordingly, the renovation of the facility and the capacity investment can be avoided. In particular, as for the use for the liquid such as medicine, an approval request about a change in the manufacturing facility or manufacturing processing to a public institution can be omitted, which is effective. An effort to freeze and dry the liquid L or to liquefy powder can be omitted. In addition, no special restrictions are imposed on the first container 30. Accordingly, a widely used material, for example, glass or resin such as polyethylene or polypropylene for a container for, for example, a food product or a medicine because of a small elution amount can be used as the material of the first container.

In the specific example described above, the first container 30 includes the container body 32 and the stopper 34. The first container 30 may be a vial bottle. A vial bottle that contains a liquid, particularly, a vial bottle that contains a liquid in a sterile state is manufactured by using butyl rubber or fluorine rubber that has low oxygen permeability and the oxygen barrier property. In the specific example described above, however, the stopper 34 has the oxygen permeability. That is, the stopper 34 is permeable to oxygen. For example, the oxygen permeability coefficient ($cm^3$ (STP)·cm/($cm^2$·sec·Pa)) of the material of the stopper 34 is set to a large value. The stopper 34 may be composed of silicone or silicone rubber. The oxygen permeability coefficient of silicone or silicone rubber of which the stopper 34 is composed may be higher than the oxygen permeability coefficient of the material of the container body 32. In the specific example, oxygen permeates the stopper 34 and moves to a position outside the first container 30. Accordingly, the use of the stopper 34 that has the oxygen permeability easily enables an existing container such as a vial bottle that has been used to have the oxygen permeability.

In the specific example, the time until the equilibrium is reached depends on the amount of oxygen to which the stopper 34 is permeable. Accordingly, the area of the opening portion 33 of the container body 32 or the thickness of the stopper 34 is adjusted as described above, and consequently, the time until the equilibrium of the permeation of oxygen through the first container 30 is reached after the first container 30 is contained in the second container 40 can be reduced. This enables dissolving (decomposition) due to oxygen in the liquid L to be reduced.

A partial volume (the volume of the headspace HS) of the first container 30 that is obtained by subtracting the volume of the liquid L from the volume of the first container 30 may be 50 mL or less, may be 30 mL, may be 10 ml, or may be 5 mL or less. The liquid-containing combination container 10L can reduce the time until the equilibrium of the permeation of oxygen through the first container 30 is reached after the second container 40 that contains the first container 30 is closed. This enables dissolving (decomposition) due to oxygen in the liquid L to be reduced.

Similarly, the volume of the liquid L that is contained in the first container 30 may be 20 ml or less or may be 10 ml or less. The liquid-containing combination container 10L can reduce the time until the equilibrium of the permeation of oxygen through the first container 30 is reached after the second container 40 that contains the first container 30 is closed. This enables dissolving (decomposition) due to oxygen in the liquid L to be reduced.

An upper limit and a lower limit may be set for a ratio (%) of the partial volume (mL) (the volume of the headspace HS) of the first container 30 that is obtained by subtracting the volume of the liquid L from the volume of the first container 30 to a partial volume (mL) of the second container 40 that is obtained by subtracting the volume of the first container 30 from the volume of the second container 40. The ratio may be 50% or less or may be 20% or less. Setting the upper limit enables the oxygen concentration in the first container 30 to be reduced. In addition, a space for containing the first container 30 can be ensured in the second container 40, and the first container 30 can be easily contained in the second container 40. In addition, the time until the equilibrium of the permeation of oxygen through the first container 30 is reached after the second container 40 that contains the first container 30 is closed can be reduced. This enables dissolving (decomposition) due to oxygen in the liquid L to be reduced. The ratio may be 5% or more or may be 10% or more. Setting the lower limit enables the second container 40 to be inhibited from being too large in comparison with the first container 30 and enables the ease of handling the combination container 10 to be inhibited from reducing.

Whether the equilibrium of the permeation of oxygen through the first container 30 is reached is determined based on the oxygen concentration in the first container 30. It is determined that the equilibrium is reached in the case where a difference between the value (%) of the oxygen concentration in the first container 30 at a point of time and the value (%) of the oxygen concentration in the first container 30 before the point of time by 24 hours is ±5% or less of the value (%) of the oxygen concentration in the first container 30 at the point of time.

The liquid-containing first container 30L and the liquid-containing combination container 10L that have an adjusted oxygen concentration and amount of dissolved oxygen can be obtained in the above manner. In many cases of existing techniques, it is difficult to reduce the oxygen concentration (%) in the headspace HS in the first container 30 merely by replacement with the inert gas or bubbling because the liquid L is contained in the first container 30. As a result, it is difficult to reduce a large amount of remaining oxygen dissolved in liquid L. In the specific example according to the embodiment described above, however, the liquid-containing first container 30L and gas are contained in the second container 40, it is not necessary to contain the liquid L as it is, and accordingly, the oxygen concentration in the second container 40 can be sufficiently reduced. Accordingly, the volume of the second container 40 is adjusted in advance, and consequently, the oxygen concentration in the first container 30 in an equilibrium state can be less than 1%. The actions and effects as above are preferable for the case where the liquid L is a medicine or a food product that has the high sensitivity.

In particular, in the case where the oxygen absorber 21 that absorbs oxygen in the second container 40 is used, the oxygen concentration in the first container 30 can be reduced to less than 0.3%, 0.1% or less, 0.05% or less, less than 0.03%, or 0%, and the oxygen concentration in the second container 40 can be reduced to less than 0.3%, 0.1% or less, 0.05% or less, less than 0.03%, or 0%. In the case where the oxygen absorber 21 that absorbs oxygen in the second container 40 is used, the amount of dissolved oxygen in the liquid L in the first container 30 can be reduced to less than 0.15 mg/L, 0.04 mg/L or less, 0.03 mg/L or less, less than 0.015 mg/L, or 0 mg/L. In addition, the oxygen absorber 21 is disposed outside the first container 30, and consequently, the oxygen absorber 21 does not break a sterilization state in the first container 30.

If a long period is needed to reduce the oxygen concentration and the amount of dissolved oxygen, deterioration of the liquid L due to oxygen develops. A period or a time until the equilibrium of the permeation of oxygen through the first container 30 is reached after the second container 40 is closed is preferably within four weeks. In the case where the equilibrium is reached within four weeks, and the oxygen concentration in the second container 40, for example, is less than 1%, deterioration of the liquid L that is a medicine can be effectively reduced. As for the liquid L that has the high sensitivity, the period until the equilibrium is reached is preferably within 20 days, more preferably within one week, further preferably within three days. A certain period is needed for equilibrium in which the amount of dissolved oxygen in the liquid L is reduced to a certain extent. The period or time until the equilibrium of the permeation of oxygen through the first container 30 is reached after the second container 40 is closed may be one hour or more.

The amount of oxygen in the first container 30 in the second container 40 may be adjusted until the equilibrium of the permeation of oxygen through the first container 30 is reached. The amount of oxygen in the first container 30 in the second container 40 may be adjusted until the oxygen concentration in the second container 40 increases to a predetermined value. The amount of oxygen in the first container 30 in the second container 40 may be adjusted until the oxygen concentration in the first container 30 reduces to a predetermined value. The amount of oxygen in the first container 30 in the second container 40 may be adjusted until the amount of dissolved oxygen in the liquid L in the first container 30 reduces to a predetermined value. The amount of oxygen in the first container 30 in the second container 40 may be adjusted until the liquid L of the combination container 10 starts to be used. The liquid-containing combination container 10L may be delivered while the first container 30 is contained in the second container 40, and the amount of oxygen is adjusted.

A method of using the liquid-containing combination container 10L will now be described.

Before the liquid L that is contained in the combination container 10 is used, the second container 40 is first opened. Subsequently, the liquid-containing first container 30L is taken out from the second container 40 that is opened. Subsequently, the liquid L is taken out from the liquid-containing first container 30L and can be used. As for the first container 30 illustrated, the fixture 36 is removed from the container body 32, the stopper 34 is removed from the container body 32, and consequently, the first container 30 can be opened. This enables the liquid L in the first container 30 to be used.

Figure 6:
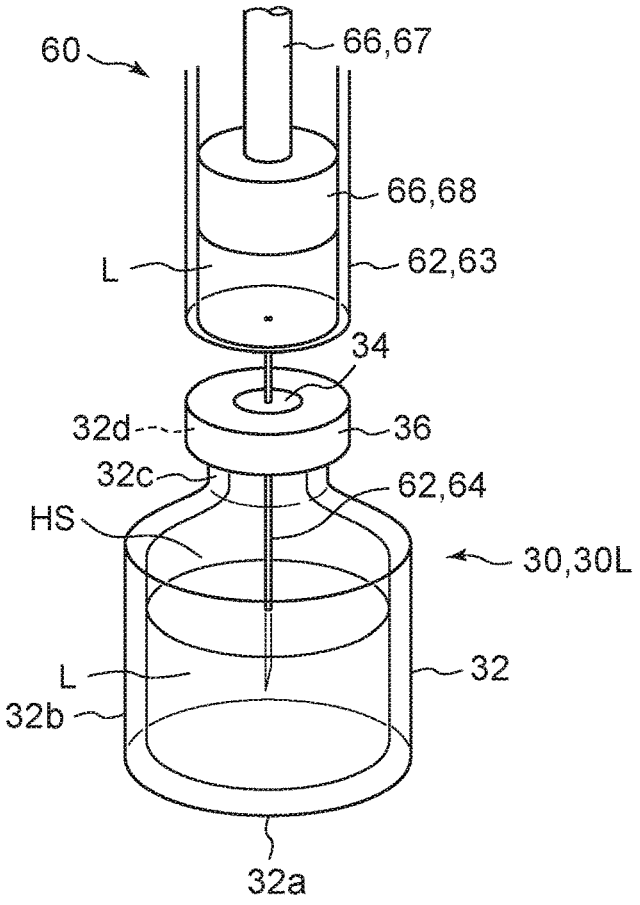
FIG. 6 is a perspective view of a method of using the liquid-containing first container in FIG. 2.

As illustrated in FIG. 6, the liquid L may be a medicine that is injected into a syringe 60. That is, the liquid L may be a liquid that is contained in the first container 30 that is a vial bottle. The liquid L may be an injectable solution that is a medicine. Examples of the injectable solution include an anticancer drug, an antiviral agent, a vaccine, and an antipsychotic. The syringe 60 includes a cylinder 62 and a piston 66. The cylinder 62 includes a cylinder body 63 and a needle 64 that projects from the cylinder body 63. The needle 64 that is tubular has access to a space for containing the liquid L in the cylinder body 63. The piston 66 includes a piston body 67 and a gasket 68 that is held by the piston body 67. The gasket 68 can be composed of, for example, rubber. The gasket 68 is inserted into the cylinder body 63 and defines the container space for the liquid L in the cylinder body 63. The liquid L that is injected into the syringe 60 may be moved from the syringe 60 to, for example, another syringe or container before being administered to, for example, a patient. In this example, this may be administered from, for example, the other syringe or container to the patient.

Pressure in the liquid-containing first container 30L is preferably adjusted. In an example, the pressure in the liquid-containing first container 30L is preferably maintained at low pressure, particularly negative pressure. In this example, the liquid can be effectively inhibited from unintentionally leaking when the liquid-containing first container 30L is preserved, and the liquid L can be effectively inhibited from splashing when the first container 30 is opened. The problems about leakage and splashing are increasingly serious when the liquid is toxic liquid such as a medicine that has high pharmacological activity. In an example illustrated in FIG. 6, when the pressure in the liquid-containing first container 30L is positive pressure, the liquid L automatically enters the syringe 60. In this case, it is difficult to inject the liquid L in a desired amount into the syringe 60 with high precision.

A liquid that has the high sensitivity and that is deteriorated by a post sterilization process that is performed after manufacturing with, for example, gas, heat, or gamma rays such as a food product or a medicine, more specifically, an anticancer drug, an antiviral agent, a vaccine, or an antipsychotic is manufactured in a sterile environment and sealed in a container. That is, a liquid for which a final sterilization method cannot be used is manufactured by using the sterile operation method. The sterile environment is typically maintained at predetermined positive pressure in order to inhibit microbes from entering. Accordingly, the pressure in the container is the predetermined positive pressure corresponding to the sterile environment, and it is difficult to adjust the inner pressure of the container after the container is closed.

According to the present embodiment, such a failure can be dealt with. The liquid-containing first container 30L is preserved in the second container 40 as described above. During preservation, oxygen in the first container 30 permeates the first container 30 and moves into the second container 40 due to a reduction in the oxygen concentration in the second container 40 caused by the oxygen absorber 21 or a reduction in the oxygen concentration in the second container 40 caused by replacement with inert gas. This enables the pressure in the first container 30 to be reduced. That is, the pressure in the first container 30 that contains the liquid L can be adjusted after the first container 30 is closed, and the liquid L is sealed.

From the perspective of the adjustment of the inner pressure of the first container 30, the second container 40 that can contain gas while the gas is maintained at negative pressure under the atmospheric pressure may be used. For example, the second container 40 that contains the first container 30 may be closed in an inert gas atmosphere that is maintained at negative pressure by using the second container 40 illustrated in FIG. 8. The pressure in the second container 40 that is closed is less than the atmospheric pressure. In this case, the permeation of oxygen from the first container 30 into the second container 40 is facilitated. In particular, the volume of the second container 40 is increased, or the initial pressure of the second container 40 is greatly reduced, and consequently, the pressure in the first container 30 can be greatly adjusted. This enables the pressure in the first container 30 that is originally positive pressure to be adjusted to the atmospheric pressure (1 atm) or less or negative pressure in a manner in which the first container 30 is preserved in the second container 40. This enables the liquid-containing first container 30L the pressure of which is adjusted can be manufactured, which does not depend on a method of manufacturing the liquid L or a method of sealing the liquid L in the first container 30 for the liquid.

The second container 40 is closed at negative pressure, and consequently, the permeation of oxygen in the first container 30 is facilitated. Accordingly, the time until the equilibrium of the permeation of oxygen through the first container 30 is reached after the second container 40 that contains the liquid-containing first container 30L is closed can be reduced.

Negative pressure means a pressure of less than the atmospheric pressure, that is, a pressure of less than 1 atm. Positive pressure means a pressure of more than 1 atm that is the atmospheric pressure. Whether the pressure in a container is negative pressure can be determined by using a pressure gauge in the case where the pressure gauge is provided in the container. In the case where no pressure gauge is provided in the container, the determination can be made by using a syringe. Specifically, when the needle of the syringe punctures the container, the determination can be made depending on whether a liquid or gas that is contained in the syringe enters the container with only the atmospheric pressure applied to the piston of the syringe. In the case where the liquid or gas that is contained in the syringe enters the container, it is determined that the pressure in the container is negative pressure. Similarly, whether the pressure in the container is positive pressure can be determined by using the pressure gauge or by using the syringe. Specifically, when the needle of the syringe punctures the container, the determination can be made depending on whether the liquid or gas that is contained in the container enters the syringe with only the atmospheric pressure applied to the piston of the syringe. In the case where the liquid or gas that is contained in the container enters the syringe, it is determined that the pressure in the container is positive pressure.

The container set 20 according to the embodiment described above includes the first container 30 that contains the liquid L and that at least partly has the oxygen permeability and the second container 40 that is capable of containing the first container 30 and that has the oxygen barrier property. The first container 30 is contained in the second container 40, and consequently, the combination container 10 is obtained. That is, the liquid-containing combination container 10L includes the first container 30 that contains the liquid L and that at least partly has the oxygen permeability and the second container 40 that contains the first container 30 and that has the oxygen barrier property. The oxygen concentration in the first container 30 may be less than 1% with the equilibrium of the permeation of oxygen through the first container 30 reached. A method of manufacturing the liquid-containing first container 30L includes a process of closing the second container 40 that contains the liquid-containing first container 30L and that is filled with inert gas and a process of adjusting the amount of oxygen in the liquid-containing first container 30L that is contained in the second container 40. In the process of adjusting the amount of oxygen, oxygen in the first container 30 permeates the first container 30, the oxygen concentration in the first container 30 consequently reduces, and the amount of dissolved oxygen in the liquid L can be reduced.

As illustrated in FIG. 1, the gap G may be formed between the stopper 34 that has the oxygen permeability of the first container 30 that is contained in the second container 40 and the second container 40. In this example, the second container 40 that has the oxygen barrier property can be inhibited from covering the stopper 34 that has the oxygen permeability. This enables the permeation of oxygen in the first container 30 to be inhibited from being disturbed by the second container 40. Accordingly, the gap G enables a reduction in the amount of oxygen in the first container 30 to be facilitated.

According to such the embodiment, oxygen in the first container 30 permeates the first container 30 and can move into the second container 40. The atmosphere in the second container 40 is replaced with inert gas, and consequently, the oxygen concentration (%) in the second container 40 increases, and the oxygen concentration (%) in the first container 30 can reduce. As the oxygen concentration (%) in the first container 30 reduces, the amount (mg/L) of dissolved oxygen in the liquid L reduces. Accordingly, the amount of oxygen that is dissolved in the liquid L can be reduced, and dissolving (decomposition) due to oxygen in the liquid L can be reduced.

In particular, in the case where the oxygen absorber 21 that absorbs oxygen in the second container 40 is used, the oxygen concentration in the first container 30 can be reduced to less than 0.3%, 0.1% or less, 0.05% or less, less than 0.03%, or 0%, and the oxygen concentration in the second container 40 can be reduced to less than 0.3%, 0.1% or less, 0.05% or less, less than 0.03%, or 0%. In the case where the oxygen absorber 21 that absorbs oxygen in the second container 40 is used, the amount of dissolved oxygen in the liquid L in the first container 30 can be reduced to less than 0.15 mg/L, 0.04 mg/L or less, 0.03 mg/L or less, less than 0.015 mg/L, or 0 mg/L. The oxygen absorber 21 can be disposed outside the first container 30, and consequently, the oxygen absorber 21 does not break the sterile state in the first container 30.

As for the combination container 10, the second container 40 contributes to reducing the amount of oxygen and has the oxygen barrier property. The liquid-containing first container 30L may contribute to sterilization of the inside and the liquid L that is contained. A container environment required for the liquid L is effectively achieved by using a combination of the first container 30 and the second container 40. The combination container 10 and the container set 20 enables a preservation environment required for the liquid L to be achieved at a high degree of freedom and low costs.

In the specific example according to the embodiment described above, the first container 30 includes the container body 32 that includes the opening portion 33 and the stopper 34 that closes the opening portion 33. The stopper 34 may have the oxygen permeability. The stopper 34 may contain silicone. The oxygen permeability coefficient of the material of the stopper 34 may be $1\times10^{-12}$ ($cm^3$ (STP)·cm/($cm^2$·sec·Pa)) or more. The oxygen permeability coefficient ($cm^3$ (STP)·cm/($cm^2$·sec·Pa)) of the material of the stopper 34 may be higher than the oxygen permeability coefficient ($cm^3$ (STP)·cm/($cm^2$·sec·Pa)) of the material of the container body 32. In this specific example, oxygen permeates the stopper 34 and moves to a position outside the first container 30. Accordingly, a region in the first container 30 that is exposed to the so-called headspace HS and apart from the liquid L can have the oxygen permeability. Consequently, the permeation of oxygen through the first container 30 is smooth, and the time until the equilibrium of the permeation of oxygen through the first container 30 is reached after the first container 30 is contained in the second container 40 can be reduced.

In the specific example according to the embodiment described above, the container body 32 may have the oxygen barrier property. Oxygen that permeates the first container 30 enters a region away from the liquid L in, for example, the headspace HS in the first container 30. Accordingly, the oxygen that permeates the first container 30 can be inhibited from being dissolved in the liquid L.

In the specific example according to the embodiment described above, the area of the opening portion 33 of the container body 32 may be 10 $mm^2$ or more and 500 $mm^2$ or less. The thickness of the stopper 34 may be 0.1 mm or more and 5 mm or less. The liquid-containing combination container 10L can reduce the time until the equilibrium of the permeation of oxygen through the first container 30 is reached after the first container 30 is contained in the second container 40. This enables dissolving (decomposition) due to oxygen in the liquid L to be reduced.

Specific examples of the second container 40 will now be described. The second container 40 that will be described below can be used so as to be combined with the first container 30 that includes the container body 32 and the stopper 34 described above, and the stopper 34 has the oxygen permeability. In the description below and the figures used for the description below, a portion that can have the same structure as in the examples described above and a portion that can have the same structure as in some specific examples described later are designated by using like reference signs, and a duplicated description is omitted.

First Specific Example

FIG. 27 to FIG. 32 illustrate a first specific example of the second container 40. In the first specific example, the liquid-containing combination container 10L includes a tray 90 that contains the first container 30. The tray 90 is a flat container that includes an opening portion 90A. The second container 40 contains the tray 90 that contains the first container 30.

The first container 30 can have the structure described above. The first container 30 illustrated includes the container body 32 that includes the opening portion 33 and the stopper 34 that closes the opening portion 33. The stopper 34 has the oxygen permeability. That is, the stopper 34 is permeable to oxygen. The second container 40 has the oxygen barrier property as described above. The second container 40 is not particularly limited but can have the same structure as in the second container described above. The second container 40 may be a film container. For example, the second container 40 may be a gusset container that uses a resin film or any one of the containers illustrated in FIG. 7A to FIG. 7D. The liquid-containing combination container 10L may include the oxygen absorber 21 that absorbs oxygen in the second container 40 as described above.

Figure 28:
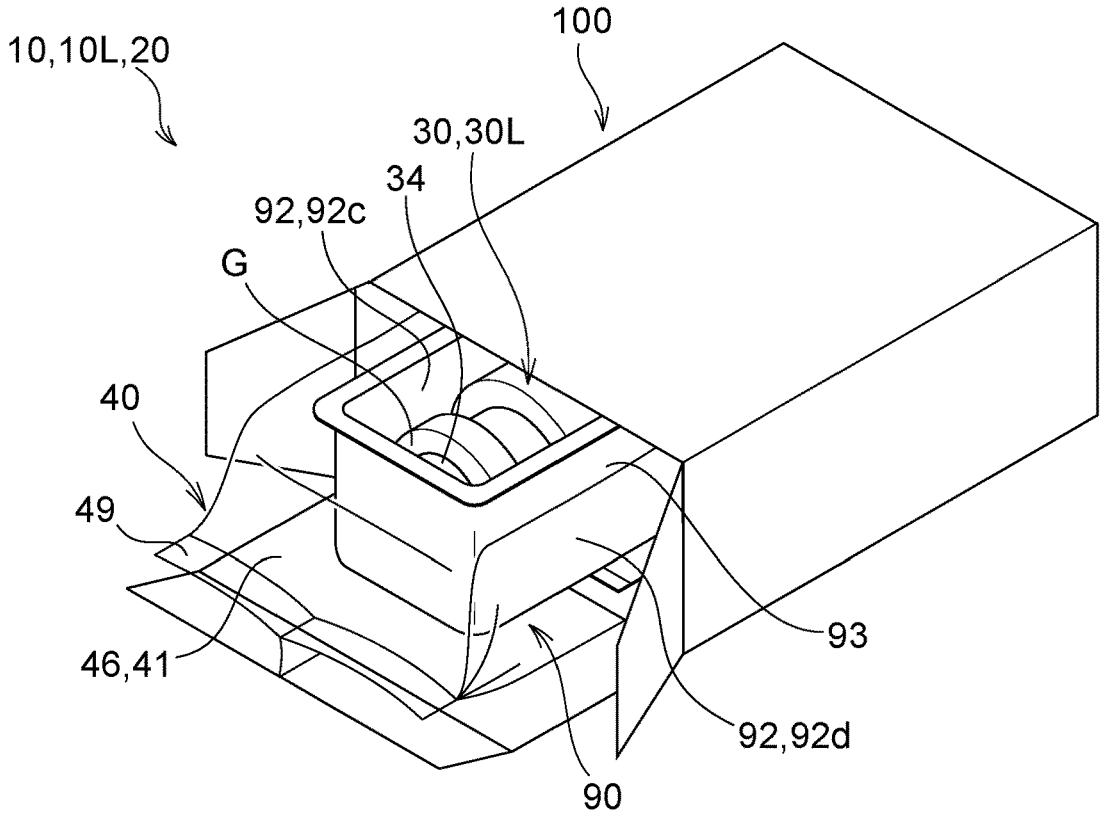
FIG. 28 is a perspective view of the liquid-containing combination container illustrated in FIG. 27.

As illustrated in FIG. 28, the liquid-containing combination container 10L may also include an outer box 100. The outer box 100 can be composed of one or more of various kinds of materials. In the illustrated example, the outer box 100 is composed of paper. The outer box 100 inhibits the liquid L from deteriorating due to light and may accordingly have a light shielding property. The light shielding property of the outer box 100 may be a light shielding property for light that causes the liquid L to deteriorate and may be, for example, a visible light shielding property. To have the light shielding property means that the total light transmittance (total luminous transmittance) of light in a target wavelength range is 30% or less, preferably 10% or less, more preferably 5% or less.

Figure 27:
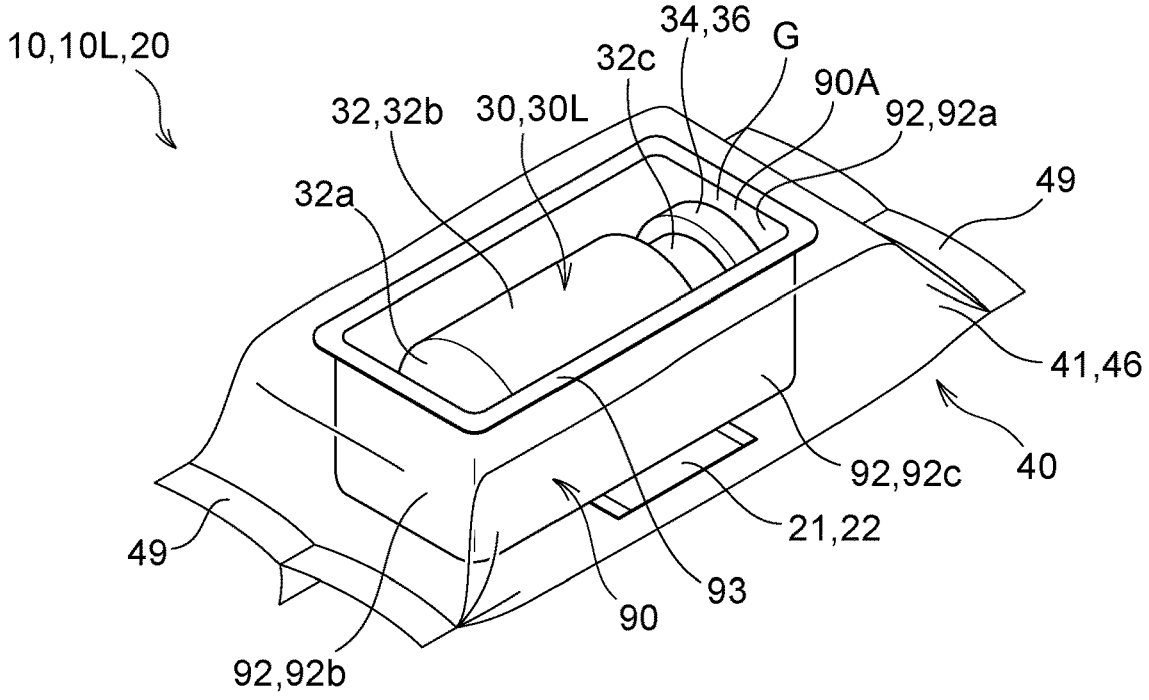
FIG. 27 illustrates a first specific example of the second container and is a perspective view of a liquid-containing combination container.
Figure 29:
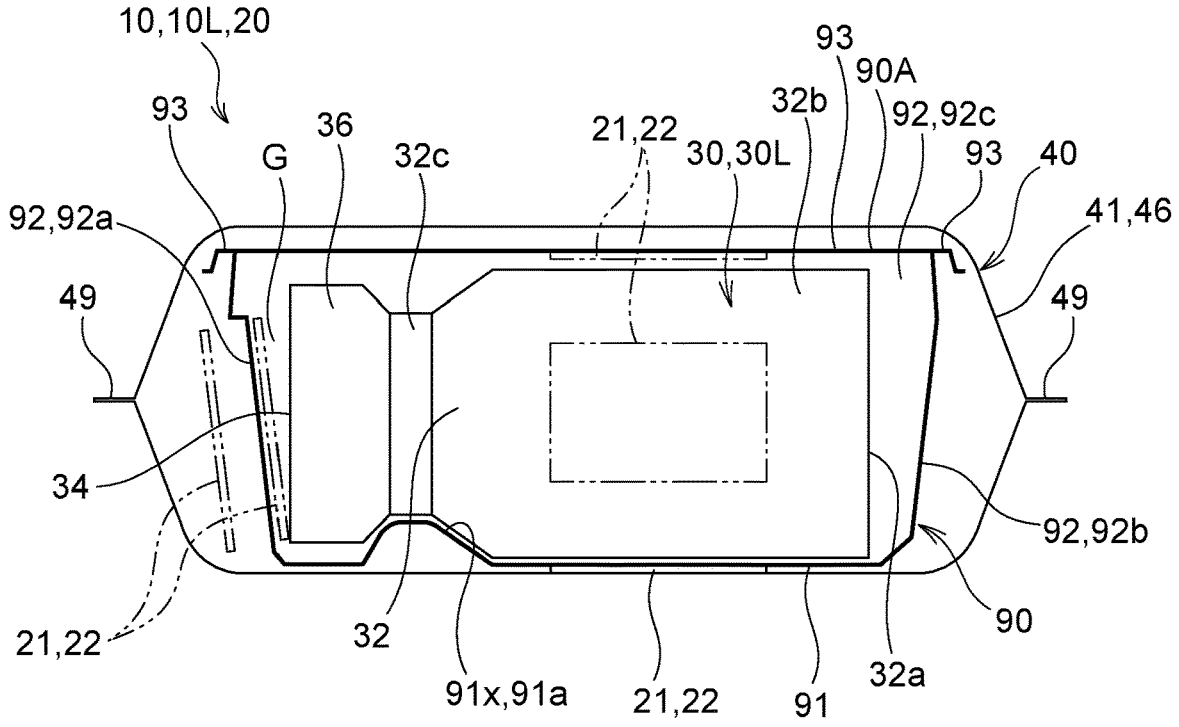
FIG. 29 is a longitudinal sectional view of the liquid-containing combination container illustrated in FIG. 27.

As illustrated in FIG. 27 and FIG. 29, the tray 90 is located between the stopper 34 and the second container 40. FIG. 29 is a longitudinal sectional view of the liquid-containing combination container 10L illustrated in FIG. 27. The gap G is formed between the tray 90 and the stopper 34. This enables the second container 40 that has the oxygen barrier property to be inhibited from covering the stopper 34 that has the oxygen permeability. Accordingly, movement of oxygen in the first container 30 to a position outside the first container 30 due to the permeation of the oxygen through the stopper 34 can be facilitated. For example, oxygen in the second container 40 is absorbed by using the oxygen absorber 21, the oxygen concentration (%) in the headspace HS in the first container 30 can be consequently stably reduced, and the amount (mg/L) of dissolved oxygen in the liquid L that is contained in the first container 30 can be stably reduced.

Figure 30:
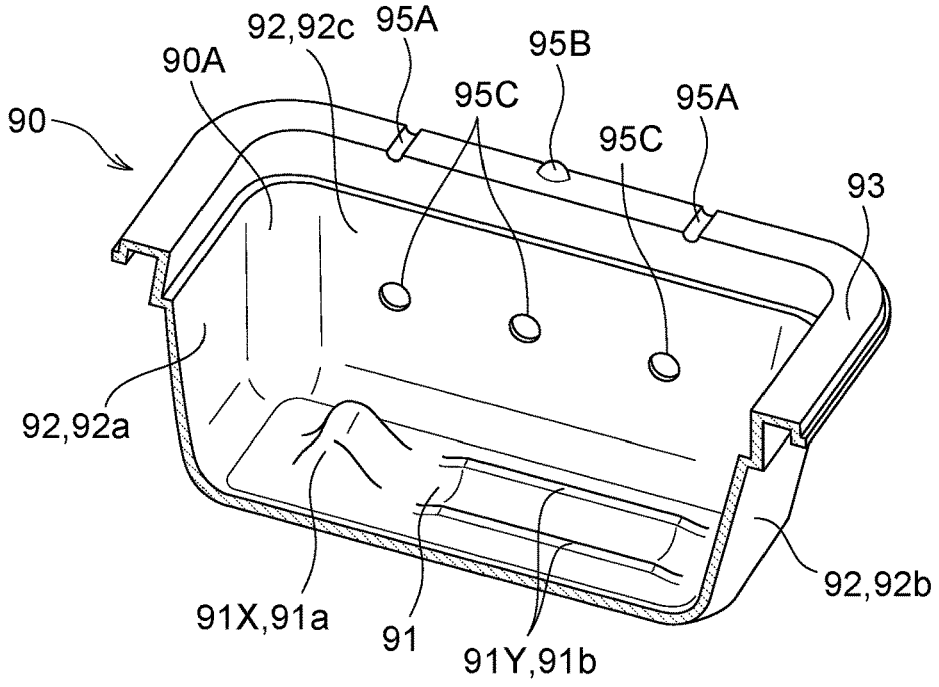
FIG. 30 is a sectional perspective view of an example of a tray that is included in the liquid-containing combination container illustrated in FIG. 27.

As illustrated in FIG. 27, FIG. 29, and FIG. 30, the tray 90 includes a bottom wall 91 and a side wall 92 that is connected to the bottom wall 91. FIG. 30 is a sectional perspective view of an example of the tray 90. The side wall 92 extends upward from the bottom wall 91. The side wall 92 is tubular. An opening of the side wall 92 that is tubular forms the opening portion 90A of the tray 90. The other opening of the side wall 92 that is tubular is closed by the bottom wall 91. The side wall 92 includes a first side wall portion 92*a* and a second side wall portion 92*b* that are paired and that face each other. The first side wall portion 92*a* faces the stopper 34 of the first container 30 that is contained in the tray 90. The second side wall portion 92*b* faces the bottom portion 32*a* of the container body 32 of the first container 30 that is contained in the tray 90. As illustrated in FIG. 29, the gap G is formed between the first side wall portion 92*a* and the stopper 34. The first side wall portion 92*a* is located between the stopper 34 and the second container 40. The first side wall portion 92*a* inhibits the second container 40 from coming into contact with the stopper 34.

The tray 90 illustrated includes a third side wall portion 92*c* and a fourth side wall portion 92*d*. The third side wall portion 92*c* connects an edge of the first side wall portion 92*a* and an edge of the second side wall portion 92*b* to each other. The fourth side wall portion 92*d* connects another edge of the first side wall portion 92*a* and another edge of the second side wall portion 92*b* to each other. The first side wall portion 92*a* to the fourth side wall portion 92*d* are included in the side wall 92 that is tubular. The tray 90 also includes a flange portion 93 that extends from the side wall 92. The bottom wall 91 is connected to an edge of the side wall 92. The flange portion 93 is connected to another edge of the side wall 92. The flange portion 93 has a surrounding shape as in the side wall 92. The flange portion 93 extends outward from the side wall 92, that is, in a direction opposite the container space of the tray 90. The flange portion 93 that has a surrounding shape defines the opening portion 90A.

The tray 90 may include positioning portions 91X and 91Y that restrict movement of the first container 30 that is contained. The tray 90 illustrated in FIG. 30 includes the first positioning portion 91X and the second positioning portion 91Y. The first positioning portion 91X includes a first positioning projection 91*a* that is provided on the bottom wall 91. As illustrated in FIG. 29, the first positioning projection 91*a* is fitted in a recessed portion of the first container 30. More specifically, the first positioning projection 91*a* projects toward the neck portion 32*c* of the first container 30. The first container 30 illustrated includes the recessed portion at the neck portion 32*c* between the stopper 34 and the trunk portion 32*b* of the container body 32. The first positioning projection 91*a* comes into contact with the stopper 34 and the trunk portion 32*b* and consequently restricts relative movement of the first container 30 with respect to the tray 90 in a direction in which the stopper 34 and the first side wall portion 92*a* face each other. Accordingly, the gap G between the first side wall portion 92*a* and the stopper 34 can be stably maintained. Consequently, oxygen permeates the stopper 34 and can consequently move from a position inside the first container 30 to a position outside the first container 30.

As illustrated in FIG. 30, the second positioning portion 91Y includes a second positioning projection 91*b* that is provided on the bottom wall 91. The second positioning projection 91*b* includes a pair of projection members. The second positioning projection 91*b* comes into contact with the trunk portion 32*b* of the first container 30 in a direction perpendicular to the direction in which the stopper 34 and the first side wall portion 92*a* face each other and can restrict relative movement of the first container 30 with respect to the tray 90. Consequently, the position of the first container 30 in the tray 90 is stabilized, and the liquid L in the first container 30 can be stably preserved.

The tray 90 may have or may not have the oxygen barrier property. Oxygen may or may not permeate the tray 90. The tray 90 is composed of, for example, resin. The tray 90 may be manufactured by injection molding or may be manufactured by drawing a resin plate. The tray 90 may be colorless or colored. The tray 90 may be transparent. When the second container 40 and the tray 90 are transparent, the state of the first container 30 can be checked from a position outside the second container 40. For example, light is emitted from a position outside the second container 40 toward the first container 30, and the amount of oxygen in the first container 30 can be measured by using the oxygen amount measuring device Fibox3. A method of measuring oxygen or pressure by using, for example, a laser can be used.

The oxygen absorber 21 can be provided in the liquid-containing combination container 10L as described above. For example, the second container 40 or the first container 30 may include the deoxygenated film 23. The oxygen absorber 21 may be contained in the tray 90. The deoxygenated member 22 may be contained in the second container 40. As illustrated in FIG. 9A, the deoxygenated member 22 includes the parcel 22*a* that has the oxygen permeability and the oxygen absorber 21 that is contained in the parcel 22*a*.

In an example illustrated by using solid lines in FIG. 27 and FIG. 29, the deoxygenated member 22 is located between the tray 90 and the second container 40. The deoxygenated member 22 is located between the bottom wall 91 of the tray 90 and the second container 40.

Unlike this example, the oxygen absorber 21 and the deoxygenated member 22 may be located between the side wall 92 of the tray 90 and the second container 40. As illustrated by using two-dot chain lines in FIG. 29, the oxygen absorber 21 and the deoxygenated member 22 may be located between the first side wall portion 92*a* and the second container 40. The oxygen absorber 21 and the deoxygenated member 22 may be located between the tray 90 and the first container 30. The oxygen absorber 21 and the deoxygenated member 22 may be located between the bottom wall 91 and the first container 30. The oxygen absorber 21 and the deoxygenated member 22 may be located between the side wall 92 and the first container 30. As illustrated in the two-dot chain lines in FIG. 29, the oxygen absorber 21 and the deoxygenated member 22 may be located between the first side wall portion 92*a* and the first container 30. As illustrated in the two-dot chain lines in FIG. 29, the oxygen absorber 21 and the deoxygenated member 22 may be located between the third side wall portion 92*c* or the fourth side wall portion 92*d* and the first container 30. As illustrated in the two-dot chain lines in FIG. 29, the oxygen absorber 21 and the deoxygenated member 22 may be located between the second container 40 and the first container 30. The deoxygenated member 22 may be attached to or mounted on any one of the first container 30, the second container 40, and the tray 90 or a combination thereof by using a joining material such as adhesive.

The tray 90 may include a recessed portion 95A, a projecting portion 95B, or holes 95C or a combination thereof. The recessed portion, the projecting portion, and the holes can form a flow pass for oxygen. For example, in the example illustrated by using the solid lines in FIG. 27 and FIG. 29, a surface of the flange portion 93 and a surface of the second container 40 can be in contact with each other. In this case, the flange portion 93 and the second container 40 are in contact with each other, and consequently, a region in which the first container 30 is located and a region in which the oxygen absorber 21 is located can be separated from each other. The tray 90 includes the recessed portion 95A, the projecting portion 95B, or the holes 95C or a combination thereof, and consequently, a flow pass for oxygen that is discharged from the first container 30 up to the oxygen absorber 21 can be ensured. In an example illustrated in FIG. 30, the flange portion 93 includes the recessed portion 95A that has a groove shape. The flange portion 93 includes the projecting portion 95B. The recessed portion 95A and the projecting portion 95B can inhibit the second container 40 from being in close contact with the whole area of the flange portion 93. In the example illustrated in FIG. 29, the side wall 92 has the holes 95C. The holes 95C can be used to measure the oxygen concentration by being irradiated with visible light.

Figure 31:
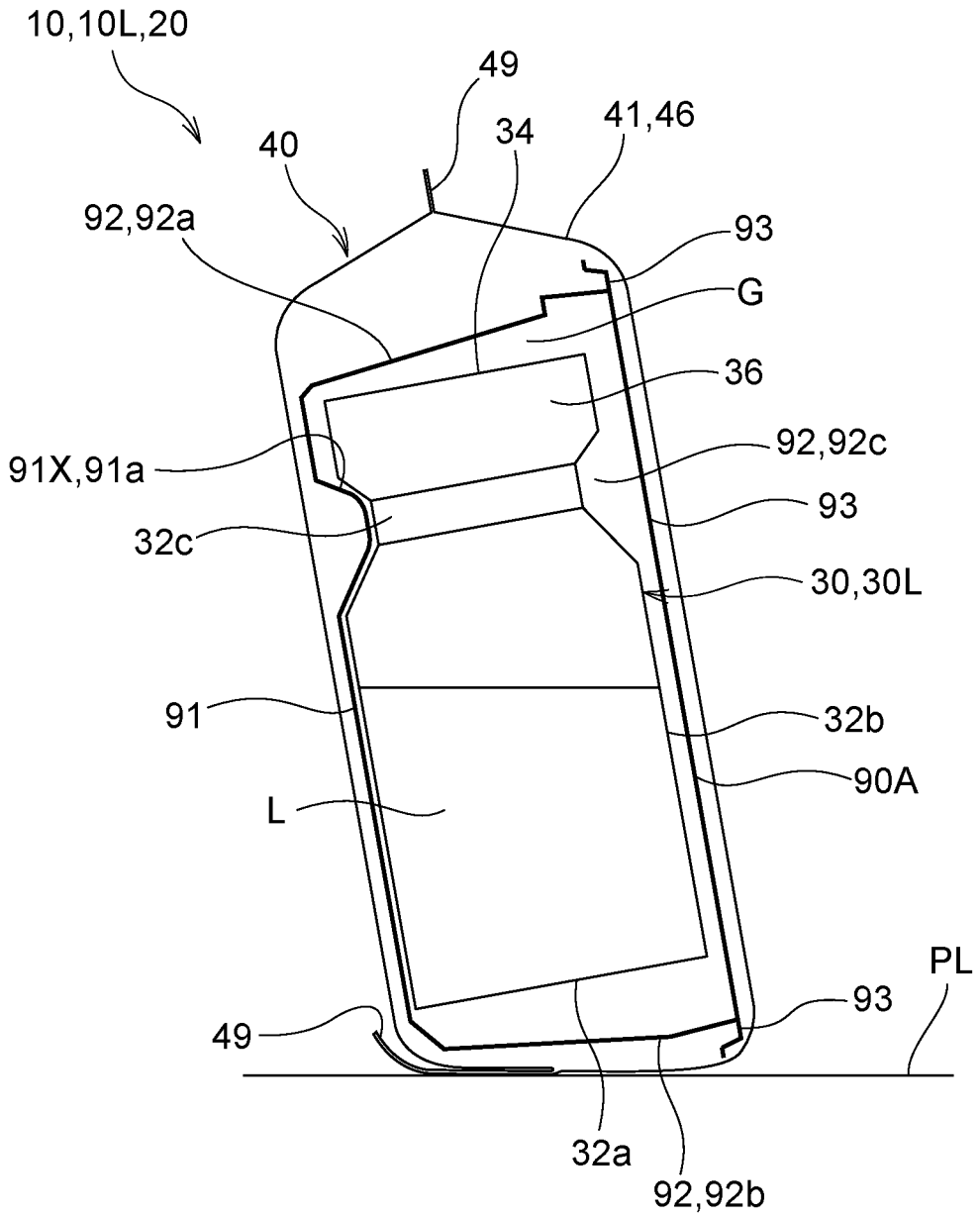
FIG. 31 illustrates an example of a method of manufacturing a liquid-containing container that uses the liquid-containing combination container illustrated in FIG. 27.

As illustrated in FIG. 31, the liquid-containing combination container 10L may be capable of being disposed on a placement surface PL such that the second side wall portion 92*b* faces the placement surface PL with the second container 40 interposed therebetween. In this state, the liquid L in the first container 30 is separated from the stopper 34 that has the oxygen permeability. The stopper 34 is exposed to the headspace HS. This enables the permeation of oxygen through the stopper 34 to be facilitated and enables the oxygen concentration to be reduced in a short time. Accordingly, for example, in a process in which oxygen in the second container 40 is absorbed by using the oxygen absorber 21 after a process of closing the second container 40 that contains the first container 30 is performed, and consequently the oxygen concentration is adjusted, the liquid-containing combination container 10L may be disposed on the placement surface PL in a state illustrated in FIG. 31.

In the illustrated example, the second side wall portion 92*b* inclines with respect to the bottom wall 91 at an angle of larger than 90°. That is, the second side wall portion 92*b* inclines with respect to the direction of a normal to the bottom wall 91 such that the opening portion 90A is wider than the bottom wall 91. Accordingly, in the case where the liquid-containing combination container 10L is disposed on the placement surface PL such that the second side wall portion 92*b* faces the placement surface PL with the second container 40 interposed therebetween, as illustrated in FIG. 31, the bottom wall 91 inclines with respect to the placement surface PL. Along with this, the first container 30 that lies on the bottom wall 91 can be held so as to incline with respect to the vertical direction. Consequently, the area of the surface of the liquid L that is exposed to the headspace HS increases. As a result, movement of oxygen dissolved in the liquid L into the headspace HS is facilitated, and the amount of oxygen in the first container 30 can be reduced in a short time.

In the illustrated example, the first side wall portion 92*a* inclines with respect to the bottom wall 91 at an angle of larger than 90°. That is, the first side wall portion 92*a* inclines with respect to the direction of the normal to the bottom wall 91 such that the opening portion 90A is wider than the bottom wall 91. This enables the gap G between the first side wall portion 92*a* and the stopper 34 to be stably ensured. In addition, oxygen that permeates the stopper 34 is likely to move in the tray 90. Accordingly, the amount of oxygen in the first container 30 can be stably reduced in a short time.

Figure 32:
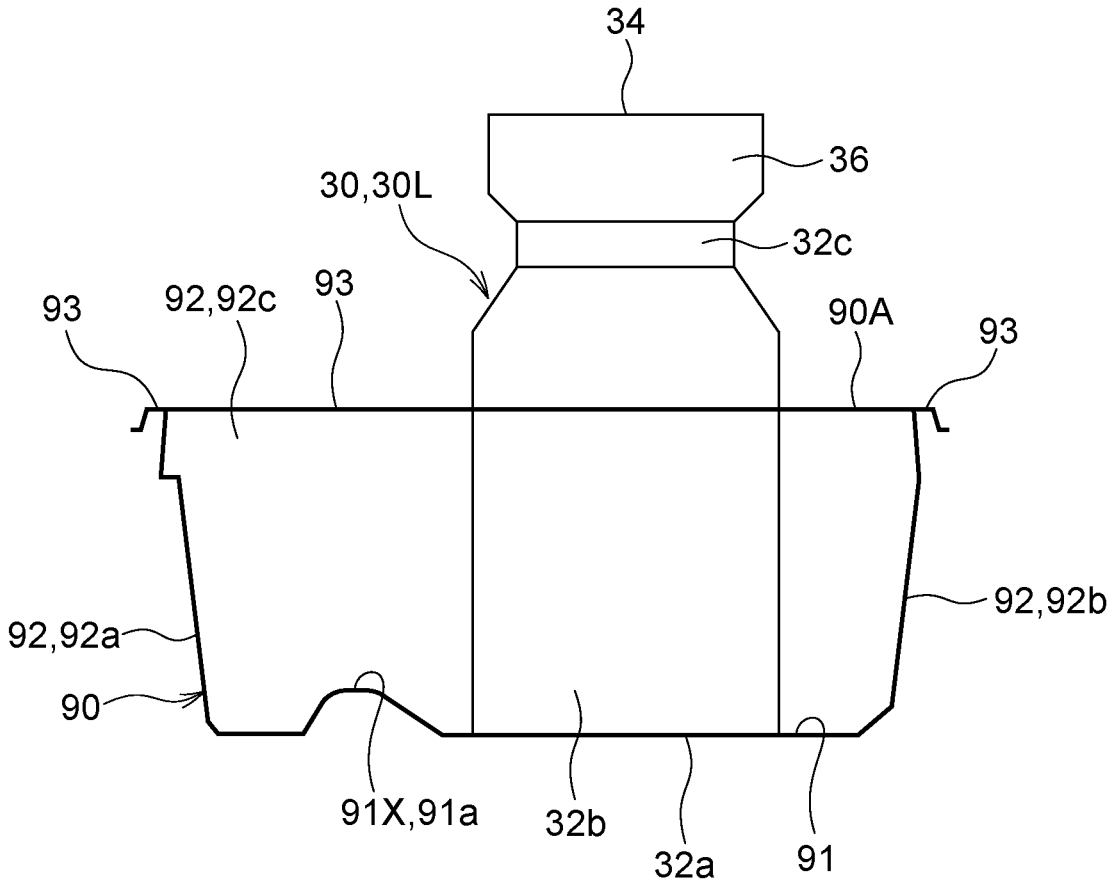
FIG. 32 illustrates an example of a method of using the liquid-containing combination container illustrated in FIG. 27.

As illustrated in FIG. 32, the tray 90 may be used after the second container 40 is opened. In an example illustrated in FIG. 32, the first container 30 can extend upward in the tray 90. In a state illustrated in FIG. 32, the first container 30 can be disposed in the tray 90 such that the bottom portion 32*a* of the container body 32 faces the bottom wall 91 of the tray 90. In this case, the stopper 34 and the opening portion 33 of the container body 32 face in a direction in which these are separated from the bottom wall 91 in the direction of the normal to the bottom wall 91. The liquid L illustrated in FIG. 6 can be taken out from the first container 30 that is disposed in the tray 90. This enables the liquid L to be inhibited from adhering to the placement surface PL and is preferable in hygiene.

Second Specific Example

Figure 33:
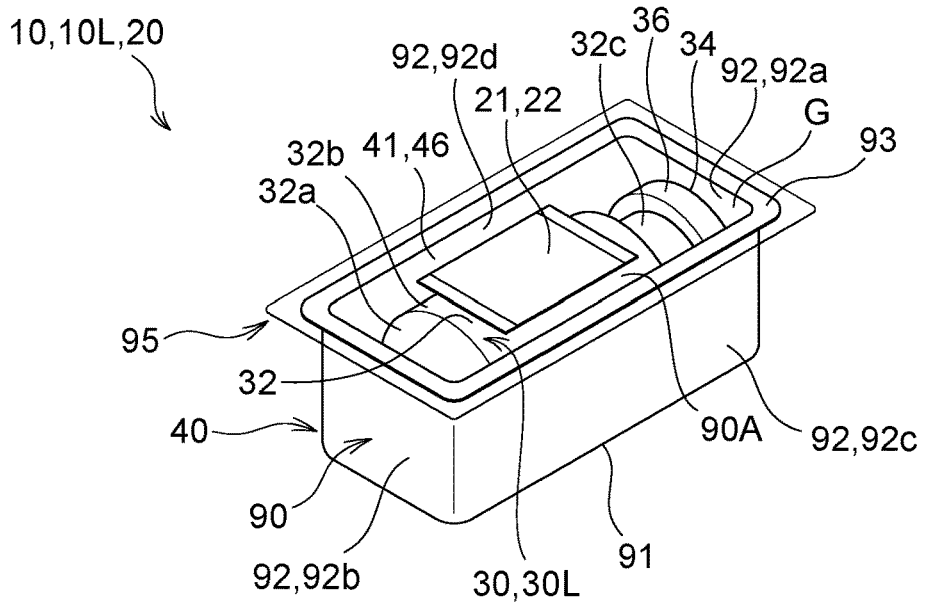
FIG. 33 illustrates a second specific example of the second container and is a perspective view of a liquid-containing combination container.
Figure 34:
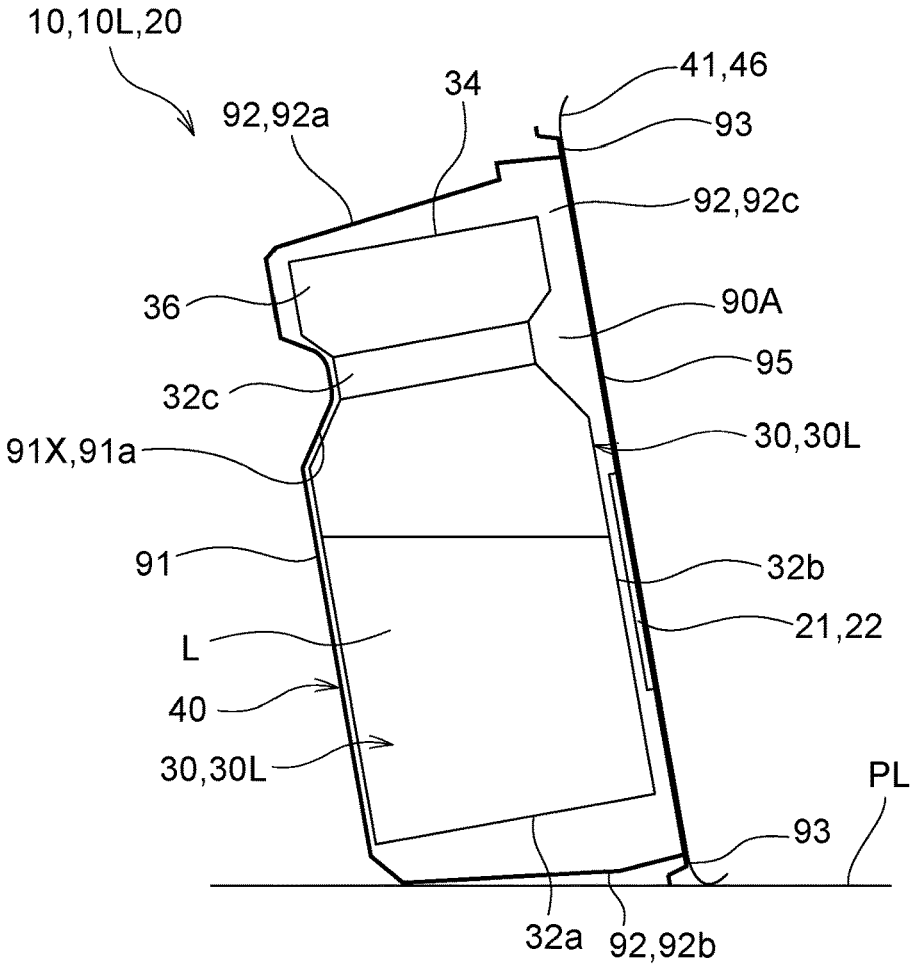
FIG. 34 illustrates an example of a method of manufacturing a liquid-containing container that uses the liquid-containing combination container illustrated in FIG. 33.
Figure 35:
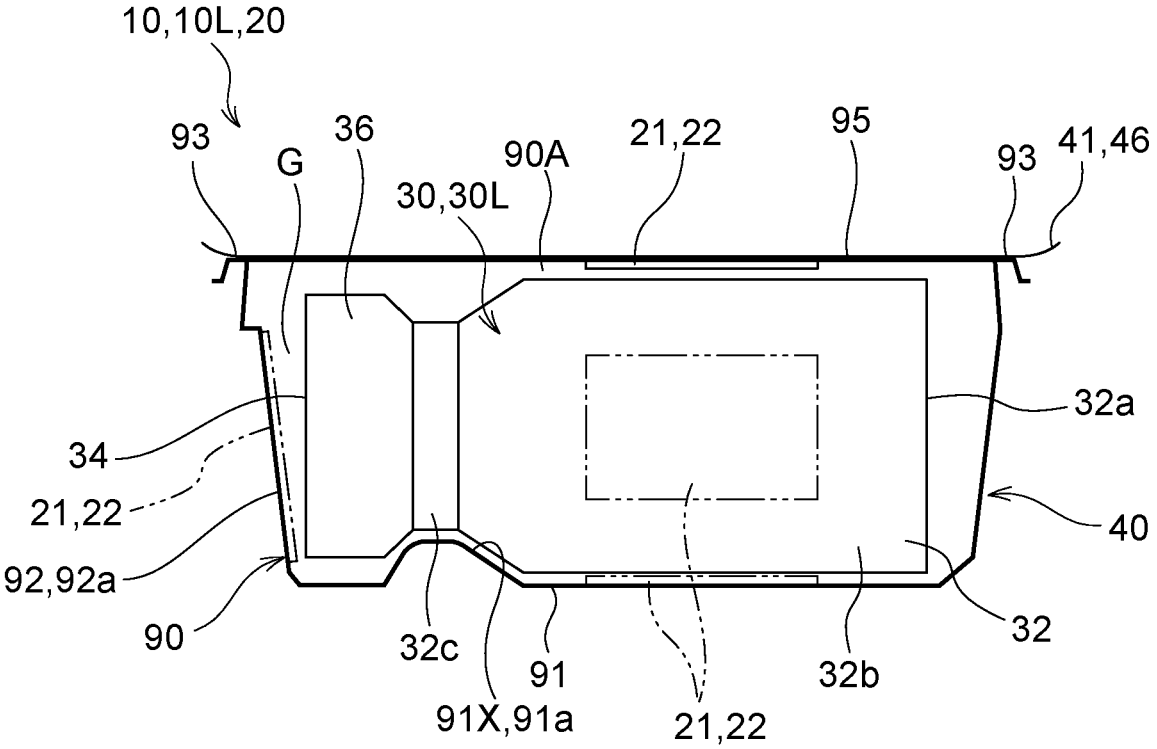
FIG. 35 is a longitudinal sectional view of the liquid-containing combination container illustrated in FIG. 33.

FIG. 33 to FIG. 35 illustrate a second specific example of the second container 40. FIG. 33 is a perspective view of the liquid-containing combination container 10L in the second specific example. FIG. 35 is a longitudinal sectional view of the liquid-containing combination container 10L illustrated in FIG. 33. In the second specific example, the liquid-containing combination container 10L includes the first container 30 and the second container 40. The first container 30 illustrated includes the container body 32 that includes the opening portion 33 and the stopper 34 that closes the opening portion 33. The stopper 34 is permeable to oxygen. The stopper 34 is permeable to oxygen.

The second container 40 has the oxygen barrier property. The second container 40 includes the tray 90 that includes the opening portion 90A and that contains the first container 30 and a lid member 95 that closes the opening portion 90A of the tray 90. The tray 90 that is included in the second container 40 in the second specific example can have the same structure as the tray 90 in the first specific example, provided that the tray 90 has the oxygen barrier property. The lid member 95 has the oxygen barrier property. The lid member 95 is joined to the tray 90. The lid member 95 may be joined, for example, by being welded by using heat sealing or ultrasonic joining or by being joined by using adhesive or glue. In the illustrated example, the lid member 95 is joined to the flange portion 93. The lid member 95 can be composed of one or more of various kinds of materials that have the oxygen barrier property described above. The lid member 95 may be transparent for the same reason as the tray 90. The liquid-containing combination container 10L may include the deoxygenated member 22 that absorbs oxygen in the second container 40. The liquid-containing combination container 10L in the second specific example may include the same outer box as in the first specific example.

As illustrated in FIG. 33 and FIG. 35 the tray 90 includes the bottom wall 91 and the side wall 92. The gap G is formed between the side wall 92 and the stopper 34. This enables the second container 40 that has the oxygen barrier property to be inhibited from covering the stopper 34 that has the oxygen permeability. Accordingly, movement of oxygen in the first container 30 to a position outside the first container 30 due to the permeation of oxygen through the stopper 34 can be facilitated. For example, oxygen in the second container 40 is absorbed by using the oxygen absorber 21, the oxygen concentration (%) in the headspace HS in the first container 30 can be consequently stably reduced, and the amount (mg/L) of dissolved oxygen in the liquid L that is contained in the first container 30 can be stably reduced.

The tray 90 in the second specific example may include the first positioning portion 91X for the same purpose as in the first specific example illustrated in FIG. 30. For example, the tray 90 may have the first positioning projection 91*a*. The tray 90 in the second specific example may include the second positioning portion 91Y for the same purpose as in the first specific example illustrated in FIG. 30. For example, the tray 90 may have the second positioning projection 91*b*.

The liquid-containing combination container 10L can include the oxygen absorber 21. For example, the second container 40 or the first container 30 may include the deoxygenated film 23. The oxygen absorber 21 may be included in the tray 90 or the lid member 95. The deoxygenated member 22 may be contained in the second container 40.

In the example illustrated in FIG. 33 to FIG. 35, the deoxygenated member 22 is located between the lid member 95 and the first container 30. The deoxygenated member 22 may be joined to the lid member 95. Unlike the illustrated example, the oxygen absorber 21 and the deoxygenated member 22 may be located between the tray 90 and the first container 30. As illustrated by using two-dot chain lines in FIG. 35, the oxygen absorber 21 and the deoxygenated member 22 may be located between the bottom wall 91 and the first container 30. The oxygen absorber 21 and the deoxygenated member 22 may be located between the side wall 92 and the first container 30. As illustrated by using the two-dot chain lines in FIG. 35, the oxygen absorber 21 and the deoxygenated member 22 may be located between the first side wall portion 92*a* and the first container 30. As illustrated by using the two-dot chain lines in FIG. 35, the oxygen absorber 21 and the deoxygenated member 22 may be located between the third side wall portion 92*c* or the fourth side wall portion 92*d* and the first container 30.

As illustrated in FIG. 34, the liquid-containing combination container 10L may be capable of being disposed on the placement surface PL such that the second side wall portion 92*b* faces the placement surface PL. In this state, the liquid L in the first container 30 is separated from the stopper 34 that has the oxygen permeability. The stopper 34 is exposed to the headspace HS. This enables the permeation of oxygen through the stopper 34 to be facilitated and enables the oxygen concentration to be reduced in a short time. Accordingly, for example, in a process in which oxygen in the second container 40 is absorbed by using the oxygen absorber 21 after the process of closing the second container 40 that contains the first container 30, and consequently, the oxygen concentration is adjusted, the liquid-containing combination container 10L may be disposed on the placement surface PL in a state illustrated in FIG. 34.

In the illustrated example, the second side wall portion 92*b* inclines with respect to the bottom wall 91 at an angle of larger than 90°. That is, the second side wall portion 92*b* inclines with respect to the direction of the normal to the bottom wall 91 such that the opening portion 90A is wider than the bottom wall 91. Accordingly, in the case where the liquid-containing combination container 10L is disposed on the placement surface PL such that the second side wall portion 92*b* faces the placement surface PL with the second container 40 interposed therebetween, as illustrated in FIG. 34, the bottom wall 91 inclines with respect to the placement surface PL. Along with this, the first container 30 that lies on the bottom wall 91 can be held so as to incline with respect to the vertical direction. Consequently, the area of the surface of the liquid L that is exposed to the headspace HS increases. As a result, movement of oxygen dissolved in the liquid L into the headspace HS can be facilitated, and the amount of oxygen in the first container 30 can be reduced in a short time.

In the illustrated example, the first side wall portion 92*a* inclines with respect to the bottom wall 91 at an angle of larger than 90°. That is, the first side wall portion 92*a* inclines with respect to the direction of the normal to the bottom wall 91 such that the opening portion 90A is wider than the bottom wall 91. This enables the gap G between the first side wall portion 92*a* and the stopper 34 to be stably ensured. In addition, oxygen that permeates the stopper 34 is likely to move in the tray 90. Accordingly, the amount of oxygen in the first container 30 can be stably reduced in a short time.

The tray 90 may be used after the second container 40 is opened as in the first specific example described with reference to FIG. 32. An operation of taking out the liquid L illustrated in FIG. 6 from the first container 30 may be performed on the first container 30 that is disposed in the tray 90.

Third Specific Example

Figure 36:
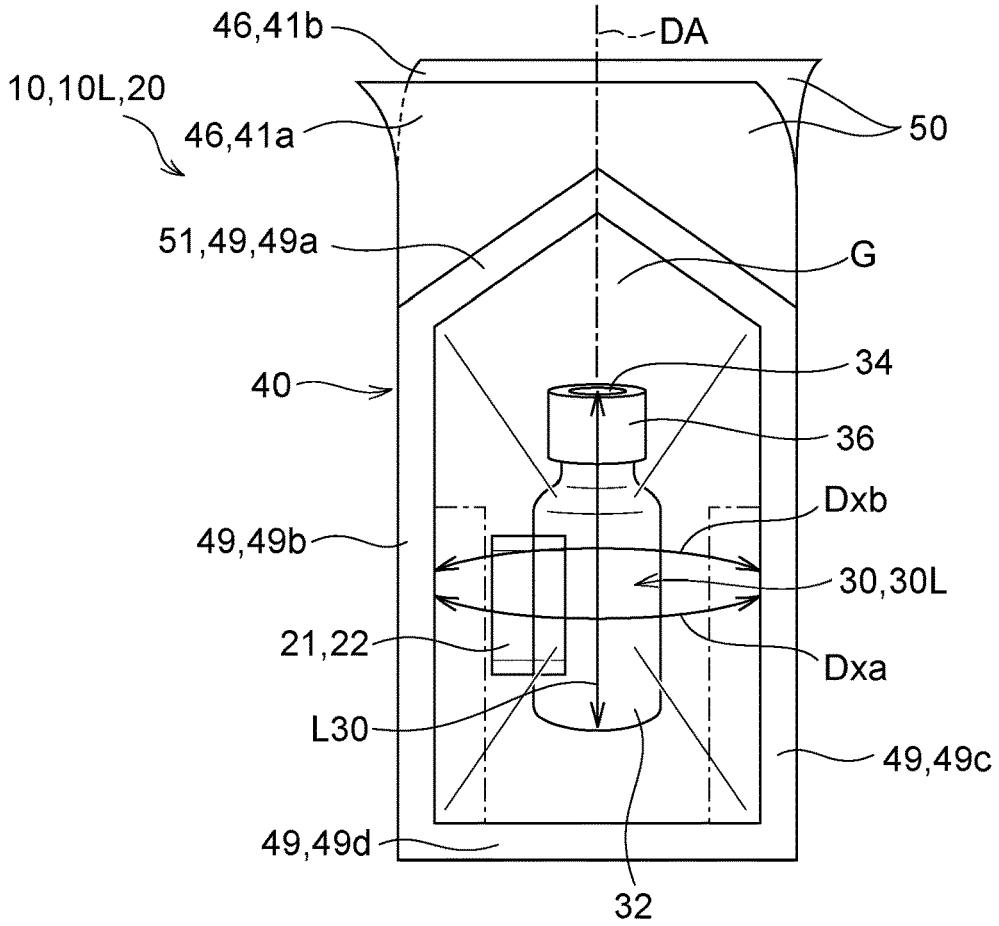
FIG. 36 illustrates a third specific example of the second container and is a perspective view of a liquid-containing combination container.
Figure 37:
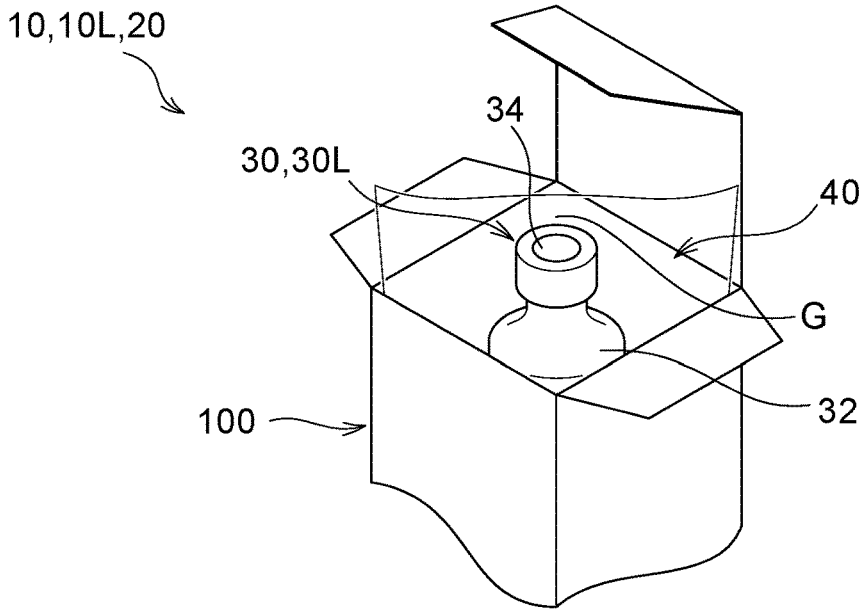
FIG. 37 is a perspective view of the liquid-containing combination container illustrated in FIG. 36.

FIG. 36 and FIG. 37 illustrate a third specific example of the second container 40. FIG. 36 is a perspective view of the liquid-containing combination container 10L in the third specific example. In the third specific example, the liquid-containing combination container 10L includes the first container 30 and the second container 40. The first container 30 illustrated includes the container body 32 that includes the opening portion 33 and the stopper 34 that closes the opening portion 33. The stopper 34 has the oxygen permeability. That is, the stopper 34 is permeable to oxygen.

The second container 40 has the oxygen barrier property. The second container 40 is a film container. A film that is used for the second container 40 is as described above.

The second container includes the first main film (a first film) 41*a* and the second main film (a second film) 41*b*. The first main film 41*a* and the second main film 41*b* face each other. The first main film 41*a* and the second main film 41*b* may be different films or may be a single film that is folded. The first main film 41*a* and the second main film 41*b* are joined to each other at the seal portion 49. Joining at the seal portion 49 may be, for example, welding by using heat sealing or ultrasonic joining or joining by using adhesive or glue. The container space in which the first container 30 is contained is formed between the first main film 41*a* and the second main film 41*b*.

The first main film 41*a* and the second main film 41*b* can be peeled at the seal portion 49. A user applies force for peeling the first main film 41*a* and the second main film 41*b*, and consequently, the first main film 41*a* and the second main film 41*b* are separated from each other at the seal portion 49. Process conditions during joining and the quality and thickness of a joining material, for example, are adjusted, and consequently, the seal portion 49 can be peeled.

The seal portion 49 includes a first seal portion 49*a* that bends. The stopper 34 of the first container 30 that is contained in the second container 40 faces the first seal portion 49*a*. In the illustrated example, the first seal portion 49*a* bends. The first seal portion 49*a* may curve. The first seal portion 49*a* projects toward outside the second container 40. That is, the first seal portion 49*a* projects so as to be separated from the container space of the second container 40. The first seal portion 49*a* projects so as to be separated from the stopper 34 in a direction in which the first seal portion 49*a* and the stopper 34 face each other. The first seal portion 49*a* that bends such that the container space of the second container 40 is widened faces the stopper 34 of the first container 30, and consequently, the gap G is formed between the second container 40 and the stopper 34. This enables the second container 40 that has the oxygen barrier property to be inhibited from covering the stopper 34 that has the oxygen permeability. Accordingly, movement of oxygen in the first container 30 to a position outside the first container 30 due to the permeation of oxygen through the stopper 34 can be facilitated. For example, oxygen in the second container 40 is absorbed by using the oxygen absorber 21, the oxygen concentration (%) in the headspace HS in the first container 30 can be consequently stably reduced, and the amount (mg/L) of dissolved oxygen in the liquid L that is contained in the first container 30 can be stably reduced.

In the illustrated example, the seal portion 49 includes a first side seal portion 49*b* that is connected to an end of the first seal portion 49*a* and a second side seal portion 49*c* that is connected to the other end of the first seal portion 49*a*. The container space in which the first container 30 is contained is formed between the first side seal portion 49*b* and the second side seal portion 49*c*. A minimum distance DXa between the first side seal portion 49*b* and the second side seal portion 49*c* along the first main film 41*a* may be shorter than a length L30 of the first container 30 in a direction DA in which the stopper 34 is inserted into the opening portion 33. A minimum distance DXb between the first side seal portion 49*b* and the second side seal portion 49*c* along the second main film 41*b* may be shorter than the length L30 of the first container 30 in the direction DA in which the stopper 34 is inserted into the opening portion 33.

The minimum distance DXa between the first side seal portion 49*b* and the second side seal portion 49*c* along the first main film 41*a* is equal to the minimum length of the first main film 41*a* between the first side seal portion 49*b* and the second side seal portion 49*c*. The minimum distance DXb between the first side seal portion 49*b* and the second side seal portion 49*c* along the second main film 41*b* is equal to the minimum length of the second main film 41*b* between the first side seal portion 49*b* and the second side seal portion 49*c*. The length L30 of the first container 30 is the length of the first container 30 in the axial direction and is typically the length of the first container 30 in the longitudinal direction.

The minimum distances DXa and DXb between the side seal portions 49*b* and 49*c* along the main films 41*a* and 41*b* are shorter than the length L30 of the first container 30, and consequently, the direction of the first container 30 can be inhibited from greatly changing in the second container 40. Consequently, the stopper 34 of the first container 30 stably faces the first seal portion 49*a*. Accordingly, the gap G between the second container 40 and the stopper 34 can be stably ensured. As a result, the amount of oxygen in the first container 30 can be stably reduced.

As illustrated in FIG. 36, the first main film 41*a* may include an extension film portion 50 that is not joined to the second main film 41*b*. The second main film 41*b* may include an extension film portion 50 that is not joined to the first main film 41*a*. The extension film portions 50 may be adjacent to the seal portion 49. The user holds the extension film portions 50 and can consequently easily apply the force for peeling the first main film 41*a* and the second main film 41*b*. In an example illustrated in FIG. 36, the extension film portions 50 are adjacent to the first seal portion 49*a* that bends. The first and second main films 41*a* and 41*b* of which the extension film portions 50 are composed are the same as those of which portions that form the container space of the second container 40 are composed. The extension film portions 50 and the portions that form the container space of the second container 40 correspond to portions into which the first and second main films 41*a* and 41*b* are divided by the seal portion 49. In this example, the force for peeling concentrates on a position at which the first seal portion 49*a* bends, and the first main film 41*a* and the second main film 41*b* can be smoothly peeled. As for the second container 40, the first seal portion 49*a* corresponds to a to-be-opened portion (opening intention portion) 51. The to-be-opened portion 51 is a portion to be opened when the second container 40 is opened.

In the illustrated example, the seal portion 49 also includes a second seal portion 49*d* that connects the first side seal portion 49*b* and the second side seal portion 49*c*. The first seal portion 49*a*, the first side seal portion 49*b*, the second side seal portion 49*c*, and the second seal portion 49*d* are included in the seal portion 49 that has a surrounding shape and form the container space of the second container 40 that contains the first container 30. The fold portion 41*x* that is formed by folding a single film may be provided instead of the second seal portion 49*d*. As for the second seal portion 49*d*, the bottom surface film 41*e* illustrated in FIG. 7D may be used instead of joining the first main film 41*a* and the second main film 41*b*. The use of the bottom surface film 41*e* may provide the second container 40 as a standing pouch that can stand itself.

At positions on the first side seal portion 49*b* and the second side seal portion 49*c* near the second seal portion 49*d*, the seal strength of the seal portion 49 may be increased. In other words, at the positions on the first side seal portion 49*b* and the second side seal portion 49*c* near the second seal portion 49*d*, the joining strength of the first main film 41*a* and the second main film 41*b* may be increased. In an example, as illustrated by using one-dot chain lines in FIG. 36, the widths of the side seal portions 49*b* and 49*c* may be increased near the second seal portion 49*d*. A processing temperature at which the seal portion 49 is formed may be high at the positions on the side seal portions 49*b* and 49*c* near the second seal portion 49*d*. The number of times of processing when the seal portion 49 is formed may be increased at the positions on the side seal portions 49*b* and 49*c* near the second seal portion 49*d*. In this example, peeling the first main film 41*a* and the second main film 41*b* that is started from the first seal portion 49*a* is easily stopped at any position on the side seal portions 49*b* and 49*c*. This enables the first container 30 to be inhibited from being greatly swung in the second container 40 and enables the first container 30 to be inhibited from falling from the second container 40 unintentionally when the second container 40 is opened.

The liquid-containing combination container 10L may include the oxygen absorber 21. For example, the second container 40 or the first container 30 may include the deoxygenated film 23. The deoxygenated member 22 may be contained in the second container 40. The deoxygenated member 22 may be joined to the second container 40.

As illustrated in FIG. 37, the liquid-containing combination container 10L may include the outer box 100 as in another specific example. In the case where the outer box 100 has a rectangular cuboid shape as illustrated in FIG. 37, the second container 40 that contains the first container 30 may be contained in the outer box 100 such that the first main film 41*a* and the second main film 41*b* extend in the container space of the outer box 100 along a diagonal. In other words, the second container 40 that contains the first container 30 may be contained in the outer box 100 such that the first side seal portion 49*b* and the second side seal portion 49*c* extend along a pair of corner portions that is located on a diagonal in the outer box 100. In this example, the second container 40 that contains the first container 30 can be inhibited from moving in the outer box 100. The liquid L in the first container 30 can be stably preserved. The gap G between the second container 40 that is contained in the outer box 100 and the stopper 34 can be stably maintained, and the flow pass for oxygen from the stopper 34 to the oxygen absorber 21 is ensured. The flow pass can be stably ensured in a manner in which the second container 40 that contains the first container 30 is contained in the outer box 100 such that the side seal portions 49*b* and 49*c* extend along the pair of corner portions in the outer box 100 or in a manner in which the second container 40 is sufficiently longer than the first container 30, and the gap G is ensured.

Fourth Specific Example

Figure 38:
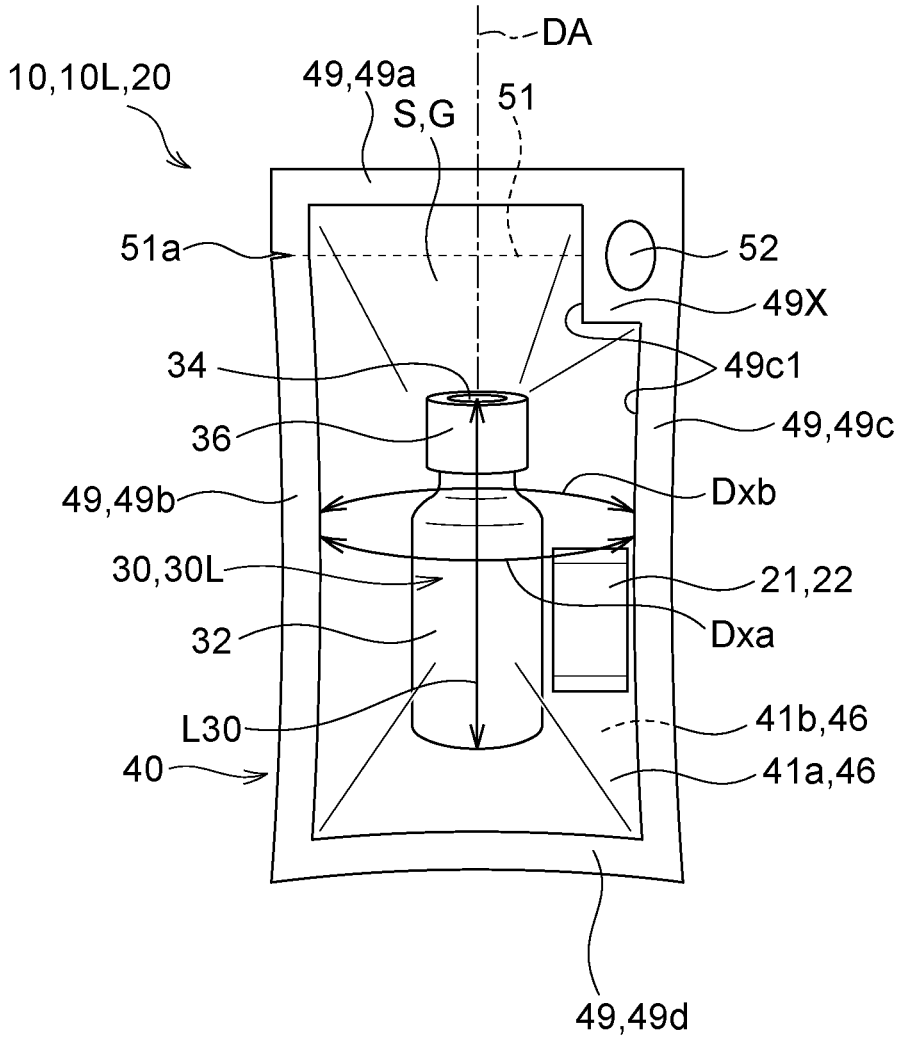
FIG. 38 illustrates of a fourth specific example of the second container and is a perspective view of a liquid-containing combination container.
Figure 39:
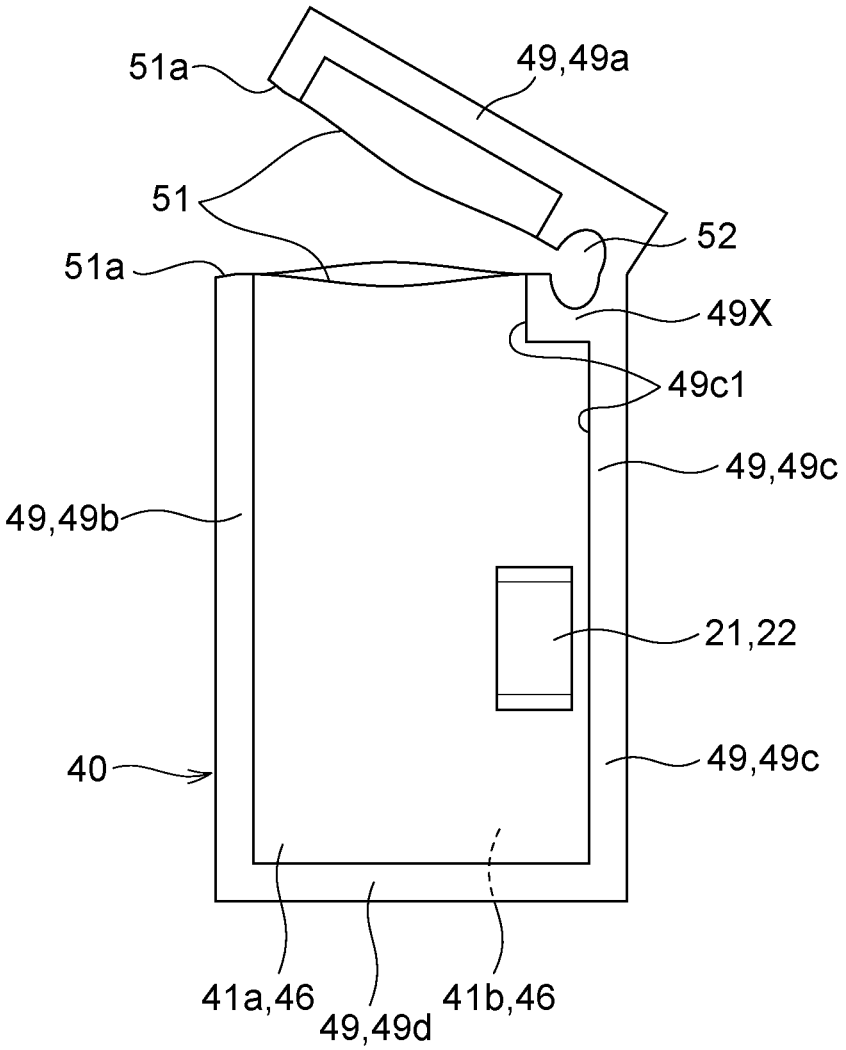
FIG. 39 is a perspective view of the second container illustrated in FIG. 38 that is opened.

FIG. 38 and FIG. 39 illustrate a fourth specific example of the second container 40. FIG. 38 is a perspective view of the liquid-containing combination container 10L in the fourth specific example. FIG. 39 illustrates the second container 40 in FIG. 38 that is opened. In the fourth specific example, the liquid-containing combination container 10L includes the first container 30 and the second container 40. The first container 30 illustrated includes the container body 32 that includes the opening portion 33 and the stopper 34 that closes the opening portion 33. The stopper 34 has the oxygen permeability. That is, the stopper 34 is permeable to oxygen.

The second container 40 has the oxygen barrier property. The second container 40 is a film container. A film that is used for the second container 40 is as described above.

The second container 40 includes the first main film 41*a* and the second main film 41*b*. The first main film 41*a* and the second main film 41*b* face each other. The first main film 41*a* and the second main film 41*b* may be different films or may be a single film that is folded. The first main film 41*a* and the second main film 41*b* are joined to each other at the seal portion 49. Joining at the seal portion 49 may be, for example, welding by using heat sealing or ultrasonic joining or joining by using adhesive or glue. The container space in which the first container 30 is contained is formed between the first main film 41*a* and the second main film 41*b*.

The second container 40 is opened in a manner in which the first main film 41*a* and the second main film 41*b* are cut at the to-be-opened portion (opening intention portion) 51. In other words, the to-be-opened portion 51 is to be cut when the second container 40 is opened. The to-be-opened portion 51 is a linear portion. The to-be-opened portion 51 can be formed due to the materials of the first main film 41*a* and the second main film 41*b* or by processing the first main film 41*a* and the second main film 41*b*. Specifically, the to-be-opened portion 51 can be formed when the materials of the first main film 41*a* and the second main film 41*b* have aeolotropy that is given by a stretching process. The to-be-opened portion 51 can be formed in manner in which the first main film 41*a* and the second main film 41*b* are half cut or processed by using a laser or a film of the intermediate layer is processed by, for example, straight cutting.

The seal portion 49 includes the first side seal portion 49*b* and the second side seal portion 49*c* that are separated in the longitudinal direction of the to-be-opened portion (opening intention portion) 51. The first side seal portion 49*b* and the second side seal portion 49*c* face in the width direction. A through-portion 52 that extends through the first main film 41*a* and the second main film 41*b* is provided at a position at which the second side seal portion 49*c* intersects with the to-be-opened portion 51. The shape of the through-portion 52 in a plan view is not particularly limited. The shape of the through-portion 52 in a plan view may be ellipse as in the illustrated example, circular, polygonal such as triangular or rectangular, or a thin slit shape.

In this example, as illustrated in FIG. 39, cutting the first main film 41*a* and the second main film 41*b* can be stopped at the through-portion 52 when the second container 40 is opened. That is, a cut piece of the second container 40 can be inhibited from being produced when the second container 40 is opened. Accordingly, the ease of handling the combination container 10 that is discarded after use is improved. The present specific example is preferable at a location at which the liquid L that has the high sensitivity such as a food productor a medicine is handled because consideration in hygiene is needed at the location.

As illustrated, the first side seal portion 49*b* may include a notch 51*a* that corresponds to an end of the to-be-opened portion (opening intention portion) 51. The notch 51*a* may be a slit or a cut portion. The notch 51*a* enables the to-be-opened portion 51 to be indicated to the user. The notch 51*a* makes the second container 40 easy to open.

As illustrated, the second side seal portion 49*c* may include a wide portion 49X that has an increased width. The wide portion 49X is wider than a portion of the second side seal portion 49*c* adjacent to the wide portion 49X. The wide portion 49X may be wider than the other portion of the second side seal portion 49*c*. The through-portion 52 may be provided at a position at which the wide portion 49X intersects with the to-be-opened portion (opening intention portion) 51. In this example, the size of the through-portion 52 can be increased. Accordingly, cutting the first main film 41*a* and the second main film 41*b* can be more stably stopped at the through-portion 52 when the second container 40 is opened. Unlike the illustrated example, the width of the second side seal portion 49*c* may be constant.

In the example illustrated in FIG. 38 and FIG. 39, the second side seal portion 49*c* includes an inner edge 49*c*1 that projects such that the inner edge 49*c*1 approaches the first side seal portion 49*b* at the wide portion 49X. In this example, the second side seal portion 49*c* is locally widened toward the first side seal portion 49*b* in the longitudinal direction of the to-be-opened portion (opening intention portion) 51, and consequently, the wide portion 49X is formed. Accordingly, the size of the second container 40 is inhibited from increasing, and the wide portion 49X can be provided.

As illustrated in FIG. 38 and FIG. 39, the stopper 34 of the first container 30 that has the oxygen permeability may face a space S in the second container 40 that is located between the first side seal portion 49*b* and the wide portion 49X of the second side seal portion 49*c*. The stopper 34 of the first container 30 that has the oxygen permeability may be partly located in the space S in the second container 40 that is located between the first side seal portion 49*b* and the wide portion 49X of the second side seal portion 49*c*. In this example, the space S can form the gap G between the second container 40 and the stopper 34. This enables the second container 40 that has the oxygen barrier property to be inhibited from covering the stopper 34 that has the oxygen permeability. Accordingly, movement of oxygen in the first container 30 to a position outside the first container 30 due to the permeation of oxygen through the stopper 34 can be facilitated. For example, oxygen in the second container 40 is absorbed by using the oxygen absorber, the oxygen concentration (%) in the headspace HS in the first container 30 can be consequently stably reduced, and the amount (mg/L) of dissolved oxygen in the liquid L that is contained in the first container 30 can be stably reduced.

The liquid-containing combination container 10L may include the oxygen absorber 21. For example, the second container 40 or the first container 30 may include the deoxygenated film 23. The deoxygenated member 22 may be contained in the second container 40. The deoxygenated member 22 may be joined to the second container 40.

As illustrated in FIG. 38 and FIG. 39, the oxygen absorber 21 and the deoxygenated member 22 may be held by the second container 40 at a position away from the wide portion 49X in a direction in which the space S in the second container 40 and the stopper face each other. In the illustrated example, the deoxygenated member 22 may be joined to the second container 40. In this example, the deoxygenated member 22 enables the first container 30 in the second container 40 to be inhibited from moving in the longitudinal direction (the width direction) of the to-be-opened portion (opening intention portion) 51. That is, the deoxygenated member 22 maintains the stopper 34 facing the space S and can facilitate a reduction in the amount of oxygen in the first container 30.

In the illustrated example, the seal portion 49 includes the first seal portion 49*a* that connects the first side seal portion 49*b* and the second side seal portion 49*c* and the second seal portion 49*d* that connects the first side seal portion 49*b* and the second side seal portion 49*c*. The first seal portion 49*a*, the first side seal portion 49*b*, the second side seal portion 49*c*, and the second seal portion 49*d* form the seal portion 49 that has a surrounding shape and form the container space of the second container 40 that contains the first container 30 The fold portion 41*x* that is formed by folding a single film may be provided instead of the first seal portion 49*a* or the second seal portion 49*d*. As for the second seal portion 49*d*, the bottom surface film 41*e* illustrated in FIG. 7D may be used instead of joining the first main film 41*a* and the second main film 41*b*. The use of the bottom surface film 41*e* may provide the second container 40 as a standing pouch that can stand itself.

Also in the fourth specific example, the minimum distances DXa and DXb between the side seal portions 49*b* and 49*c* along the main films 41*a* and 41*b* may be shorter than the length L30 of the first container 30 as in the third specific example. With this structure, the direction of the first container 30 can be inhibited from greatly changing in the second container 40. Consequently, the stopper 34 of the first container 30 stably faces the first seal portion 49*a*. Accordingly, the gap G between the second container 40 and the stopper 34 can be stably ensured. As a result, the amount of oxygen in the first container 30 can be stably reduced.

The liquid-containing combination container 10L may include the outer box 100 as in another specific example. A method of containing the second container 40 that contains the first container 30 in the outer box 100 may be the same as in the third specific example described with reference to FIG. 37.

Fifth Specific Example

Figure 40:
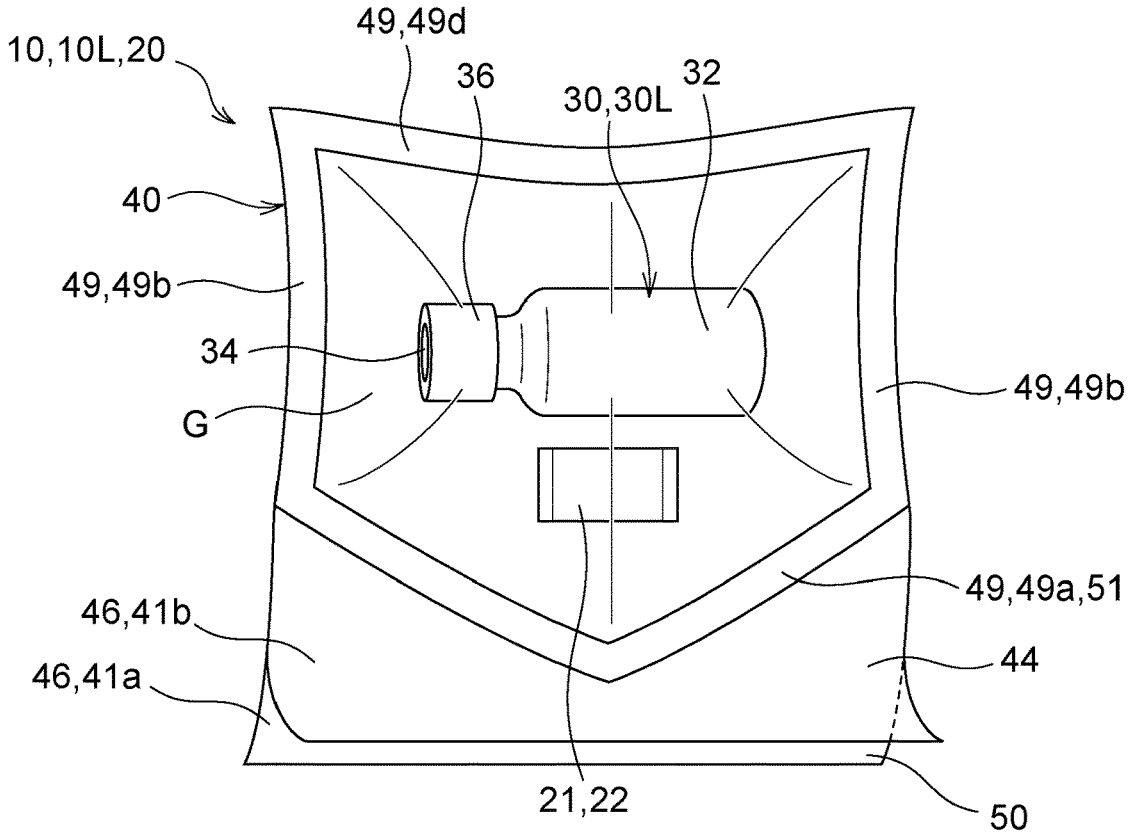
FIG. 40 illustrates a fifth specific example of the second container and is a perspective view of a liquid-containing combination container.
Figure 41:
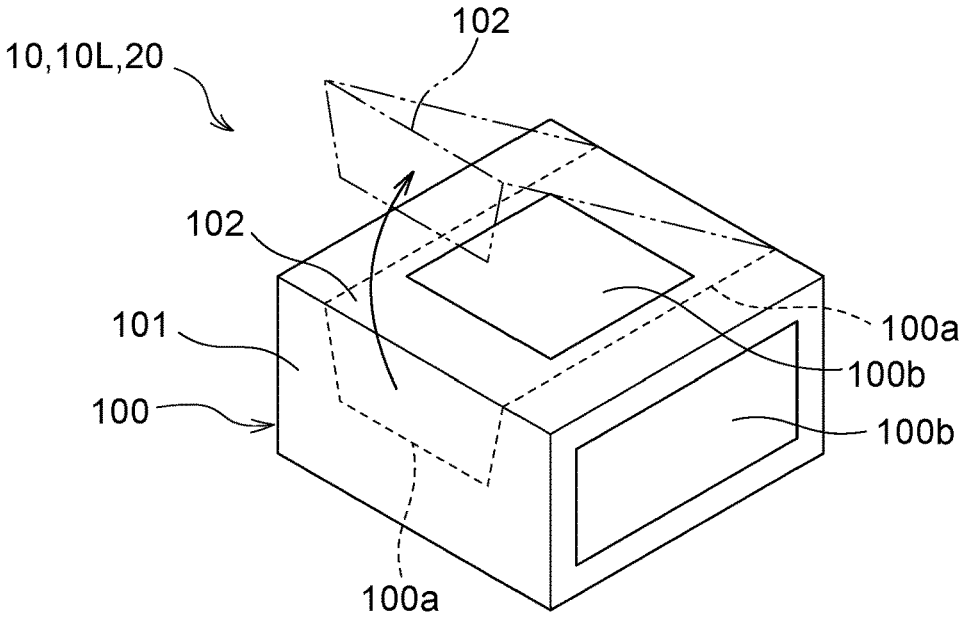
FIG. 41 is a perspective view of an outer box that can be included in the liquid-containing combination container illustrated in FIG. 40.

FIG. 40 to FIG. 43 illustrate a fifth specific example of the second container 40. FIG. 41 is a perspective view of the outer box 100 of the liquid-containing combination container 10L in the fifth specific example. FIG. 40 illustrates the second container 40 that contains the first container 30 that is contained in the outer box 100 in FIG. 41. In the fifth specific example, the liquid-containing combination container 10L includes the first container 30, the second container 40, and the outer box 100. The first container 30 illustrated includes the container body 32 that includes the opening portion 33 and the stopper 34 that closes the opening portion 33. The stopper 34 has the oxygen permeability. That is, the stopper 34 is permeable to oxygen.

The second container 40 has the oxygen barrier property. The second container 40 is a film container. A film that is used for the second container 40 is as described above.

As illustrated in FIG. 40, the second container may include the first main film 41*a* and the second main film 41*b*. The first main film 41*a* and the second main film 41*b* face each other. The first main film 41*a* and the second main film 41*b* may be different films or may be a single film that is folded. The first main film 41*a* and the second main film 41*b* are joined to each other at the seal portion 49. Joining at the seal portion 49 may be, for example, welding by using heat sealing or ultrasonic joining or joining by using adhesive or glue. The container space in which the first container 30 is contained is formed between the first main film 41*a* and the second main film 41*b*.

The first main film 41*a* and the second main film 41*b* can be peeled at the seal portion 49. The user applies the force for peeling the first main film 41*a* and the second main film 41*b*, and consequently, the first main film 41*a* and the second main film 41*b* are separated from each other at the seal portion 49. Process conditions during joining and the quality and thickness of a joining material, for example, are adjusted, and consequently, the seal portion 49 can be peeled.

As illustrated in FIG. 41, the outer box 100 includes an outer box body 101 and a lid portion 102 that can move relatively to the outer box body 101. The lid portion 102 and the outer box body 101 relatively move, and consequently, the outer box 100 can be opened. In the illustrated example, the outer box 100 can be composed of paper. The lid portion 102 can swing with respect to the outer box body 101. The lid portion 102 may be integrally formed with the outer box body 101. In the illustrated example, the outer box 100 includes a to-be-cut portion 100*a* that has holes linearly arranged as in a dashed line or that is formed by, for example, half cut. The outer box body 101 is separated from the lid portion 102 at the to-be-cut portion 100*a*, and consequently, the lid portion 102 can swing with respect to the outer box body 101. As illustrated by using two-dot chain lines in FIG. 41, the lid portion 102 swings with respect to the outer box body 101, and consequently, the outer box 100 is opened.

Figure 42:
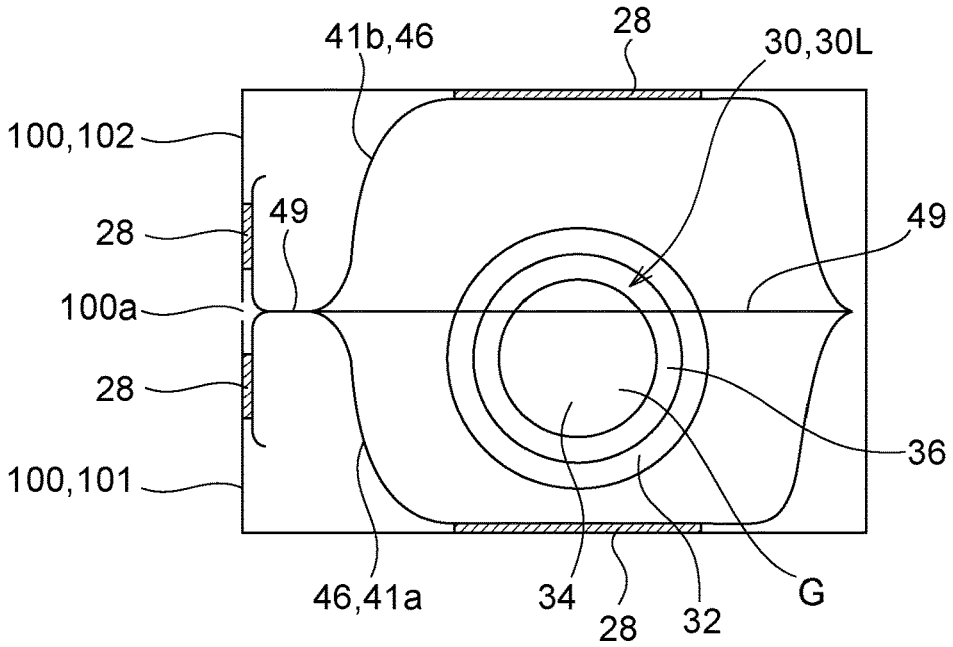
FIG. 42 is a longitudinal sectional view of the liquid-containing combination container illustrated in FIG. 40 with the outer box closed.
Figure 43:
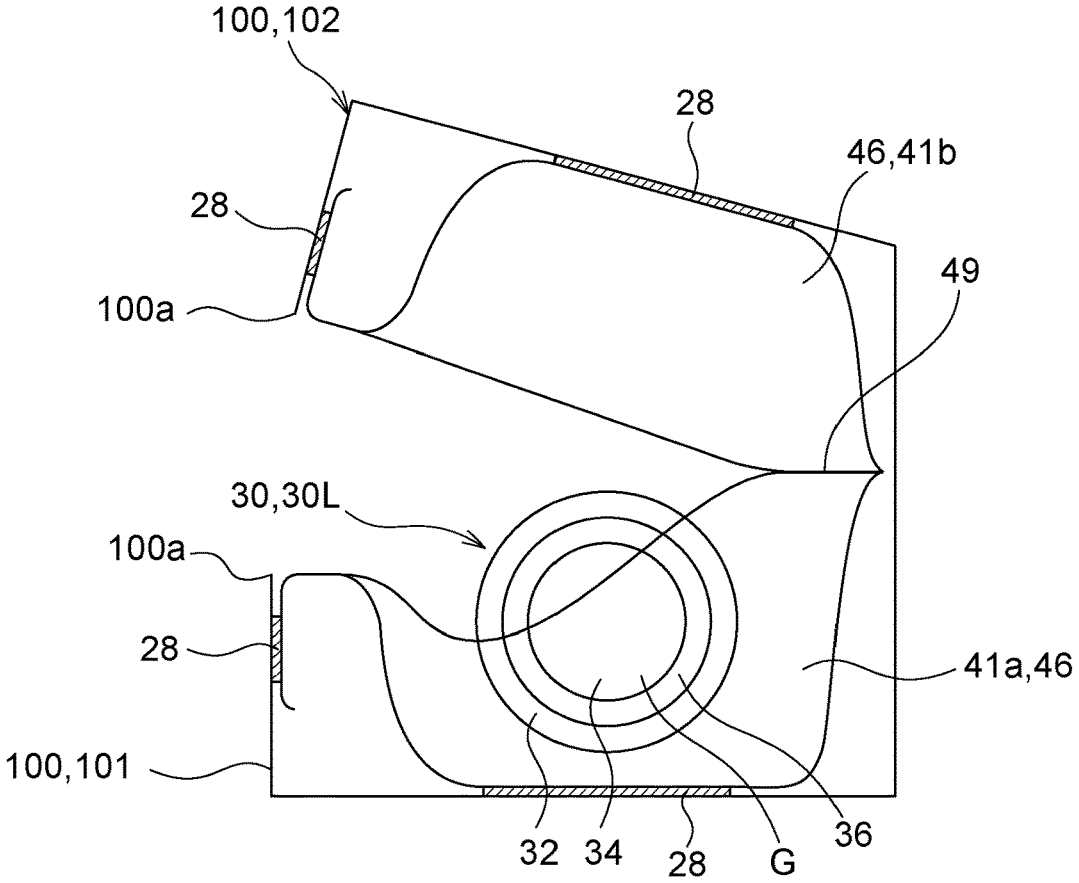
FIG. 43 is a longitudinal sectional view of the liquid-containing combination container illustrated in FIG. 40 with the outer box opened.

As illustrated in FIG. 42 and FIG. 43, the first main film 41*a* is attached to (mounted on) the outer box body 101, and the second main film 41*b* is attached to (mounted on) the lid portion 102. When the lid portion 102 is moved relatively to the outer box body 101, the second main film 41*b* is separated from the first main film 41*a*. As a result, when the lid portion 102 is moved relatively to the outer box body 101, and the outer box 100 is opened, the second main film 41*b* is peeled from the first main film 41*a* at the seal portion 49, and consequently, the second container 40 is opened. With this structure, the first container 30 is easily taken out from the liquid-containing combination container 10L that includes the outer box 100.

Since the first main film 41*a* and the second main film 41*b* are attached to the outer box 100, the second container 40 that has the oxygen barrier property can inhibited from covering the stopper 34 that has the oxygen permeability. That is, the gap G can be formed between the second container 40 and the stopper 34. Accordingly, movement of oxygen in the first container 30 to a position outside the first container 30 due to the permeation of oxygen through the stopper 34 can be facilitated. For example, oxygen in the second container 40 is absorbed by using the oxygen absorber, the oxygen concentration (%) in the headspace HS in the first container 30 can be consequently stably reduced and the amount (mg/L) of dissolved oxygen in the liquid L that is contained in the first container 30 can be stably reduced.

FIG. 40 illustrates an example of the second container 40. The seal portion 49 includes the first seal portion 49*a* that bends. In the illustrated example, the first seal portion 49*a* bends. The first seal portion 49*a* may curve. The first seal portion 49*a* projects so as to be separated from the first container 30. That is, the first seal portion 49*a* projects such that the container space of the second container 40 is widened. The seal portion 49 illustrated also includes the first side seal portion 49*b*, the second side seal portion 49*c*, and the second seal portion 49*d*. The first side seal portion 49*b* is connected to an end of the first seal portion 49*a* and an end of the second seal portion 49*d*. The second side seal portion 49*c* is connected to the other end of the first seal portion 49*a* and the other end of the second seal portion 49*d*. The second seal portion 49*d* faces the first seal portion 49*a*. The first seal portion 49*a*, the first side seal portion 49*b*, the second side seal portion 49*c*, and the second seal portion 49*d* form the seal portion 49 that has a surrounding shape and form the container space of the second container 40 that contains the first container 30. The fold portion 41*x* that is formed by folding a single film may be provided instead of the second seal portion 49*d*. As for the second seal portion 49*d*, the bottom surface film 41*e* illustrated in FIG. 7D may be used instead of joining the first main film 41*a* and the second main film 41*b*.

As illustrated in FIG. 40, the first main film 41*a* may include the extension film portion 50 that is not joined to the second main film 41*b*. The second main film 41*b* may include the extension film portion 50 that is not joined to the first main film 41*a*. The extension film portions 50 may be adjacent to the seal portion 49. As illustrated in FIG. 42 and FIG. 43, the seal portion 49 of the first main film 41*a* is joined to the lid portion 102 by using a joining material 28 such as adhesive or glue. The lid portion 102 is swung with respect to the outer box body 101, and consequently, the two extension film portions 50 are separated from each other. This enables the force for peeling to be automatically applied to the first main film 41*a* and the second main film 41*b* along with the operation of opening the lid portion 102. In an example illustrated in FIG. 40, the extension film portions 50 are adjacent to the first seal portion 49*a* that bends. In this example, the force for peeling concentrates on the position at which the first seal portion 49*a* bends, and the first main film 41*a* and the second main film 41*b* can be smoothly peeled.

As illustrated in FIG. 42 and FIG. 43, a portion of the first main film 41*a* that forms the container space, that is, a portion of the first main film 41*a* that faces the first container 30 is also joined to the outer box 100 with a joining material 28 interposed therebetween. Similarly, a portion of the second main film 41*b* that forms the container space, that is, a portion of the second main film 41*b* that faces the first container 30 is also joined to the outer box 100 by using a joining material 28. With this structure, the first main film 41*a* and the second main film 41*b* can be smoothly peeled.

The gap G can be stably ensured between the stopper 34 of the first container 30 and the second container 40, and consequently, the amount of oxygen can be rapidly reduced.

As illustrated in FIG. 41, the outer box 100 may include a transparent portion 100*b* that is transparent. The states of the first container 30 and the second container 40 that are contained in the outer box 100 can be checked through the transparent portion 100*b*. The transparent portion 100*b* and the second container 40 that is transparent enable the amount of oxygen in the first container 30 to be measured, for example, in a manner in which visible light is emitted from a position outside the outer box 100 toward the first container 30 by using the oxygen amount measuring device Fibox3.

The liquid-containing combination container 10L may include the oxygen absorber 21. For example, the second container 40 or the first container 30 may include the deoxygenated film 23. The deoxygenated member 22 may be contained in the second container 40. The deoxygenated member 22 may be joined to the second container 40.

Sixth Specific Example

Figure 44:
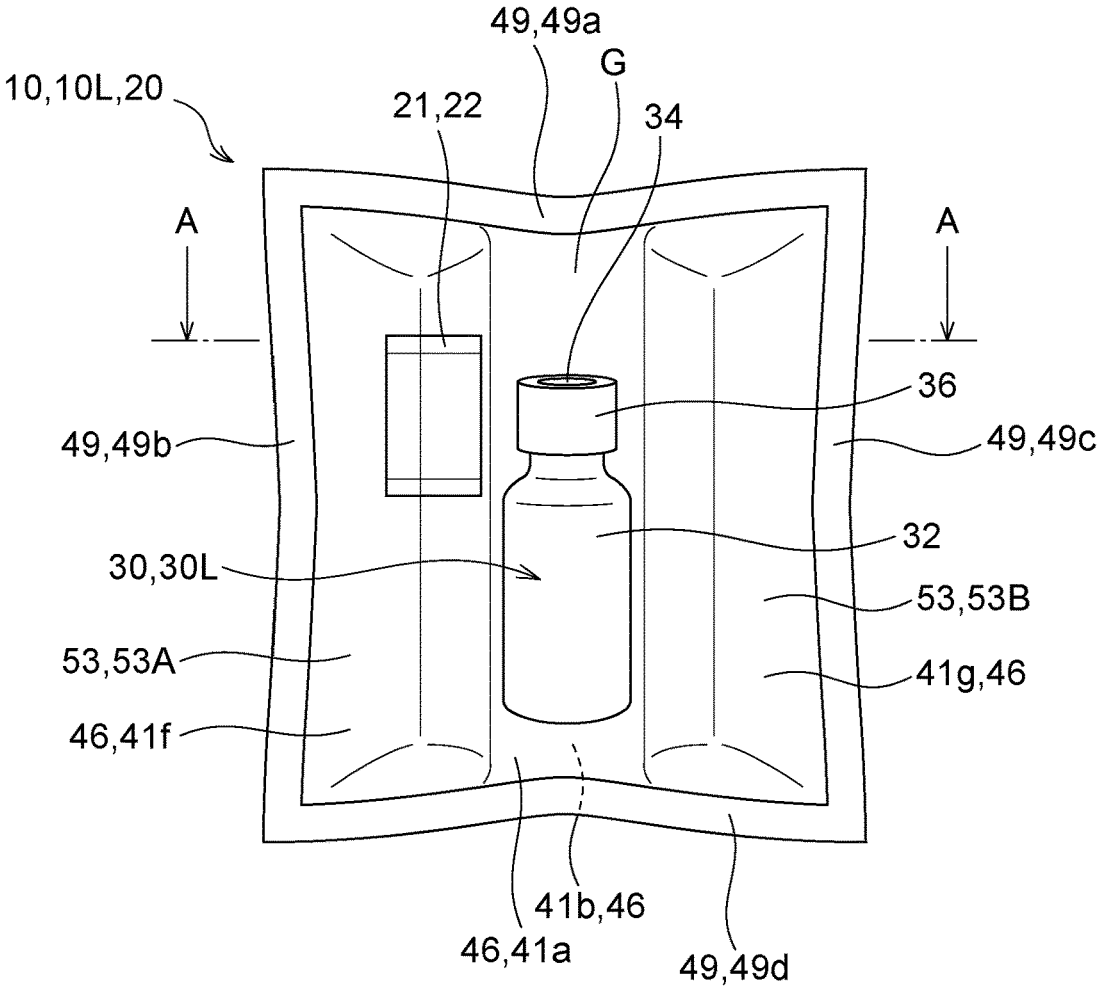
FIG. 44 illustrates a sixth specific example of the second container and is a perspective view of a liquid-containing combination container.
Figure 45:
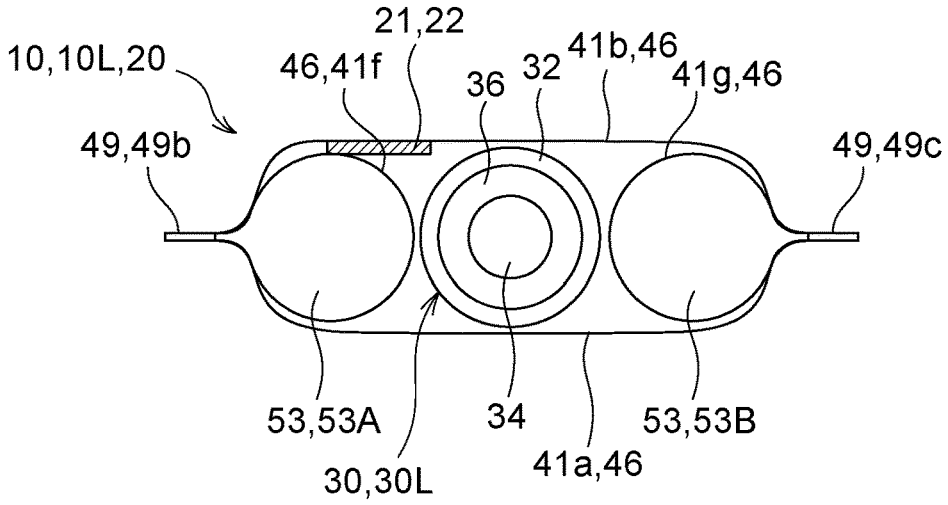
FIG. 45 is a sectional view taken along line A-A in FIG. 44.
Figure 46:
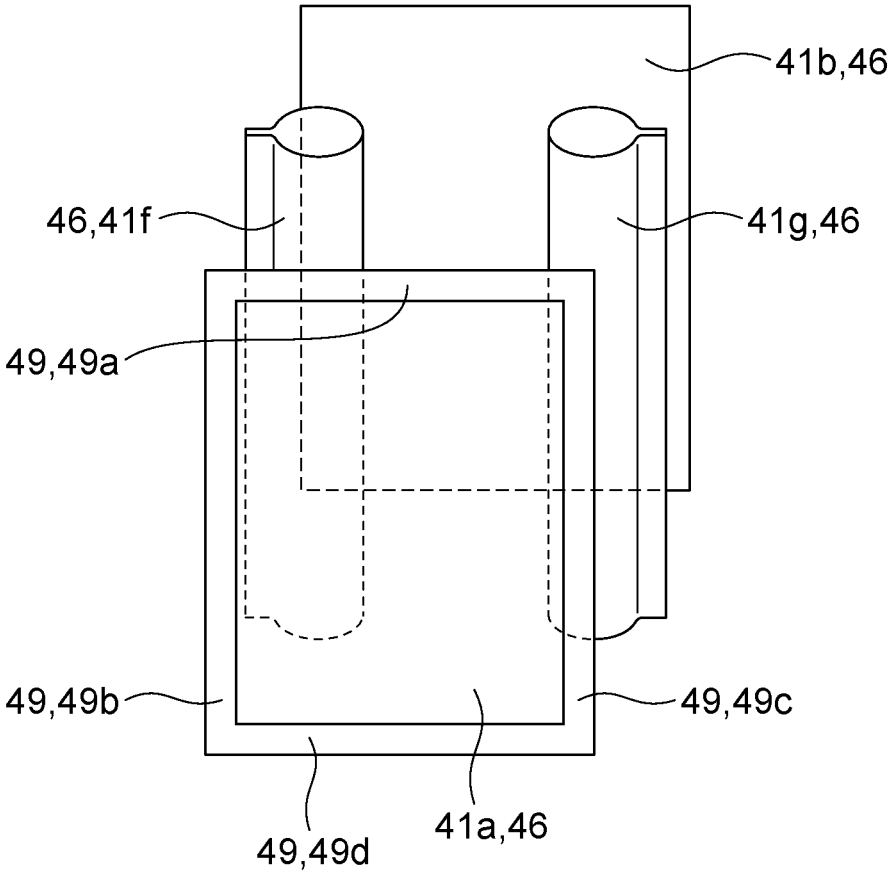
FIG. 46 illustrates a method of manufacturing the liquid-containing combination container illustrated in FIG. 44.

FIG. 44 to FIG. 46 illustrate a sixth specific example of the second container 40. FIG. 44 is a perspective view of the liquid-containing combination container 10L in the sixth specific example. FIG. 45 illustrates the liquid-containing combination container 10L taken along line A-A in FIG. 44. FIG. 46 illustrates a method of manufacturing the liquid-containing combination container 10L illustrated in FIG. 44. The first container 30 illustrated includes the container body 32 that includes the opening portion 33 and the stopper 34 that closes the opening portion 33. The stopper 34 has the oxygen permeability. That is, the stopper 34 is permeable to oxygen.

The second container 40 has the oxygen barrier property. The second container 40 is a film container. A film that is used for the second container 40 is as described above.

The second container 40 includes the first main film 41*a* and the second main film 41*b*. The first main film 41*a* and the second main film 41*b* face each other. The first main film 41*a* and the second main film 41*b* may be different films or may be a single film that is folded. The first main film 41*a* and the second main film 41*b* are joined to each other at the seal portion 49. Joining at the seal portion 49 may be, for example, welding by using heat sealing or ultrasonic joining or joining by using adhesive or glue. The container space in which the first container 30 is contained is formed between the first main film 41*a* and the second main film 41*b*.

As illustrated in FIG. 44 and FIG. 45, the second container 40 includes a gas bag 53 that is provided between the first main film 41*a* and the second main film 41*b*. The gas bag 53 contains gas. The gas bag 53 is composed of, for example, a resin film. The gas bag 53 may not have the oxygen barrier property, provided that the gas bag 53 does not form an outer surface of the second container 40. The gas bag 53 may have the oxygen barrier property. The gas that is sealed in the gas bag 53 is not particularly limited. The gas that is sealed in the gas bag 53 may be inert gas.

The gas bag 53 is provided in the container space of the second container 40 that is formed between the first main film 41*a* and the second main film 41*b*, the gas bag 53 consequently functions as a buffer material, and the first container 30 can be stably contained in the second container 40. This enables the first container 30 to be inhibited from being damaged and enables the first container 30 to be inhibited from vibrating and from being impacted. Accordingly, the liquid L in the first container 30 can be stably preserved.

In addition, the use of the gas bag 53 enables the first container 30 that is disposed in the second container 40 to be stable. In addition, a distance between the main films 41*a* and 41*b* that are paired can be increased. This enables the second container 40 that has the oxygen barrier property to be inhibited from covering the stopper 34 that has the oxygen permeability. That is, the gap G between the second container 40 and the stopper 34 can be formed. Accordingly, movement of oxygen in the first container 30 to a position outside the first container 30 due to the permeation of oxygen through the stopper 34 can be facilitated. For example, oxygen in the second container 40 is absorbed by using the oxygen absorber, the oxygen concentration (%) in the headspace HS in the first container 30 can be consequently stably reduced, and the amount (mg/L) of dissolved oxygen in the liquid L that is contained in the first container 30 can be stably reduced.

The gas bag 53 may be joined to the first main film 41*a* and the second main film 41*b*. For example, joining may be welding by using heat sealing or ultrasonic joining or joining by using adhesive or glue. The gas bag 53 is joined to the first main film 41*a* and the second main film 41*b*, and consequently, the position of the gas bag 53 is stabilized. This enables the first container 30 that is disposed in the second container 40 to be stable. This enables the liquid L in the first container 30 to be stably preserved.

The gas bag 53 may be joined to the main films 41*a* and 41*b* at the seal portion 49 at which the first main film 41*a* and the second main film 41*b* are joined. In this example, the gas bag 53 can be joined to the main films 41*a* and 41*b* when the second container 40 is manufactured.

As illustrated in FIG. 44, the seal portion 49 may include the first side seal portion 49*b* and the second side seal portion 49*c*. The first side seal portion 49*b* and the second side seal portion 49*c* face each other. The first side seal portion 49*b* and the second side seal portion 49*c* are separated in the width direction. FIG. 45 illustrates a section of the liquid-containing combination container 10L in the width direction. The second container 40 includes a first gas bag 53A that is joined to the main films 41*a* and 41*b* at the first side seal portion 49*b* and a second gas bag 53B that is joined to the main films 41*a* and 41*b* at the second side seal portion 49*c*. At the container space of the second container 40, the first container 30 is located between the first gas bag 53A and the second gas bag 53B. With this structure, the first container 30 can be stably preserved. The gap G can be more stably ensured.

In the illustrated example, the seal portion 49 includes the first seal portion 49*a* that connects the first side seal portion 49*b* and the second side seal portion 49*c* and the second seal portion 49*d* that connects the first side seal portion 49*b* and the second side seal portion 49*c*. The first seal portion 49*a*, the first side seal portion 49*b*, the second side seal portion 49*c*, and the second seal portion 49*d* form the seal portion 49 of a surrounding shape and form the container space of the second container 40 that contains the first container 30.

As illustrated in FIG. 46, the second container 40 can include the first main film 41*a*, the second main film 41*b*, a first bag film 41*f*, and a second bag film 41*g*. As illustrated in FIG. 46, the first bag film 41*f* is a single folded film that is disposed between the main films 41*a* and 41*b* that are paired. Both side edges of the first bag film 41*f* that is folded are joined to first side edges of the main films 41*a* and 41*b* that are paired and form the first side seal portion 49*b*. An upper edge of the first bag film 41*f* that is folded is joined to upper edge portions of the main films 41*a* and 41*b* that are paired and forms a portion of the first seal portion 49*a*. A lower edge of the first bag film 41*f* that is folded is joined to lower edge portions of the main films 41*a* and 41*b* that are paired and forms a portion of the second seal portion 49*d*. The first bag film 41*f* that is folded in this way is sealed in three directions. When the first bag film 41*f* is sealed, gas is supplied to a folded region of the first bag film 41*f*, and the first gas bag 53A is obtained. The second bag film 41*g* is symmetrical to the first bag film 41*f*, and the symmetric structure of the first bag film 41*f* forms the second gas bag 53B. The first bag film 41*f* and the second bag film 41*g* may be films that are used for the second container 40 described above such as films that are used as the main films 41*a* and 41*b*.

The liquid-containing combination container 10L may include the oxygen absorber 21. For example, the second container 40 or the first container 30 may include the deoxygenated film 23. The deoxygenated member 22 may be contained in the second container 40. The deoxygenated member 22 may be joined to the second container 40.

As illustrated in FIG. 44 and FIG. 45, the oxygen absorber 21 and the deoxygenated member 22 may be held between the first main film 41*a* or the second main film 41*b* and the gas bag 53. In the illustrated example, the deoxygenated member 22 is interposed between the first gas bag 53A and the second main film 41*b*. The deoxygenated member 22 is held by the second container 40 without using a joining material such as adhesive, and accordingly, waste can be easily separated when the liquid-containing combination container 10L is discarded.

The liquid-containing combination container 10L may include the outer box 100 as in another specific example. The seal portion 49 of the second container 40 may has a notch (not illustrated). The notch enables the second container to be easily opened.

The embodiment is described above with reference to the specific examples. The specific examples described above do not limit the embodiment. According to the embodiment described above, various specific examples can be provided, various omissions, replacements, modifications, and additions, for example, can be made without departing from the spirit thereof.

Examples of the modifications will now be described with reference to the drawings. In the description below and the figures used for the description below, a portion that can have the same structure as in the specific examples described above is designated by using a reference sign like to that used for a portion that corresponds to one in the specific examples described above, and a duplicated description is omitted.

Figure 10:
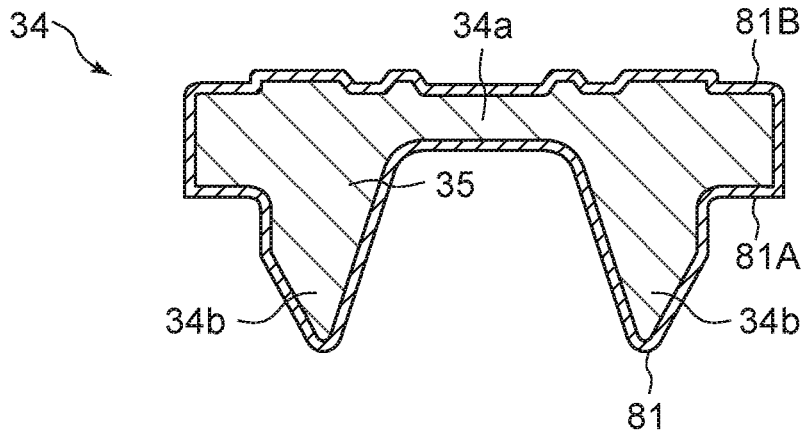
FIG. 10 is a longitudinal sectional view of a modification to the stopper.

In the specific examples described above, a specific structure of the stopper 34 that has the oxygen permeability is described but is not limited to that in the examples described above. For example, as illustrated in FIG. 10, a barrier layer 81 that restricts elution of the content in the stopper 34 may be provided on a surface of the stopper 34. In an example illustrated FIG. 10, the stopper 34 includes a stopper body 35 and the barrier layer 81. The stopper body 35 may contain silicone. For example, in the case where the stopper 34 contains silicone rubber, a highly active substance derived from a rubber vulcanizing agent and an additive such as a stabilizer or an antioxidant can be eluted from the stopper 34. The eluted substance can cause the liquid L that is contained in the first container 30 to deteriorate. In view of this, the barrier layer 81 may be provided on an inner surface of the stopper 34. As illustrated by using a reference sign 81 in FIG. 10, the barrier layer 81 may be provided in a portion of the stopper 34 that is inserted into the container body 32. As illustrated by using a reference sign 81A in FIG. 10, the barrier layer 81 and a barrier layer 81A may be provided at positions on the stopper 34 so as to be in contact with the container body 32. As illustrated by using a reference sign 81B in FIG. 10, the barrier layers 81 and 81A and a barrier layer 81B may be provided on the entire surface of the stopper 34.

The barrier layer 81 may include a para-xylylene layer. The para-xylylene layer may contain para-xylylene N, may contain para-xylylene C, or may contain para-xylylene HT. The para-xylylene layer may be manufactured on the stopper body 35 by using vacuum deposition. The thickness of the para-xylylene layer may be 0.1 μm or more and 2 μm or less, may be 0.1 μm or more and 1 μm or less, or may be 0.1 μm or more and 0.5 μm or less. The upper limit that is set for the thickness of the para-xylylene layer enables the stopper 34 to have sufficient oxygen permeability. The lower limit that is set for the thickness of the para-xylylene layer enables the stopper 34 to have a function of sufficiently reducing elution.

The barrier layer 81 may include a fluorine resin layer. The fluorine resin layer may contain perfluoroalkoxy alkane (PFA). The fluorine resin layer may contain perfluoroethylene propylene copolymer (FEP). The fluorine resin layer may contain ethylene tetrafluoroethylene copolymer (ETFE)). The fluorine resin layer may be manufactured on the stopper body 35 by using coating. The thickness of the fluorine resin layer may be 0.1 μm or more and 60 μm or less, may be 0.1 μm or more and 40 μm or less, or may be 0.1 μm or more and 25 μm or less. The upper limit that is set for the thickness of the fluorine resin layer enables the stopper 34 to have sufficient oxygen permeability. The lower limit that is set for the thickness of the fluorine resin layer enables the stopper 34 to have the function of sufficiently reducing elution.

The barrier layer 81 may include an amorphous fluorine layer. The amorphous fluorine layer may be manufactured on the stopper body 35 by using coating. The thickness of the amorphous fluorine layer may be 0.1 μm or more and 4 mm or less. The upper limit that is set for the thickness of the amorphous fluorine layer enables the stopper 34 to have sufficient oxygen permeability. The lower limit that is set for the thickness of the amorphous fluorine layer enables the stopper 34 to have the function of sufficiently reducing elution.

In the specific examples described above, the specific structure of the stopper 34 that has the oxygen permeability is described. From the perspective that the permeation of oxygen through the stopper 34 that has the oxygen permeability is facilitated, the stopper 34 is preferably not in contact with the liquid L in a process of adjusting the amount of oxygen. The stopper 34 is preferably separated (away) from the liquid L in the process of adjusting the amount of oxygen. The stopper 34 is preferably in contact with gas in the process of adjusting the amount of oxygen. In view of this, the stopper 34 may be subject to a liquid repellent process. The stopper 34 may has a liquid repellent structure. The contact angle of the inner surface of the stopper 34 that is subject to the liquid repellent process or that has the liquid repellent structure in a sessile drop method in a wettability test in accordance with JIS R3257 may be 80° or more, may be 90° or more, may be 95° or more, or may be less than 180°.

Figure 11:
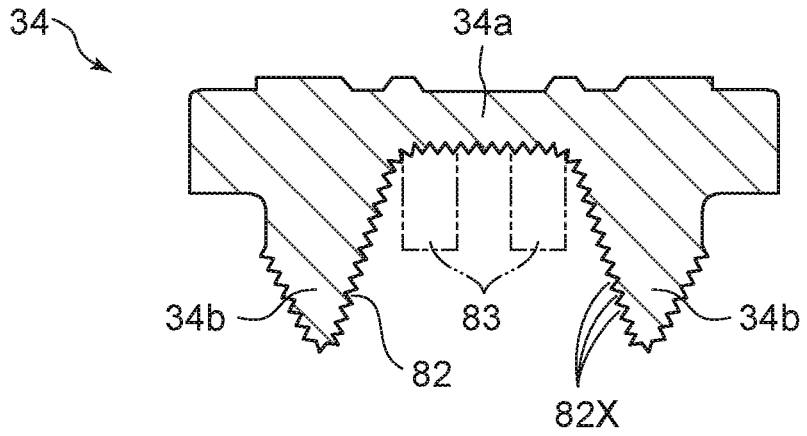
FIG. 11 is a longitudinal sectional view of another modification to the stopper.

An example of the liquid repellent process is a surface modification process by using ion beam radiation or plasma processing. As illustrated in FIG. 11, the liquid repellent structure may include an unevenness surface 82 that is included in a surface of the stopper 34 that faces an inner portion of the container body 32. In an example illustrated in FIG. 11, the unevenness surface 82 that is included in the inner surface of the stopper 34 has a fine uneven structure. In this example, recessed portions 82X of the unevenness surface 82 can hold gas. In this example, bubbles that adhere to the unevenness surface 82 can be maintained.

The use of the inner surface of the stopper 34 that includes the unevenness surface 82 increases the surface area of the stopper 34. The increase in the surface area of the stopper 34 enables the permeation of oxygen through the stopper 34 to be facilitated. Projections 83 that project from the inner surface of the stopper 34 may be provided, and the surface area of the stopper 34 may be increased. For example, as illustrated by using two-dot chain lines in FIG. 11, the projections 83 that are provided on the stopper 34 is not in contact with the container body 32. The projections 83 may be located inside the insertion projection 34*b* that has a cylindrical shape. The projections 83 may be located in a region that is surrounded by multiple insertion projections 34*b* that are located on a circle, in other words, inside the circle on which the multiple insertion projections 34*b* are disposed. The surface areas of the projections 83 that are separated from the container body 32 can be effectively increased.

Figure 12:
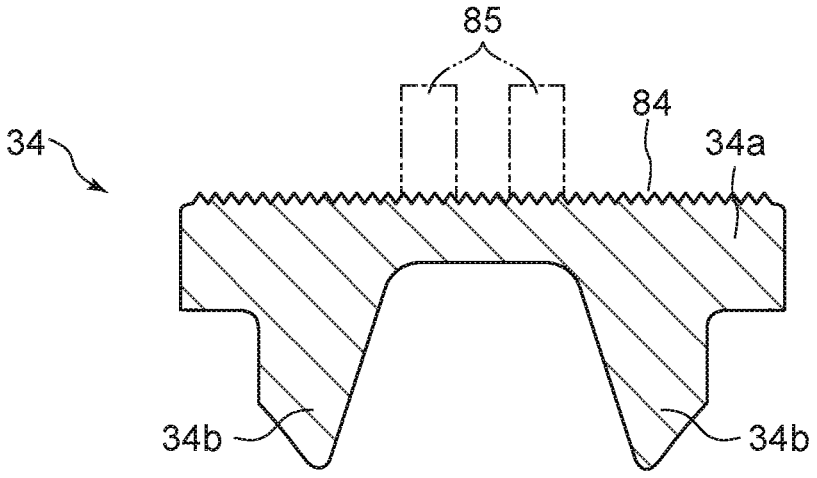
FIG. 12 is a longitudinal sectional view of another modification to the stopper.

As illustrated in FIG. 12, the use of an outer surface of the stopper 34 that includes an unevenness surface 84 may increase the surface area of the stopper 34. The increase in the surface area of the stopper 34 enables the permeation of oxygen through the stopper 34 to be facilitated. As illustrated in FIG. 12, projections 85 that project from the outer surface of the stopper 34 may be provided, and the surface area of the stopper 34 may be increased. In this example, the unevenness surface 84 may be formed such that a gap through which gas can pass is formed between a portion of the stopper 34 that is covered by the fixture 36 and the fixture 36. In this example, the permeation of gas through the stopper 34 can be stably facilitated.

Figure 13:
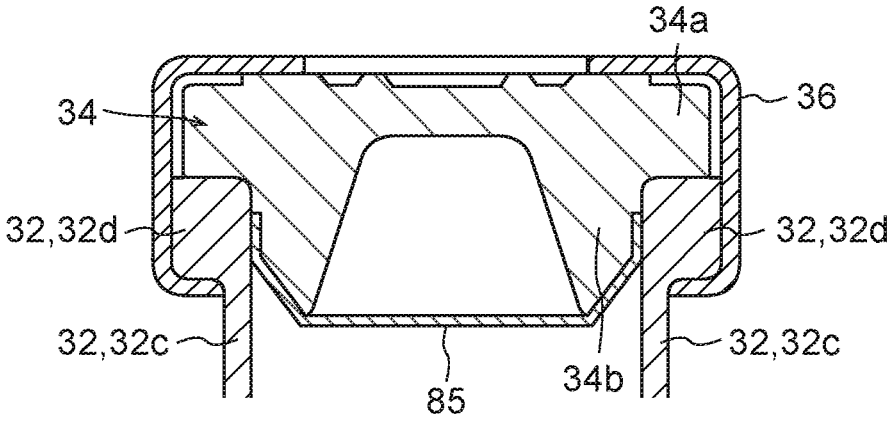
FIG. 13 is a longitudinal sectional view of the first container that includes a liquid repellent sheet.
Figure 14:
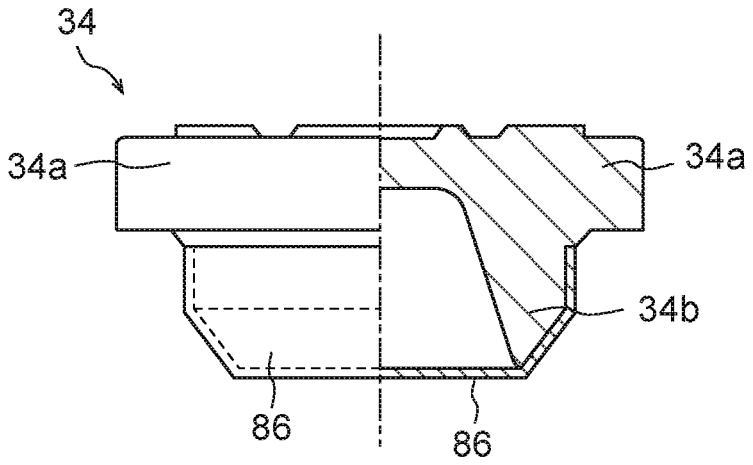
FIG. 14 is a longitudinal sectional view of the stopper on which the liquid repellent sheet is provided.

As illustrated in FIG. 13, a sheet 86 that has the oxygen permeability and liquid repellency may be provided between the container body 32 and the stopper 34. An example of the sheet 86 is a sheet that has a hole in which gas can be held such as non-woven fabric. An example of the sheet 86 is a sheet material that includes a sheet body that has a hole and a coating layer that is stacked on the sheet body and that has liquid repellency. The coating layer of the sheet material may be a fluorine deposition film or a coating film. The oxygen permeability of the sheet is evaluated in the same manner as the oxygen permeability of the first container 30. That is, this means that oxygen in a predetermined oxygen permeation amount or more can permeate the sheet 86 in an atmosphere at a temperature of 23° C. and a humidity of 40% RH. The predetermined oxygen permeation amount is $1\times10^{-1}$ (mL/(day×atm)) or more. The predetermined oxygen permeation amount may be 1 (mL/(day×atm)) or more, may be 1.2 (mL/(day×atm)) or more, or may be 3 (mL/(day×atm)) or more. The liquid repellency of the sheet 86 means that the contact angle is 80° or more in the sessile drop method in the wettability test in accordance with JIS R3257. The sheet 86 illustrated in FIG. 13 may be attached to (mounted on) the stopper 34 as illustrated in FIG. 14 and may form a portion of the stopper 34. The sheet 86 illustrated in FIG. 13 may be another member that differs from the container body 32 and the stopper 34 and may be interposed and held between the container body 32 and the stopper 34.

As illustrated in FIG. 15 to FIG. 18, the first container 30 may include an extension wall portion 87 that extends from an inner surface of the container body 32. The extension wall portion 87 enables the liquid L to be inhibited from adhering to the inner surface of the stopper 34.

Figure 15:
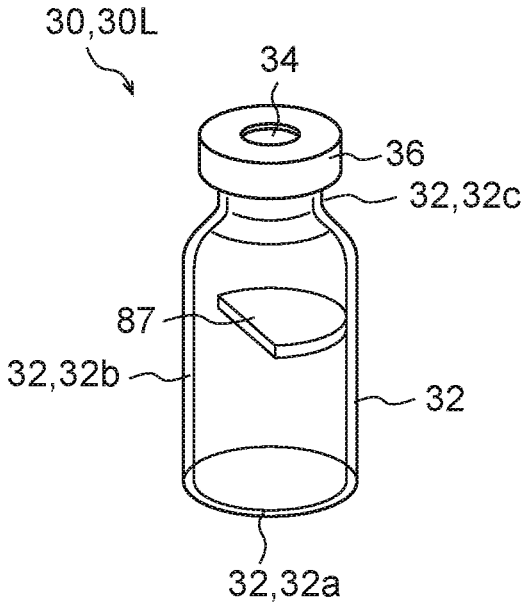
FIG. 15 is a perspective view of an example of the first container that includes an extension wall portion.
Figure 16:
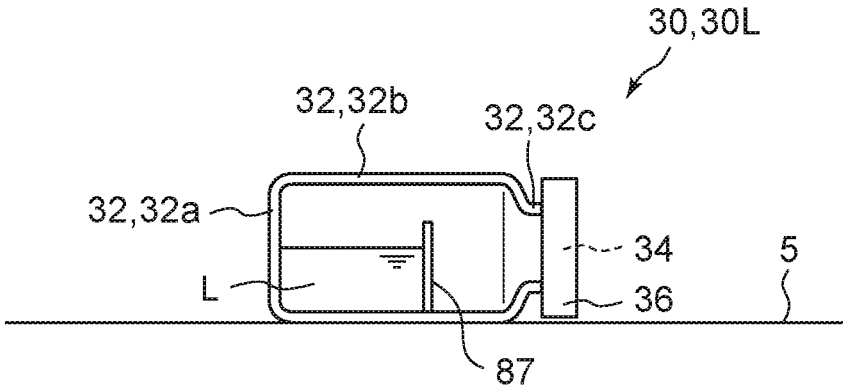
FIG. 16 illustrates a method of using the first container illustrated in FIG. 15.
Figure 17:
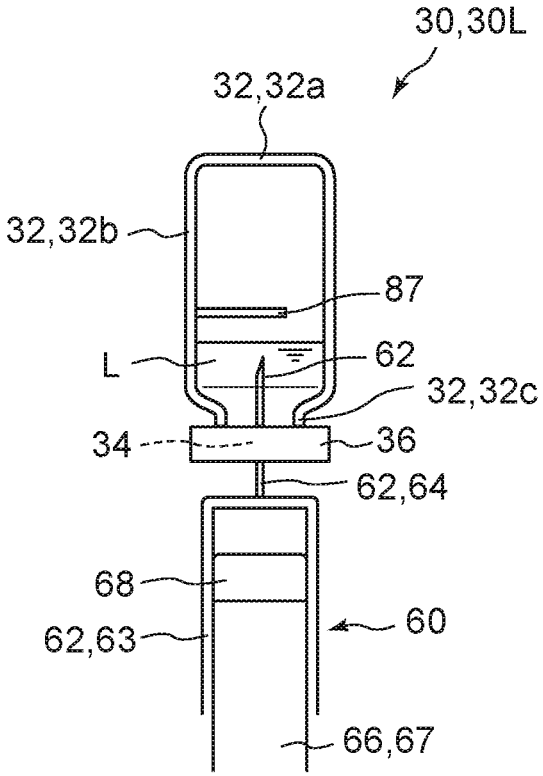
FIG. 17 illustrates a method of using the first container illustrated in FIG. 15.

In examples illustrated in FIG. 15 to FIG. 17, the extension wall portion 87 divides the interior space of the container body 32 into two spaces. However, the liquid L can move between the two spaces in the container body 32. In a process of adjusting the amount of oxygen in the first container 30, as illustrated in FIG. 16, the first container 30 may be preserved with the stopper 34 and the bottom portion 32*a* of the container body 32 laid down and facing sideways. The first container 30 is disposed such that the trunk portion 32*b* is located on a placement surface 5. In the example illustrated in FIG. 16, the liquid L is held in the space that is defined by the container body 32 and the extension wall portion 87 and is not in contact with the stopper 34. This enables the permeation of oxygen through the stopper 34 to be facilitated. As illustrated in FIG. 17, when the liquid L is taken out from the first container 30 by using the syringe 60, the first container 30 may be held such that the stopper 34 faces downward. In a state illustrated in FIG. 17, the liquid L passes through a gap between the container body 32 and the extension wall portion 87 and moves to the space that is defined by the container body 32, the stopper 34, and the extension wall portion 87 in the container body 32. In the state illustrated in FIG. 17, the liquid L is in contact with the stopper 34, and the liquid L can be taken out from the first container 30 by using the syringe 60.

Figure 18:
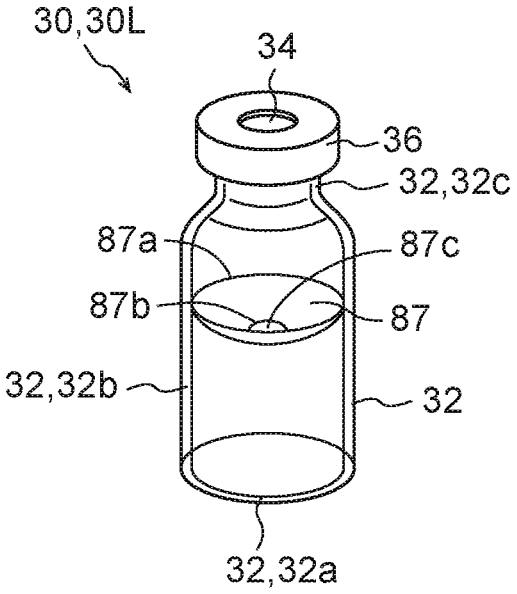
FIG. 18 is a perspective view of another example of the first container that includes the extension wall portion.

FIG. 18 illustrates another example of the extension wall portion 87. In the example illustrated in FIG. 18, the extension wall portion 87 has an annular shape. The extension wall portion 87 that has an annular shape includes an outer periphery 87*a* and an inner periphery 87*b*. The extension wall portion 87 is connected to an inner surface of the trunk portion 32*b* of the container body 32 that is cylindrical over the entire length of the outer periphery 87*a*. The extension wall portion 87 has a hole 87*c* that is defined by the inner periphery 87*b*. The extension wall portion 87 divides the interior space of the container body 32 into two. The liquid L passes through the hole 87*c* and can move between the two spaces. In the illustrated example, the extension wall portion 87 inclines so as to be separated from the opening portion 33 and approach the bottom portion 32*a* in a direction from the outer periphery 87*a* toward the inner periphery 87*b*. In this example, the liquid L can be collected in the space near the bottom portion 32*a* away from the stopper 34. This enables the liquid L to be more stably inhibited from adhering to the inner surface of the stopper 34.

In the specific examples described above, the first container 30 includes the container body 32 that includes the opening portion 33, the stopper 34 that closes the opening portion 33, and the fixture 36 that is mounted on the container body 32 and that fixes the stopper 34 to the container body 32. The stopper 34 includes the plate portion 34*a* that is disposed on the container body 32 and that covers the opening portion 33 and the insertion projection 34*b* that projects from the plate portion 34*a* and that is inserted into the opening portion 33. The insertion projection 34*b* may have a cylindrical shape. The insertion projection 34*b* may include the multiple insertion projections 34*b* that are located on a circle. In an example in which the container body 32 and the fixture 36 have the oxygen barrier property, and the stopper 34 has the oxygen permeability, oxygen mainly permeates an exposed region (an exposed portion) 34*c* of the stopper 34 that is exposed to the inside of the container body 32. The exposed region 34*c* is a region of a portion of the plate portion 34*a* that faces the opening portion 33 where the insertion projection 34*b* is not provided.

In this example, the fixture 36 may has an exposure hole 36*a* through which the exposed region 34*c* of the plate portion 34*a* that is exposed to the inside of the container body 32 is exposed. The fixture 36 that has gas barrier property has the exposure hole 36*a*, and consequently, movement of oxygen in the first container 30 to the outside can be facilitated.

Figure 19:
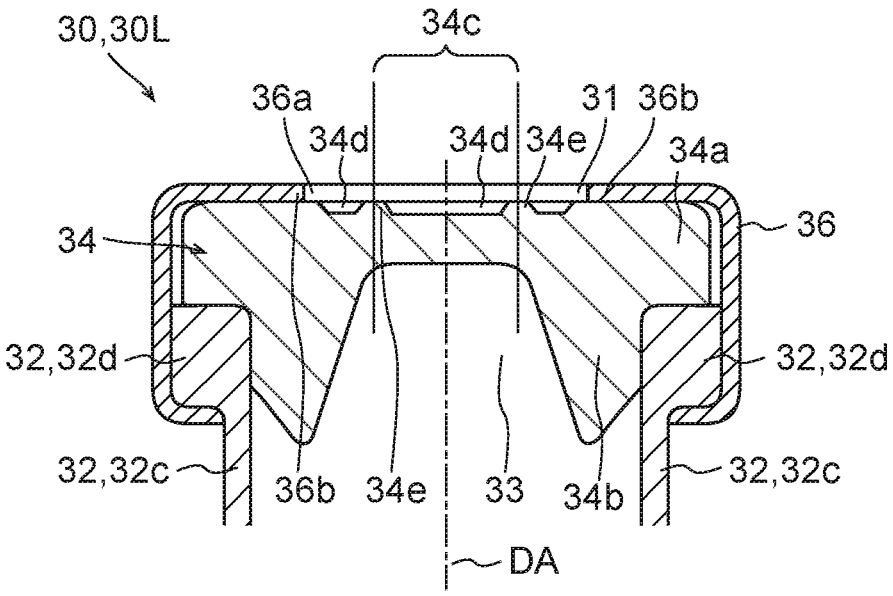
FIG. 19 is a longitudinal sectional view of an example of the first container.

As illustrated in FIG. 19, a step 31 in the direction DA in which the stopper 34 is inserted into the opening portion 33 may be formed between a circumferential portion 36*b* around the exposure hole 36*a* of the fixture 36 and a portion of the stopper 34 that is exposed to the inside of the exposure hole 36*a*. The step 31 enables the second container 40 that is flexible and that has the oxygen barrier property to be inhibited from coming into contact with the stopper 34 of the first container 30 that has the oxygen permeability. This enables movement of oxygen in the first container 30 to the outside to be stably facilitated.

As illustrated in FIG. 19, the plate portion 34*a* may have recesses 34*d* that are recessed toward an inner portion (the trunk portion 32*b*) of the container body 32 in the direction DA in which the stopper 34 is inserted into the opening portion 33 at portions of the plate portion 34*a* that is exposed to the inside of the exposure hole 36*a*, particularly, in the exposed region 34*c*. The plate portion 34*a* at a portion provided with the recesses 34*d* is nearer than the portion of the plate portion 34*a* that is covered by the fixture 36 to the inner portion (the trunk portion 32*b*) of the container body 32 in the direction DA in which the stopper 34 is inserted into the opening portion 33. The recesses 34*d* enables the step 31 to be enlarged. Accordingly, the second container 40 that has the oxygen barrier property can be inhibited from coming into contact with the stopper 34 of the first container 30 that has the oxygen permeability. This enables movement of oxygen in the first container 30 to the outside to be stably facilitated.

Figure 20:
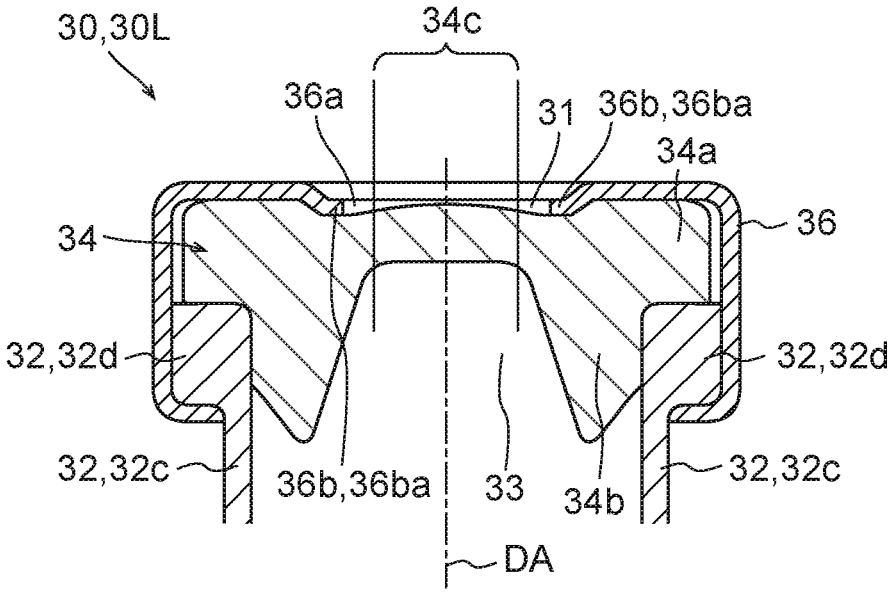
FIG. 20 is a longitudinal sectional view of another example of the first container.

As illustrated in FIG. 20, the circumferential portion 36*b* around the exposure hole 36*a* of the fixture 36 may include a bent portion 36*ba* that bends toward the plate portion 34*a* in the direction DA in which the stopper 34 is inserted into the opening portion 33. The bent portion 36*ba* can press the plate portion 34*a* toward the inner portion of the container body 32 with the fixture 36 mounted on the container body 32. The bent portion 36*ba* enables the step 31 to be enlarged. Accordingly, the second container 40 that has the oxygen barrier property can be inhibited from coming into contact with the stopper 34 of the first container 30 that has the oxygen permeability. This enables movement of oxygen in the first container 30 to the outside to be stably facilitated.

Figure 21:
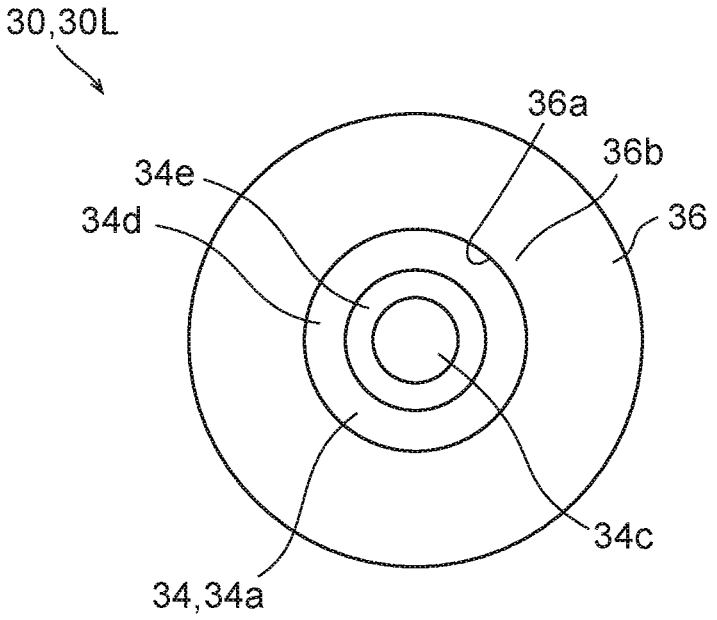
FIG. 21 is a top view of the first container illustrated in FIG. 19.

In examples illustrated in FIG. 19 and FIG. 21, a linear projecting portion 34*e* that linearly extends is provided on the portion of the stopper 34 that is exposed to the inside of the exposure hole 36*a*. Also in an example illustrated in FIG. 22, the linear projecting portions 34*e* that linearly extend are provided on the portion of the stopper 34 that is exposed to the inside of the exposure hole 36*a*. In these illustrated examples, the linear projecting portions 34*e* may indicate the position of the exposed region 34*c* of the plate portion 34*a* that is exposed to the inside of the container body 32. The exposed region 34*c* can be grasped from a position outside the first container 30, and consequently, the second container 40 that is flexible and that has the oxygen barrier property can be inhibited from coming into contact with the exposed region 34*c*. When the liquid L is taken out from the first container 30 by using the syringe 60, a region into which the needle 64 of the syringe 60 is to be inserted can be grasped.

Figure 22:
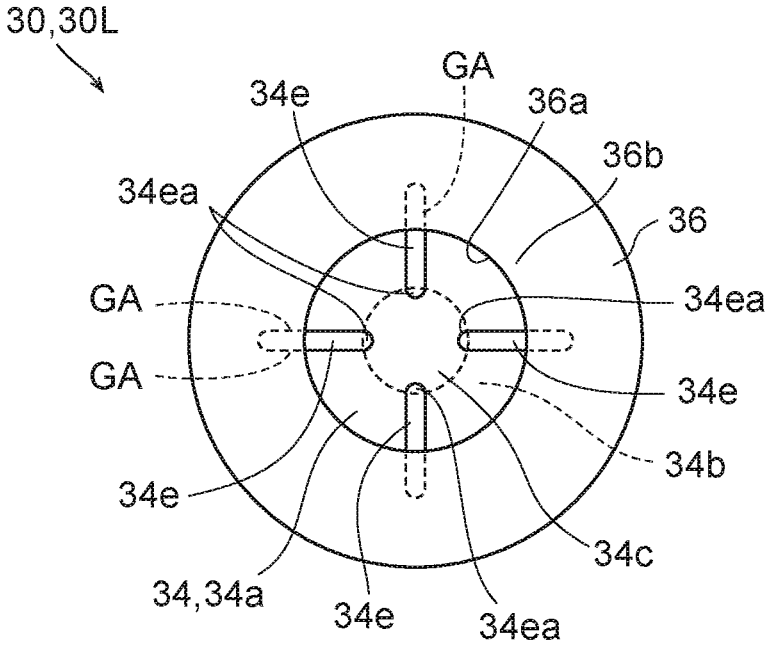
FIG. 22 is a top view of another example of the first container.

FIG. 19 and FIG. 20 are sectional views of the first container 30 corresponding to that in, for example, FIG. 2. FIG. 19 and FIG. 20 illustrate sections that extend in the direction DA in which the stopper 34 is inserted into the opening portion 33. FIG. 21 and FIG. 22 are plan views of the first container 30 viewed in the direction DA in which the stopper 34 is inserted into the opening portion 33.

In the examples illustrated in FIG. 19 and FIG. 21, the linear projecting portion 34*e* extends on the peripheral portion of the exposed region 34*c* of the plate portion 34*a* that is exposed to the inside of the container body 32 in a projection view in the direction DA in which the stopper 34 is inserted into the opening portion 33. In these examples, the user can handle the combination container 10 such that the whole of the exposed region 34*c* does not come into contact with the second container 40 that is flexible and that has the oxygen barrier property. This enables movement of oxygen in the first container 30 to the outside to be facilitated.

In an example illustrated in FIG. 22, a part of each linear projecting portion 34*e* is covered by the fixture 36 that is mounted on the container body 32. The other part of each linear projecting portion 34*e* is exposed to the inside of the exposure hole 36*a*. In this example, a gap GA can be formed between the circumferential portion 36*b* around the exposure hole 36*a* of the fixture 36 and a portion of the stopper 34 adjacent to each linear projecting portion 34*e*. That is, the stopper 34 can be separated from the fixture 36 at parts of a region that faces the fixture 36. That is, the gap can be formed between the stopper 34 and the fixture 36. This enables movement of oxygen in the first container 30 to the outside to be stably facilitated.

In the example illustrated in FIG. 22, the multiple linear projecting portions 34*e* are separated from each other. End portions 34*ea* of the linear projecting portions 34*e* that are exposed to the inside of the exposure hole 36*a* may be located in the exposed region 34*c* of the plate portion 34*a* that is exposed to the inside of the container body 32 in the projection view in the direction DA in which the stopper 34 is inserted into the opening portion 33. As illustrated in FIG. 22, the end portions 34*ea* of the linear projecting portions 34*e* that are exposed to the inside of the exposure hole 36*a* may be located on the peripheral portion of the exposed region 34*c* of the plate portion 34*a* that is exposed to the inside of the container body 32 in the projection view in the direction DA in which the stopper 34 is inserted into the opening portion 33. In this example, the exposed region 34*c* can be indicated as a region that is surrounded by the end portions 34*ea* of the multiple linear projecting portions 34*e*.

Figure 23:
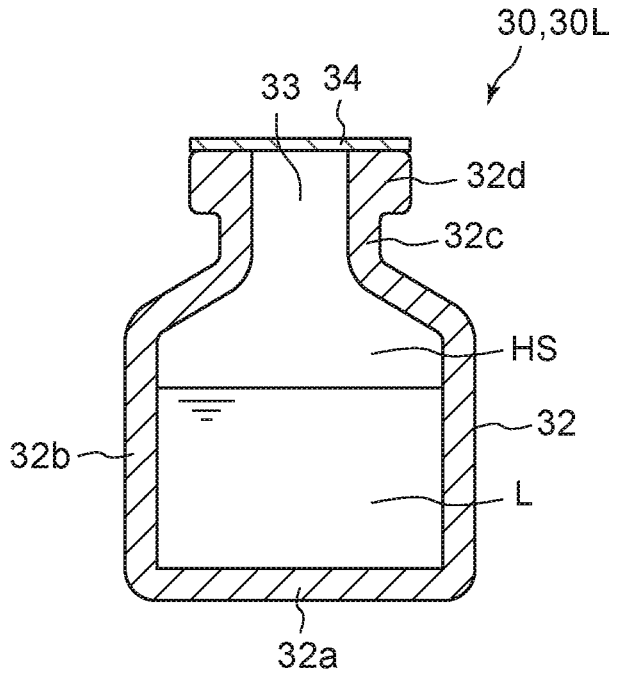
FIG. 23 is a longitudinal sectional view of another example of the first container.

In the specific examples described above, a specific structure of the first container 30 is described, but this is not a limitation, and various containers may be used. For example, as illustrated in FIG. 23, the stopper 34 of the first container 30 may have a film shape or a sheet shape that covers the opening portion 33. The stopper 34 illustrated in FIG. 23 is joined to an end surface of the container body 32 by using, for example, a joining material or welding. The stopper 34 may have the oxygen permeability or may have the oxygen barrier property.

Figure 24:
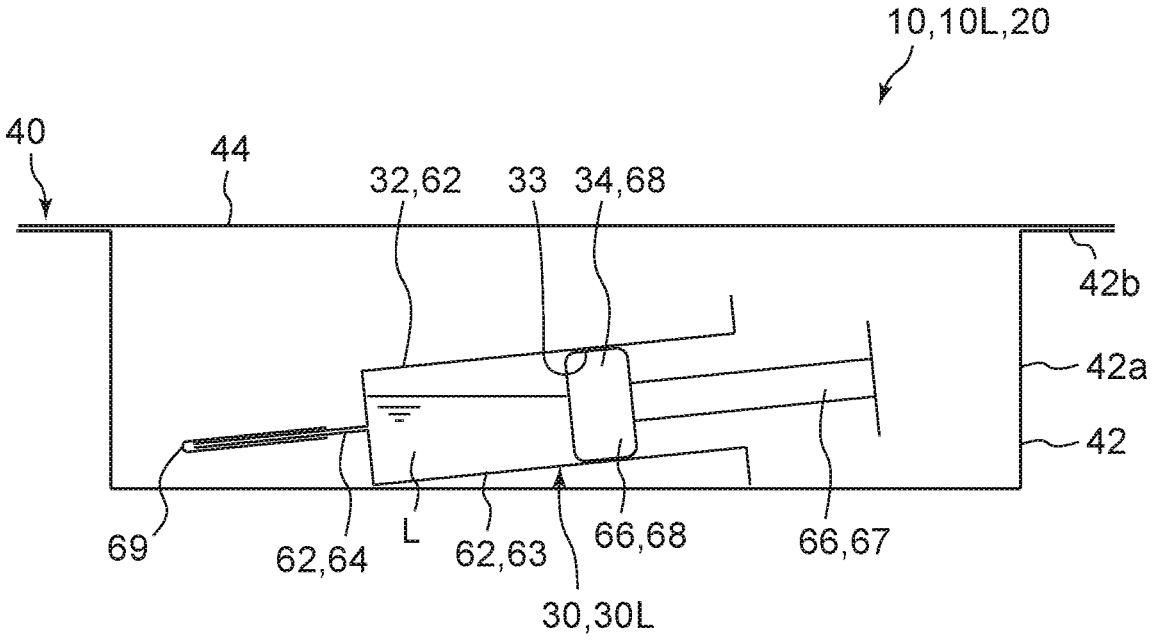
FIG. 24 is a longitudinal sectional view of another example of the first container.

FIG. 24 illustrates another modification of the first container 30. The first container 30 illustrated in FIG. 24 is composed of the syringe 60. The syringe 60 illustrated in FIG. 24 includes the cylinder 62 and the piston 66 as in the example described above with reference to FIG. 6. The cylinder 62 includes the cylinder body 63 composed of glass or resin and the needle 64 composed of metal. The cylinder 62 corresponds to the container body 32 of the first container 30 and forms the container space for the liquid L. The piston 66 includes the piston body 67 composed of glass or resin and the gasket 68 that is disposed in the opening portion 33 of the cylinder 62. The gasket 68 corresponds to the stopper 34 of the first container 30 and closes the opening portion 33. The container space for the liquid L is defined between the cylinder 62 and the gasket 68. The syringe 60 illustrated includes a cap 69. The cap 69 is removably mounted on the needle 64. The cap 69 restricts leakage of the liquid L from the needle 64 and seals the liquid L in the syringe 60. In an example illustrated in FIG. 24, the syringe 60 is used as the first container 30, and consequently, the syringe 60 that is taken out from the second container 40 can be used as it is for, for example, a patient.

In the example illustrated in FIG. 24, the gasket 68 may have the oxygen permeability. A stopper composed of silicone rubber may be used as the gasket 68 that has the oxygen permeability. The cylinder 62 may have the oxygen barrier property. The oxygen permeability coefficient of the gasket 68 may be set to the same as the oxygen permeability coefficient of the stopper 34 described above. The oxygen permeability coefficient of the cylinder 62 may be set to the same as the oxygen permeability coefficient of the container body 32 described above.

In the example illustrated in FIG. 24, oxygen permeates the gasket 68, and consequently, the oxygen is discharged from an inner portion of the first container 30 that is defined by the cylinder body 63 and the gasket 68. Consequently, the oxygen concentration in the syringe 60 reduces, and the amount of dissolved oxygen in the liquid L reduces. As a result, dissolving (decomposition) due to oxygen in the liquid L can be effectively reduced.

Figure 25:
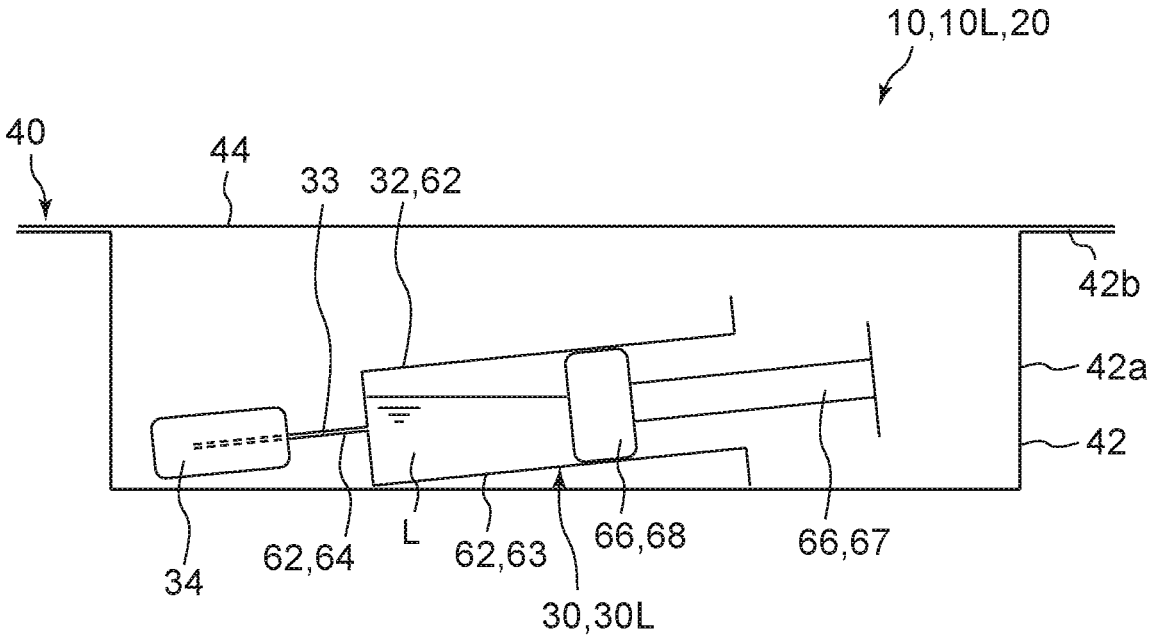
FIG. 25 is a longitudinal sectional view of a modification to the first container illustrated in FIG. 20.

As illustrated in FIG. 25, the syringe 60 that serves as the first container 30 may include the stopper 34 that cover the opening portion 33 that is provided in the cylinder 62. For example, the needle 64 may form the opening portion 33, and the stopper 34 may cover an end of the needle 64. The stopper 34 may has the oxygen permeability. The stopper 34 that has the oxygen permeability may be composed of silicone rubber. The stopper 34 covers the opening portion 33 that is formed by the cylinder 62.

Figure 26:
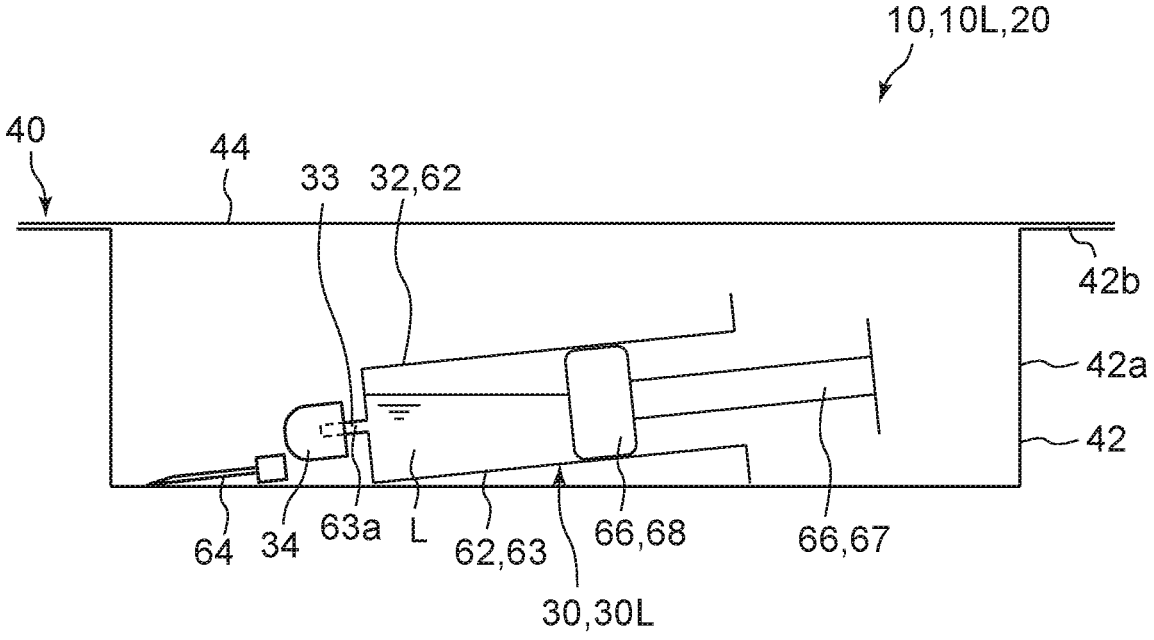
FIG. 26 is a longitudinal sectional view of another modification to the first container illustrated in FIG. 20.

In another example, as illustrated in FIG. 26, the syringe 60 that serves as the first container 30 may be contained in the second container 40 with the needle 64 removed. In the example illustrated in FIG. 26, the cylinder body 63 includes an end projection 63*a*. The needle 64 can be attached to (mounted on) the end projection 63*a*. The syringe 60 may include the stopper 34 that covers an opening of the end projection 63*a*. The stopper 34 may have the oxygen permeability. The stopper 34 that has the oxygen permeability may be composed of silicone rubber. In the examples illustrated in FIG. 25 and FIG. 26, the gasket 68 may have the oxygen permeability or may not have the oxygen permeability. In the examples illustrated in FIG. 25 and FIG. 26, the gasket 68 may have the oxygen barrier property or may not have the oxygen barrier property. The stopper 34 covers the opening portion 33 that is formed by the end projection 63*a*.

In the examples illustrated in FIG. 25 and FIG. 26, oxygen permeates the stopper 34, and the oxygen is discharged from the inner portion of the first container 30 that is defined by the cylinder body 63 and the gasket 68. Consequently, the oxygen concentration in the syringe 60 reduces, and the amount of dissolved oxygen in the liquid L reduces. As a result, dissolving (decomposition) due to oxygen in the liquid L can be effectively reduced.

The first container 30 may have a label. As for the label, information about the liquid may be displayed. The label may be stuck to the container body 32. The label preferably does not extend over the entire circumference such that the inside of the container body 32 can be observed. As for a combination with the second container 40 in the first specific example described with reference to FIG. 27 to FIG. 32, the label preferably faces the second container 40 such that a description on the label can be observed. That is, the label preferably faces in the direction opposite the direction in which the bottom wall 91 of the tray 90 faces. In the case where the first container 30 is a vial bottle, the container body 32 is preferably exposed 10 mm or more, preferably 20 mm or more between the label and the stopper 34 and between the label and the fixture 36. The liquid in the first container 30 can be observed through the container body 32 that is transparent. Light is radiated via the container body 32 that is transparent, and consequently, the amount of oxygen in the first container 30 can be measured. In this case, in addition to the neck portion 32*c* of the container body 32, the trunk portion 32*b* is preferably exposed between the label and the stopper 34 and between the label and the fixture 36.

The fixture 36 illustrated in FIG. 1 and FIG. 2 has an opening (the exposure hole 36*a*) through which the stopper 34 is exposed. This example is not a limitation, and the fixture 36 may include a removable plate portion that is removed such that an opening is formed. The stopper 34 may be a flip cap. As for the flip cap, an aluminum seal and plastic are integrally formed. A specific structure of the flip cap may be a structure disclosed in JP7-165252A or JP2008-222270A.

In the specific examples described above, the first container 30 includes the container body 32 and the stopper 34, and the stopper 34 has the oxygen permeability. However, at least a portion of the container body 32 may have the oxygen permeability, and the stopper 34 may have the oxygen barrier property. The specific structure of the second container 40 described above is just an example, and various modifications can be made.

In the specific examples described above, the combination container 10 includes the oxygen absorber 21. The oxygen absorber 21 absorbs oxygen in the second container 40 and oxygen that permeates the portion of the first container 30 that has the oxygen permeability and that moves from a position in the first container 30 into the second container 40. The oxygen absorber 21 and the deoxygenated member 22 may be disposed between the portion of the first container 30 that has the oxygen permeability and the second container. The oxygen absorber 21 and the deoxygenated member 22 may face the portion of the first container 30 that has the oxygen permeability. The oxygen absorber 21 and the deoxygenated member 22 may be disposed on the portion of the first container 30 that has the oxygen permeability. The oxygen absorber 21 and the deoxygenated member 22 may be in contact with the portion of the first container 30 that has the oxygen permeability. The oxygen absorber 21 and the deoxygenated member 22 may be in contact with the portion so as not to cover (so as to expose) at least a part of the portion of the first container 30 that has the oxygen permeability. This arrangement enables movement of oxygen in the first container 30 to the outside to be facilitated. The second container 40 that is flexible and that has the oxygen barrier property can be inhibited from coming into contact with the stopper 34 of the first container 30 that has the oxygen permeability. This enables movement of oxygen in the first container 30 to the outside to be facilitated.

The oxygen absorber 21 or the deoxygenated member 22 may be fixed to the first container 30 by using heat sealing or a joining material in order to maintain relative positions of the oxygen absorber 21 or the deoxygenated member 22 and the portion of the first container 30 that has the oxygen permeability. The oxygen absorber 21 or the deoxygenated member 22 may be fixed to a portion other than the portion of the first container 30 that has the oxygen permeability. With this structure, an appropriate relationship between the relative positions of the oxygen absorber 21 or the deoxygenated member 22 and the portion of the first container 30 that has the oxygen permeability is maintained, and movement of oxygen in the first container 30 to the outside can be stably facilitated.

In the examples illustrated in FIG. 1 and FIG. 8, the container body 32 and the fixture 36 have the oxygen barrier property, and the stopper 34 has the oxygen permeability. In the examples illustrated by using the two-dot chain lines in FIG. 1 and FIG. 8, the deoxygenated member 22 that includes the oxygen absorber 21 faces the stopper 34 that has the oxygen permeability. The deoxygenated member 22 that includes the oxygen absorber 21 may be in contact with the stopper 34 that has the oxygen permeability. The deoxygenated member 22 that includes the oxygen absorber 21 may be in contact with only a portion of the stopper 34 that has the oxygen permeability. The deoxygenated member 22 that includes the oxygen absorber 21 may be disposed such that a gap is between the deoxygenated member 22 and the stopper 34 that has the oxygen permeability. The oxygen absorber 21 and the deoxygenated member 22 that are illustrated by using the two-dot chain lines in FIG. 1 and FIG. 8 enable movement of oxygen in the first container 30 to the outside to be facilitated. The second container 40 that is flexible and that has the oxygen barrier property can be inhibited from coming into contact with the stopper 34 of the first container 30 that has the oxygen permeability.

The deoxygenated member 22 may be fixed to the first container 30 in order to maintain the relative positions of the deoxygenated member 22 and the stopper 34. The deoxygenated member 22 that includes the oxygen absorber 21 may be fixed to the stopper 34, the fixture 36 or the first container 30 by using heat sealing or a joining material. In the case where the deoxygenated member 22 is fixed to the stopper 34, the deoxygenated member 22 may be fixed to a portion of the stopper 34. The deoxygenated member 22 may be fixed to the fixture 36 such that the gap is ensured between the deoxygenated member 22 and the stopper 34.

Figure 47:
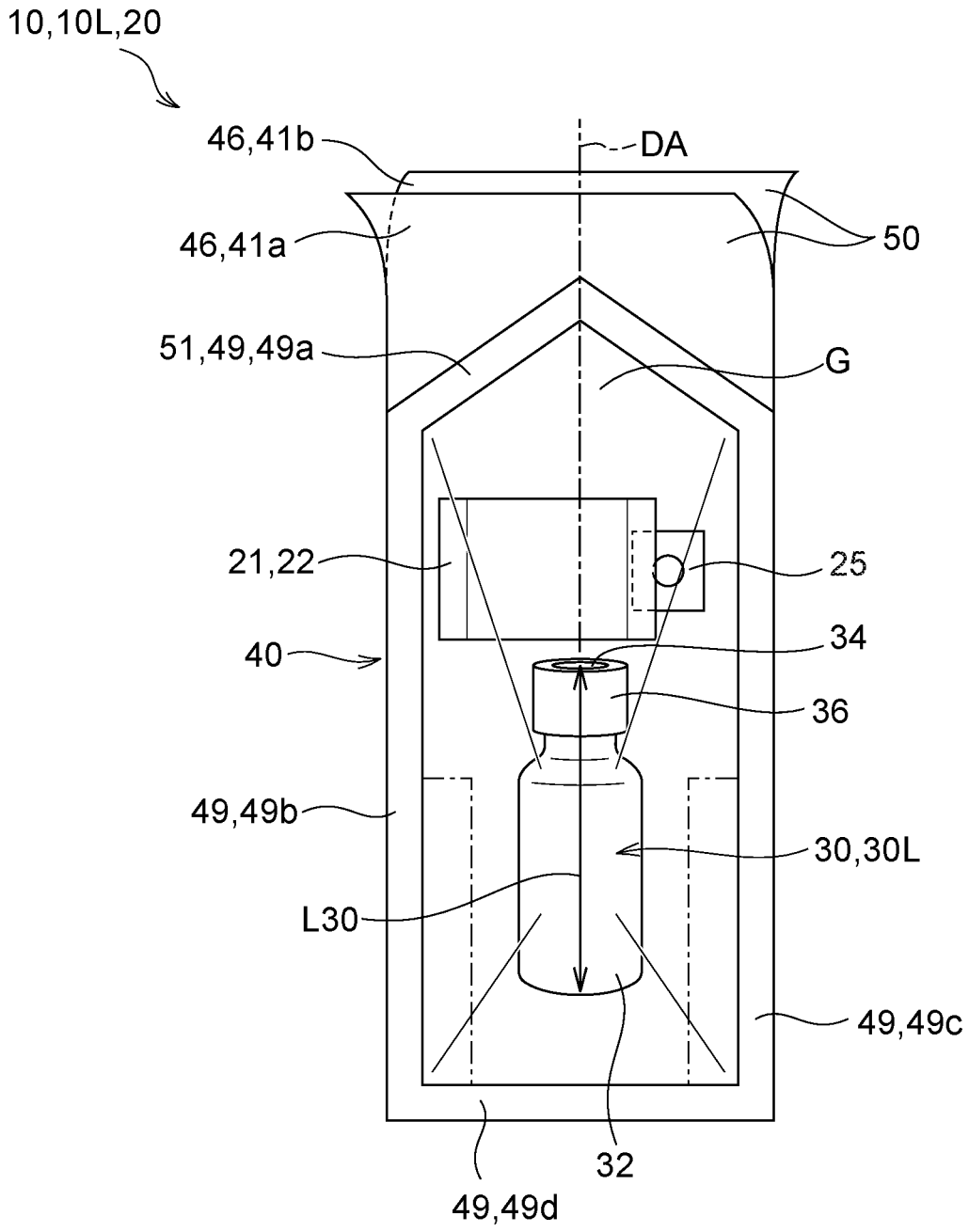
FIG. 47 is a perspective view of a modification to the liquid-containing combination container illustrated in FIG. 36.
Figure 48:
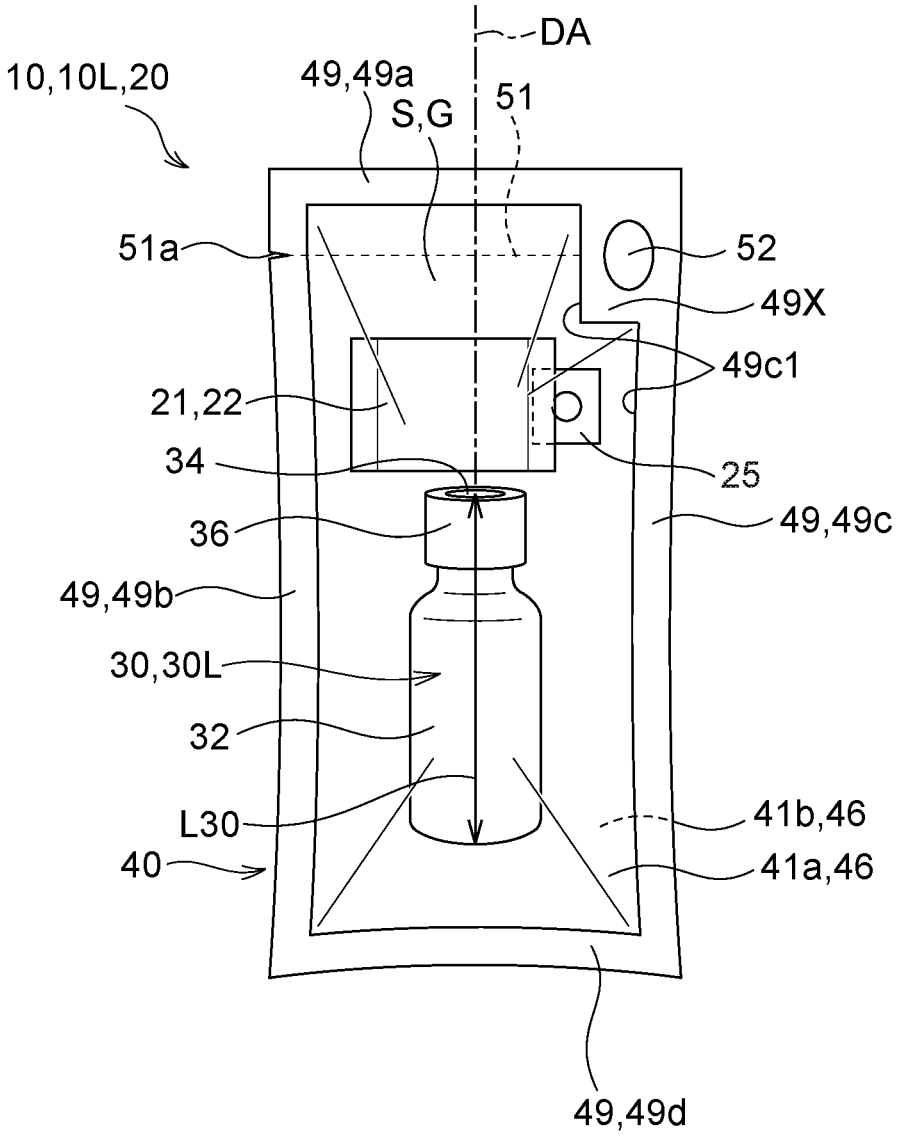
FIG. 48 is a perspective view of a modification to the liquid-containing combination container illustrated in FIG. 38.

In the examples illustrated in FIG. 22, FIG. 47, and FIG. 48, the second container 40 includes the to-be-opened portion (opening intention portion) 51. The to-be-opened portion 51 is a portion at which the second container 40 is to be opened. The to-be-opened portion 51 has a structure for inducing and facilitating opening the second container 40. In the third and fifth specific examples described above, the to-be-opened portion 51 of the second container 40 includes the first seal portion 49*a*. In the fourth specific example described above, the to-be-opened portion 51 of the second container 40 is formed due to the materials or by processing. As illustrated in FIG. 47, the second container 40 may include two or more structures for forming the to-be-opened portion 51. The second container 40 illustrated in FIG. 47 includes the to-be-opened portion 51 in the third specific example by using the first seal portion 49*a* and the to-be-opened portion 51 in the fourth specific example that is formed due to a material or by processing.

The oxygen absorber 21 and the deoxygenated member 22 are partly or entirely disposed between the to-be-opened portion 51 and the first container 30 in the second container 40. In this example, when the second container 40 is opened, the oxygen absorber 21 is located between a portion at which the second container 40 is opened and the first container 30. Accordingly, the oxygen concentration (%) in the first container 30 and the amount (mg/L) of dissolved oxygen in the liquid L can be inhibited from rapidly increasing. As for this arrangement, the oxygen absorber 21 and the deoxygenated member 22 may be separated from the portion of the first container 30 that has the oxygen permeability. Consequently, a path for permeation of oxygen in the first container 30 to the outside is ensured, and movement of oxygen in the first container 30 to the outside can be stably facilitated. In this example, the oxygen absorber 21 and the deoxygenated member 22 may be located above the first container 30. Similarly, this arrangement enables the oxygen absorber 21 and the deoxygenated member 22 to be separated from the portion of the first container 30 that has the oxygen permeability. This arrangement also enables the oxygen absorber 21 to be activated due to the water vapor as described above.

The deoxygenated member 22 that includes the oxygen absorber 21 may be fixed to the second container 40 by using heat sealing or a joining material in order to maintain this arrangement. For example, the deoxygenated member 22 may be fixed between the to-be-opened portion (opening intention portion) 51 of the second container 40 and the first container 30. The deoxygenated member 22 may be fixed to the second container 40 so as to be separated from the first container 30. In other words, the deoxygenated member 22 may be fixed to the second container 40 such that a gap is formed between the first container 30 and the deoxygenated member 22. The deoxygenated member 22 may be fixed to the second container 40 such that the deoxygenated member 22 is partly or entirely located above the first container 30. The deoxygenated member 22 is thus fixed to the second container 40, and consequently, movement of oxygen in the first container 30 to the outside can be stably facilitated. The deoxygenated member 22 is fixed to the second container 40, and consequently, the flexibility of the second container 40 can be limited. This enables the permeation of oxygen to be inhibited from being restricted due to the second container 40 that is flexible and that has the oxygen barrier property covering the portion of the first container 30 that has the oxygen permeability.

The deoxygenated member 22 may be fixed to the second container 40 so as to be separated from the to-be-opened portion (opening intention portion) 51. In other words, the deoxygenated member 22 may be fixed to the second container 40 such that a gap is formed between the to-be-opened portion 51 and the deoxygenated member 22. When the second container 40 is opened at the to-be-opened portion 51, the parcel 22*a* of the deoxygenated member 22 can be inhibited from being damaged.

In consideration for use, the first container 30 may be disposed in the second container 40 such that the stopper 34 faces the to-be-opened portion 51. This arrangement enables the first container 30 to be easily taken out from the second container 40 that is opened and makes the liquid L in the first container 30 stable. In this example, the oxygen absorber 21 or the deoxygenated member 22 is disposed between the stopper 34 and the to-be-opened portion 51, and consequently, the oxygen concentration (%) in the first container 30 and the amount (mg/L) of dissolved oxygen in the liquid L can be effectively inhibited from rapidly increasing.

The oxygen detection member 25 may be disposed at the same position as the oxygen absorber 21 and the deoxygenated member 22 described above. This enables a change in the oxygen concentration (%) in the second container 40 to be rapidly grasped.

EXAMPLES

The embodiment described above will now be described in more detail by using examples, but the examples do not limit the embodiment described above.

Example 1

A vial bottle that had a volume of about 8.2 mL was prepared as the first container. The first container had the structure illustrated in FIG. 1. The vial bottle that served as the first container had a glass container body. The first container was capable of containing gas while the gas was maintained at negative pressure. Injection water (an aqueous solution) that had a volume of about 4 ml was used as the liquid L and was contained in the first container. The opening portion of the container body that contains the injection water is closed by using a rubber stopper. The rubber stopper was composed of silicone rubber and had the oxygen permeability. An aluminum seal was fixed to the head of the container body by using a hand gripper, and the liquid-containing first container was manufactured. The aluminum seal functioned as the fixture illustrated in FIG. 2A. That is, the aluminum seal restricted the rubber stopper such that the rubber stopper did not come off from the container body. The container body and the rubber stopper were airtight in a state after sealing by using the aluminum seal. In the first container, a headspace in which no injection water was filled remained so as to have a volume of about 4.2 mL. The first container was closed in air. Accordingly, the headspace of the first container 30 contained air. The oxygen concentration in the headspace of the first container 30 was 21.0%. The amount of dissolved oxygen in the injection water that is contained in the first container was 8.84 mg/L The oxygen permeation amount of the stopper of the first container was measured by using the method illustrated in FIG. 2B. As a result, the oxygen permeation amount was 3 (mL/(day×atm)), and the first container in EXAMPLE 1 had the oxygen permeability.

Subsequently, the second container composed of a transparent packing material that had the oxygen barrier property was prepared. The second container had the structure illustrated in FIG. 1. The second container was a so-called pouch. The liquid-containing first container and the deoxygenated member that included the oxygen absorber were contained in the second container, and the second container was sealed by using heat sealing. The closed second container contained about 100 mL of air. The deoxygenated member included the oxygen absorber that was capable of absorbing 200 mL of oxygen.

Materials and members that were used in EXAMPLE 1, for example, were sterilized. The injection water was contained in the first container, the first container was closed, the liquid-containing first container and the oxygen absorber were contained in the second container, and the second container was closed in a sterile isolator. The use of the sterilized materials and operations in the sterile isolator were the same as those in COMPARATIVE EXAMPLE 1 and COMPARATIVE EXAMPLE 2 described below.

Comparative Example 1

A liquid-containing first container was manufactured in the same manner as in EXAMPLE 1. The liquid-containing first container was used in COMPARATIVE EXAMPLE 1. That is, in COMPARATIVE EXAMPLE 1, a second container was omitted. A rubber stopper of the first container was composed of silicone rubber as in EXAMPLE 1.

Comparative Example 2

In COMPARATIVE EXAMPLE 2, a rubber stopper that closed an opening portion of a container body of a first container was composed of butyl rubber. COMPARATIVE EXAMPLE 2 differed from EXAMPLE 1 in this point, and the other was the same as in EXAMPLE 1. The degree of the oxygen permeability (oxygen transmission rate) of the butyl rubber of which the rubber stopper in COMPARATIVE EXAMPLE 2 was about 80 ($cm^3/(m^2 \times 24\ h \times atm)$) and did not substantially have the oxygen permeability.

Evaluation

In EXAMPLE 1 and COMPARATIVE EXAMPLE 2, each second container was closed, and each liquid-containing combination container was subsequently preserved. In COMPARATIVE EXAMPLE 1, the first container was closed, and the liquid-containing first container was subsequently preserved. In EXAMPLE 1, COMPARATIVE EXAMPLE 1, and COMPARATIVE EXAMPLE 2, a preservation environment was an air atmosphere at 22° C. under the atmospheric pressure. During the preservation, variations in the amount (mg/L) of dissolved oxygen in the injection water, the oxygen concentration (%) in each first container, and the oxygen concentration (%) in each second container over time were checked. The amount (mg/L) of dissolved oxygen in the injection water, the oxygen concentration (%) in each first container, and the oxygen concentration (%) in each second container were measured by using the oxygen amount measuring device Fibox3 made by PreSens Precision Sensing GmbH in Germany. The amount (mg/L) of dissolved oxygen in the injection water, the oxygen concentration (%) in each first container, and the oxygen concentration (%) in each second container were measured from a position outside each container by using the oxygen amount measuring device Fibox3 without damage of the container.

Table 1 illustrates the result of measurement of the oxygen concentration (%) in each second container. Table 2 illustrates the result of measurement of the oxygen concentration (%) in each first container. Table 3 illustrates the result of measurement of the amount (mg/L) of dissolved oxygen in the injection water. The limit of detection of the oxygen concentration by using the oxygen amount measuring device Fibox3 was 0.03%. The limit of detection of the amount of dissolved oxygen by using the oxygen amount measuring device Fibox3 was 0.015 mg/L. As illustrated in Table 1 to Table 3, in EXAMPLE 1, the oxygen concentration in the second container was reduced to 0% when a day elapsed after the second container was closed. In EXAMPLE 1, the oxygen concentration in the first container was able to be reduced to 0%. In EXAMPLE 1, the amount of dissolved oxygen in the injection water that was contained in the first container was able to be reduced to 0 mg/L.

TABLE 1

Variation in Oxygen Concentration in Second Container over Time

| Elapsed Day (Day) | Oxygen Concentration (%) in Second Container EXAMPLE 1 | COMPARATIVE EXAMPLE 1 | COMPARATIVE EXAMPLE 2 |
|---|---|---|---|
| 1 | 0 | — | 0 |
| 2 | 0 | — | 0 |
| 3 | 0 | — | 0 |
| 6 | 0 | — | 0 |
| 7 | 0 | — | 0 |
| 8 | 0 | — | 0 |
| 8.5 | 0 | — | 0 |
| 9 | 0 | — | 0 |
| 10 | 0 | — | 0 |
| 17 | 0 | — | 0 |
| 31 | 0 | — | 0 |

TABLE 2

Variation in Oxygen Concentration in First Container over Time

| Elapsed Day (Day) | Oxygen Concentration (%) in First Container EXAMPLE 1 | COMPARATIVE EXAMPLE 1 | COMPARATIVE EXAMPLE 2 |
|---|---|---|---|
| 1 | 14.95 | 22.07 | 22.25 |
| 2 | 9.05 | 22.23 | 22.10 |
| 3 | 6.70 | 21.00 | 21.85 |
| 6 | 1.60 | 20.10 | 20.80 |
| 7 | 1.45 | 21.33 | 21.80 |
| 8 | 0.80 | 20.93 | 22.60 |
| 8.5 | 0.80 | 22.63 | 23.05 |
| 9 | 0.40 | 21.27 | 21.95 |
| 10 | 0.15 | 20.93 | 21.55 |
| 17 | 0 | 21.73 | 22.00 |
| 31 | 0 | — | 21.45 |

TABLE 3

Variation in Amount of Dissolved Oxygen in Injection Water over Time

| Elapsed Day (Day) | Amount (mg/L) of Dissolved Oxygen in Injection Water EXAMPLE 1 | COMPARATIVE EXAMPLE 1 | COMPARATIVE EXAMPLE 2 |
|---|---|---|---|
| 1 | 5.51 | 8.76 | 8.57 |
| 2 | 3.36 | 8.42 | 8.34 |
| 3 | 2.67 | 8.47 | 8.71 |
| 6 | 0.62 | 7.74 | 7.91 |
| 7 | 0.53 | 8.47 | 8.70 |
| 8 | 0.30 | 8.46 | 8.71 |
| 8.5 | 0.28 | 8.45 | 8.62 |
| 9 | 0.16 | 8.46 | 8.75 |
| 10 | 0.06 | 8.35 | 8.56 |
| 17 | 0 | 8.48 | 8.58 |
| 31 | 0 | — | 8.82 |

REFERENCE SIGNS LIST

101: liquid-containing combination container, 10: combination container, 20: container set, 21: oxygen absorber, 22: deoxygenated member, 30L: liquid-containing first container, 30: first container, 32: container body, 33: opening portion, 34: stopper, 36: fixture, 40: second container, 40*a*: opening, 41*a*: first main film (first film), 41*b*: second main film (second film), 41*c*: first gusset film, 41*d*: second gusset film, 42: container body, 42*a*: container portion, 42*b*: flange portion, 44: lid, 59: supply pipe, 59*a*: discharge port, 60: syringe, 62: cylinder, 63: cylinder body, 64: needle, 66: piston, 67: piston body, 68: gasket, 69: cap, L: liquid

The invention claimed is:

1. A liquid-containing combination container comprising:

a first container that is a vial bottle including a glass container body that includes an opening portion and a stopper that closes the opening portion, the first container containing a liquid such that the stopper is separated from the liquid;

a second container that contains the first container and that has an oxygen barrier property; and an oxygen absorber that absorbs oxygen in the second container, wherein the stopper contains silicone and has oxygen permeability, and wherein an oxygen permeation amount of a cutout portion of the container body is $1\times10^{-1}$ (mL/(day×atm)) or more in an atmosphere at a temperature of 23° C. and a humidity of 40% RH, the cutout portion of the container body including the stopper and an around-portion around the stopper.

2. The liquid-containing combination container according to claim 1, wherein the stopper includes a plate portion that is disposed on the container body and that covers the opening portion and an insertion projection that projects from the plate portion and that is inserted into the opening portion, wherein the first container includes a fixture that is mounted on the container body and that fixes the stopper to the container body, and wherein the portion of the container body includes the fixture.

3. The liquid-containing combination container according to claim 1, wherein the first container is placed in the second container with the opening portion of the container body opening upward, and the stopper covers the opening portion of the container body from above, and wherein the oxygen absorber is at least partly located between the second container and the stopper and above the stopper.

4. The liquid-containing combination container according to claim 1, wherein the container body has an oxygen barrier property.

5. The liquid-containing combination container according to claim 1, wherein the first container includes a fixture that is mounted on the container body and that fixes the stopper to the container body, wherein the stopper includes a plate portion that is disposed on the container body and that covers the opening portion and an insertion projection that projects from the plate portion and that is inserted into the opening portion, wherein the container body and the fixture have an oxygen barrier property, wherein the fixture covers a periphery of the plate portion, and wherein the fixture has an exposure hole from which a region of the plate portion that is exposed to an inside of the container body is exposed.

6. The liquid-containing combination container according to claim 5, wherein a portion of the stopper that is exposed to an inside of the exposure hole includes a linear projecting portion that linearly extends, and wherein the linear projecting portion indicates a position of the region of the plate portion that is exposed to the inside of the container body.

7. The liquid-containing combination container according to claim 1, wherein the second container includes a to-be-opened portion to be opened, and wherein the oxygen absorber is at least partly located between the to-be-opened portion of the second container and the first container.

8. The liquid-containing combination container according to claim 1, wherein the oxygen absorber is at least partly located between the second container and the stopper.

9. The liquid-containing combination container according to claim 1, wherein the first container includes a fixture that is mounted on the container body and that fixes the stopper to the container body, and wherein a deoxygenated member that includes the oxygen absorber and a parcel that contains the oxygen absorber is attached to the fixture.

10. The liquid-containing combination container according to claim 1, wherein a gap is formed between the stopper of the first container that is contained in the second container and the second container.

11. The liquid-containing combination container according to claim 1, wherein the second container includes a first film and a second film that contains the first container between the second film and the first film, wherein the first film and the second film are joined at a seal portion so as to be capable of being peeled, wherein the seal portion includes a first seal portion that bends, and wherein the first seal portion projects so as to be separated from the first container in a direction in which the first seal portion and the first container face each other.

12. The liquid-containing combination container according to claim 1, wherein the second container includes a first film and a second film that contains the first container between the second film and the first film, and wherein the second container is opened in a manner in which the first film and the second film are cut at a to-be-opened portion.

13. The liquid-containing combination container according to claim 1, wherein the stopper includes a surface opposite of the first container and a deoxygenated member that includes the oxygen absorber faces said surface of the stopper.

14. A container set comprising:

a first container that is a vial bottle including a glass container body that includes an opening portion and a stopper that closes the opening portion, the first container containing a liquid such that the stopper is separated from the liquid, a second container that is capable of containing the first container and that has an oxygen barrier property; and an oxygen absorber that absorbs oxygen in the second container, wherein the stopper contains silicone and has oxygen permeability, and wherein an oxygen permeation amount of a cutout portion of the container body is $1\times10^{-1}$ (mL/(day×atm)) or more in an atmosphere at a temperature of 23° C. and a humidity of 40% RH, the cutout portion of the container body including the stopper and an around-portion around the stopper.

15. A method of manufacturing a liquid-containing container, comprising:

closing a second container that contains a first container; and adjusting an amount of oxygen in the first container, wherein the first container is a vial bottle including a glass container body that includes an opening portion and a stopper that closes the opening portion, wherein the first container contains a liquid and the stopper is separated from the liquid, wherein the stopper contains silicone and has oxygen permeability, wherein an oxygen permeation amount of a cutout portion of the container body is $1\times10^{-1}$ (mL/(day×atm)) or more in an atmosphere at a temperature of 23° C. and a humidity of 40% RH, the cutout portion of the container body including the stopper and an around-portion around the stopper, wherein the second container has an oxygen barrier property, and wherein in the adjusting the amount of oxygen, oxygen in the second container is absorbed by an oxygen absorber, oxygen in the first container permeates the first container, and an oxygen concentration in the first container reduces.

16. The method of manufacturing the liquid-containing container according to claim 15, wherein in the adjusting the amount of oxygen, the stopper is away from the liquid.

17. The method of manufacturing the liquid-containing container according to claim 15, wherein in the adjusting the amount of oxygen, the first container is placed in the second container with the opening portion of the container body opening upward, and the stopper covers the opening portion of the container body from above.

18. The method of manufacturing the liquid-containing container according to claim 15, wherein in the adjusting the amount of oxygen, the oxygen concentration in the first container is less than 0.3%, and an oxygen concentration in the second container is less than 0.3%.

19. The method of manufacturing the liquid-containing container according to claim 15, wherein in the adjusting the amount of oxygen, a dissolved oxygen concentration of a liquid in the first container is less than 0.15 mg/L.

20. The method of manufacturing the liquid-containing container according to claim 15, wherein a period until equilibrium of permeation of oxygen through the first container is reached after the second container is closed is within four weeks.

* * * * *